US007255042B2

(12) United States Patent
Sasaki

(10) Patent No.: US 7,255,042 B2
(45) Date of Patent: Aug. 14, 2007

(54) RECORDING APPARATUS AND METHOD OF FOREIGN MATERIAL REMOVAL THEREOF

(75) Inventor: Yoshiharu Sasaki, Shizuoka (JP)

(73) Assignee: Fujifilm Corporation, Tokyo (JP)

( * ) Notice: Subject to any disclaimer, the term of this patent is extended or adjusted under 35 U.S.C. 154(b) by 402 days.

(21) Appl. No.: 10/054,279

(22) Filed: Jan. 24, 2002

(65) Prior Publication Data

US 2002/0168203 A1 Nov. 14, 2002

(30) Foreign Application Priority Data

Jan. 25, 2001 (JP) ..... 2001-016980
Jan. 25, 2001 (JP) ..... 2001-016983
Jan. 25, 2001 (JP) ..... 2001-017020
Jan. 25, 2001 (JP) ..... 2001-017328
Jan. 30, 2001 (JP) ..... 2001-021819

(51) Int. Cl.
*B41F 35/00* (2006.01)

(52) U.S. Cl. ..... 101/425; 101/423

(58) Field of Classification Search ..... 101/425, 101/423; 15/256.52, 256.51, 104.002, 25
See application file for complete search history.

(56) References Cited

U.S. PATENT DOCUMENTS 5,132,737 A * 7/1992 Takeda et al. ..... 399/303
5,349,714 A * 9/1994 Korbonski et al. ..... 15/3
5,402,721 A * 4/1995 Schultz ..... 101/389.1
5,526,746 A * 6/1996 Capdeboscq ..... 101/415.1
5,678,161 A * 10/1997 Kurotaka et al. ..... 399/400
6,024,019 A * 2/2000 Williams et al. ..... 101/463.1
6,196,128 B1 * 3/2001 Corrado et al. ..... 101/425
6,270,074 B1 * 8/2001 Rasmussen et al. ..... 271/276
6,474,236 B1 * 11/2002 Naniwa et al. ..... 101/477
2001/0017996 A1 * 8/2001 Shinoda ..... 399/249

* cited by examiner

*Primary Examiner*—Anthony H. Nguyen
(74) *Attorney, Agent, or Firm*—Sughrue Mion, PLLC

(57) ABSTRACT

In the recording apparatus 121, a recording medium fixing member 123 having a plurality of suction ports on the fixed surface to fix the recording medium 101; an adhering roller 143 which can contact with or separate from the recording medium fixing member 123 and which cleans the fixed surface; a flexible plate 137 which is attached onto the fixed surface of the recording medium fixing member 123 and whose contact surface with the recording medium is cleaned by the adhering roller 143; and a suction apparatus for recording medium fixing which sucks the air from the suction ports of the recording medium fixing member 123 and sucks and fixes the flexible plate 137 and the recording medium 101 onto the fixed surface of the recording medium fixing member 123, are provided.

18 Claims, 32 Drawing Sheets

FIG.34

| | | COMPARATIVE EXAMPLE 1 | EXAMPLE A | EXAMPLE B | EXAMPLE C | EXAMPLE D | EXAMPLE E | COMPARATIVE EXAMPLE 2 | EXAMPLE F | EXAMPLE G |
|---|---|---|---|---|---|---|---|---|---|---|
| CENTRAL PORTION DIAMETER | D | 40.0 | 40.0 | 40.0 | 40.0 | 40.0 | 40.0 | 40.0 | 50.0 | 40.0 |
| END PORTION DIAMETER | d | 40.0 | 39.9 | 39.2 | 38.0 | 37.5 | 36.0 | 35.0 | 49.0 | 39.2 |
| ROLLER LENGTH | L | 500 | 500 | 500 | 500 | 500 | 500 | 500 | 500 | 1000 |
| D・d | | 0 | 0.1 | 0.8 | 2.0 | 2.5 | 4.0 | 5.0 | 1.0 | 0.8 |
| D/d | | 1.000 | 1.003 | 1.020 | 1.053 | 1.067 | 1.111 | 1.143 | 1.020 | 1.020 |
| (D・d)/L | | 0 | 0.0002 | 0.0016 | 0.0040 | 0.0050 | 0.0080 | 0.0100 | 0.0020 | 0.0008 |
| CENTRAL PORTION PRESSURE | | NONE | ENOUGH | ENOUGH | ENOUGH | ENOUGH | ENOUGH | ENOUGH | ENOUGH | ENOUGH |
| END PORTION PRESSURE | | ENOUGH | ENOUGH | ENOUGH | ENOUGH | ALMOST ENOUGH | ALMOST ENOUGH | NONE | ENOUGH | ENOUGH |
| TOTAL PERFORMANCE | | × | ○ | ○ | ○ | △ | △ | × | ○ | ○ |

(UNIT : mm ; HATCHING BOX : OUT OF RANGE)

FLEXURE DIRECTION

FLEXURE DIRECTION

RECORDING APPARATUS AND METHOD OF FOREIGN MATERIAL REMOVAL THEREOF

BACKGROUND OF THE INVENTION

1. Field of the Invention

The present invention relates to a recording apparatus to produce an image on a recording medium being attached onto a recording medium fixing member, more specifically an adhered foreign material removal method or device therefor, and further a method to prevent the position dislocation, separation and film peeling of the recording medium due to the cleaning motion.

2. Description of the Related Art

In the recording of an image or character, there is a recording method by which an image receiving sheet which is a recording medium, and a transfer sheet which is a recording medium in the same manner, are superimposed and fixed on the recording medium fixing member(drum) and exposed by the laser. In this recording medium, one kind of image receiving sheet and a plurality of kinds of transfer sheets such as K (black), C (cyan), M (magenta), Y (yellow), are used. These recording media are set in a cassette for a recording medium of the recording apparatus in a reversal order to the recording order. Accordingly, in the cassette, from the upper layer, the image receiving sheet, and a plurality of recording media in the order of K, C, M, Y, are set in the laminated condition. In this connection, when a plurality of sets of the recording medium are set, these operations are repeated and the recording media are set.

In such the manner, a cassette 103 in which the recording media 101 are accommodated in recording order, is installed in a recording apparatus 105 as shown in FIG. 2. A pickup mechanism 107 is provided in the recording apparatus 105, and the pickup mechanism 107 has a function by which only one sheet of the recording medium 101 of the uppermost layer is picked up from the inside of the cassette 103 by, for example, rubber roller or suction absorption mechanism. By this pickup mechanism 107, after the recording medium 101 whose only one sheet is picked up passes through a conveying mechanism in which a guide plate, not shown, or roller is used, it is fixed on a drum 109 for recording.

As shown in FIG. 3, in the recording apparatus 105, a recording head 111 to conduct, for example, the laser exposure is provided, and the recording head 111 is reciprocally moved in a parallel direction to the rotation axis of the drum 109. The laser light Lb is emitted from the recording head 111, and irradiated as a plurality of spots. In this recording method, the rotation direction of the drum 109 is a main scanning direction, and the movement direction of the recording head 111 is a sub scanning direction. Accordingly, when the rotation movement of the drum 109 and the linear movement of the recording head 111 are combined, the spot scans on the transfer sheet, and a desired image is transferred onto the image receiving sheet.

When the recording apparatus 105 is operated, initially, the image receiving sheet is supplied and conveyed to the drum 109. At this time, the image receiving layer of the image receiving sheet is fixed so as to face the outside of the drum 109. Next, the recording apparatus 105 supplies and conveys a K color transfer sheet onto the image receiving sheet on the drum 109. In this case, the toner layer of the transfer sheet is fixed so as to face the image receiving layer of the image receiving sheet. That is, the image receiving layer of the image receiving sheet and the toner layer of the transfer sheet are superimposed. Next, the recording apparatus 105 records on the recording medium 101 fixed on the drum 109 by the recording head 111. After the recording by the K-color data is completed, only the K-color transfer sheet is peeled off from the drum 109, and delivered to the outside of the recording apparatus 105. When these supplying, recording, and delivering operations are conducted for the C, M, Y-color transfer sheets in the same manner, a desired color image is transferred onto the image receiving sheet.

In this connection, onto the drum of the recording apparatus described above, in order to avoid the image defects due to undulations of the drum surface (cutting flaw at the time of drum processing, cutting streak, groove or hole of the recording medium fixing release mechanism), or to enable to cope with each kind of sizes of recording medium, there is a case where a flexible plate (plate) is attached. In such the recording apparatus, the recording defects due to the adherence of the foreign material onto the flexible plate becomes a problem. The recording defects due to the adherence of the foreign material are largely divided into two kinds. One is the recording defect (generation of so-called [image reversing]) in the case where the foreign material on the flexible plate is adhered onto the image receiving sheet. Another one is the recording defect (generation of so-called [ring unevenness]) in the case where the foreign material is adhered onto the flexible plate.

The image reversing is generated due to the generation of the poor close contact of the transfer sheet with the image receiving sheet by the foreign material when the foreign material exists on the image receiving sheet. Further, the ring unevenness is generated when the foreign material exists on the flexible plate. That is, in the central portion in which the foreign material exists, although the transfer sheet and the image receiving sheet are closely contacted with each other, in its periphery, a gap is formed ring-like between the transfer sheet and the image receiving sheet, therefore, the transferring can not be performed in this gap, and the white un-transferred portion is generated ring-like around the foreign material. Further, due to the foreign material adhered on the flexible plate, the position dislocation is generated in the perpendicular direction to the rotation axis of the drum, and the focal point of the laser light for recording is shifted, and the sufficient energy density can not be obtained, and there is a case where the thinning of the image or lowering of the density is generated, and the image unevenness is generated.

Further, in the conventional apparatus, as described above, although the foreign material adhered onto the recording medium during the apparatus operation can be removed, the foreign material adhered and piled onto the recording medium conveying means such as the rotating drum for the recording or nip roller in the condition that the recording medium is not conveyed such as the case where the apparatus is not used, can not be removed. Therefore, specifically, the foreign material is adhered onto the image receiving sheet conveyed just after the power supply of the apparatus is turned on, and the image defect is generated.

Next, after these recording media are supplied to a supply tray, the uppermost one sheet is taken out by a pick-up roller, and conveyed to the rotating drum for the recording position by a conveying roller (nip roller) arranged on an intermediate route of a conveying path, and wound around the drum surface and fixed. In this manner, on the recording medium conveying path in the recording apparatus, several conveying rollers are arranged, and by these conveying rollers, the recording medium is conveyed at a predetermined timing.

In these conveying rollers, when any one roller is an adhesive roller, there is a case where the conveyance and cleaning effects are provided together, or a cleaning roller (formed of the adhesive roller) for the purpose of foreign material removal is provided separately from the conveying roller. When the adhesive roller is provided, the removal of the foreign material adhered onto the recording material and removal of the foreign material adhered during the recording medium conveyance can be conducted. Further, when the cleaning roller is arranged so that it can come into contact with the rotating drum for the recording, the removal of the foreign material adhered onto the rotating drum for the recording, and the removal of the foreign material adhered onto the recording medium during the supply and conveyance of the recording medium to the rotating drum for the recording, or the removal of the foreign material adhered onto the recording medium during the delivery conveyance of the recording medium from the rotating drum for the recording, can be conducted.

For the pick-up roller, conveying roller, and cleaning roller used in the conventional recording apparatus, generally, a roller of straight shape in which the diameter of the roller is constant along the whole width direction, is used. In this roller of straight shape, when the roller is brought into contact with the other material by only self weight of the roller, the contact can be evenly conducted along the whole width direction of the roller, however, when, as the nip roller 370 shown in FIG. 35(*a*), it structures the roller pair, and nips with a predetermined pressing force between each of rollers, because the roller is bent, there is a tendency that the pressing force at the central portion in the width direction of the roller is smaller, and in the worst condition, there is a case that the pressing force at the central portion can not be obtained. Further, even when the nip roller is not structured, as shown in FIG. 35(*b*), for example, a drive mechanism 372 such as air piston is provided on both ends of the roller, and the roller 374 can be pressed onto the opposite surface. In the same manner also in this case, there is a tendency that the pressing force at the central portion in the width direction becomes small by the bend generated in the roller 374.

In this connection, the recording medium conveyed in the recording apparatus makes, when it is wound around the rotating drum for the recording and fixed, the image receiving sheet and the color material sheet superimposed, and closely contacted with each other by the vacuum suction or pressure roller. In the degree of the close contact, it is large at the edge portion of the sheet, and at almost the central portion of the sheet, because the air flow resistance becomes large, the suction easily becomes insufficient, and there is a case where the close contact is not conducted sufficiently. In this condition, when the foreign material exists on the sheet, the image defect due to the foreign material is particularly easily conspicuous at the central portion in the width direction. Therefore, it is necessary that the foreign material removal at the central portion in the width direction is assuredly conducted.

Accordingly, when the recording medium is pressed by the pressure roller (for example, a laminate roller, cleaning roller, squeeze roller) which can be brought into contact with the surface of the rotating roller for the recording, from the above reason, the pressing force at the central portion in the width direction of the roller becomes weak, and there is a problem that the degree of the close contact of the recording medium is lowered.

Further, when the material used for the adhesive roller is an adhesive rubber material or adhesive substance, because there is a case where the adhesive strength is lowered by the natural aging, therefore, after the production of the adhesive roller, the adhesive strength is lowered after about 302-303 months, and the ability to remove the foreign material on the recording medium is lowered. As the result, there is a problem that a portion on which a desired image is not recorded is generated on the recording image, and the image defect is generated.

In the related cleaning method of the recording medium, one end portion of the recording medium set on the rotating drum for the recording is a cleaning start point, and the other end portion is a cleaning end point, and a cleaning roller is brought into contact with the recording medium and the cleaning is continuously conducted. In FIG. 43, the conventional cleaning procedure is shown. As shown in FIG. 43(*a*), when a cleaning roller 450 is brought into contact with the end portion 1*a* of the recording medium or the drum surface on this side of the end portion 1*a*, and the rotating drum for the recording 412 is rotated, at the end portion 1*a* of the recording medium, because there is a tendency that the suction force to the rotating drum for the recording 412 is lowered, the adhesive strength of the cleaning roller 450 is sometimes relatively larger than the vacuum suction force from the rotating drum for the recording 412. In this case, as shown in FIG. 43(*b*), the end portion 1*a* of the recording medium 401 is wound around the cleaning roller 450. Further, in the same manner, when the cleaning roller 450 which is brought into contact with the recording medium 401 is vertically separated from the recording medium 401 at the end portion 1*a*, there is a possibility that the recording medium 401 is pulled up and a portion of the end portion 1*a* is separated from the rotating drum for the recording 412, or the film of the recording medium 401 is peeled off.

Therefore, the adhesive strength of the cleaning roller 450 is previously appropriately designed corresponding to the characteristic of the recording medium 401, and when it is necessary that the applicable kind of the recording medium 401 is enlarged or the foreign material is removed more strongly, there is sometimes a case in which the cleaning roller formed of the material having the strong adhesive strength is used, or the rubber roller whose rubber hardness is small and whose flexibility is high is used. In this case, because the adhesion property of the cleaning roller 450 is strong, problems in which the position dislocation is generated in the recording medium 401 on the rotating drum for the recording 412, or the suction leakage for the recording medium fixing is increased by this position dislocation, and the recording medium 401 is separated from the rotating drum for the recording 412, or the film (the image receiving layer 2*c* of the image receiving sheet 402 or cushion layer 2*b*) of the recording medium 401 is peeled off, are generated.

Further, as a conveying mechanism of the sheets used for the above related arts, there is a mechanism in which the image receiving sheet or transfer sheet is previously cut into a predetermined dimensions, and the image receiving sheet and the transfer sheet of a plurality of colors (or single color) are accommodated in a cassette of the recording apparatus, and at the time of recording, these sheets are successively conveyed, or on the one hand, a mechanism in which a roll for the image receiving sheet and a plurality of rolls corresponding to the plurality of colors of the transfer sheet are provided in the recording apparatus, and at the time of recording, these sheets are cut into predetermined dimensions by respective rolls, and conveyed to the rotating drum for the recording.

The image receiving sheet conveyed by the above mechanism, after it is wound around the rotating drum for the recording with the image receiving surface facing upward and fixed, the transfer sheet is conveyed to the rotating drum for the recording and the toner layer of the transfer sheet is superimposed on the image receiving layer of the image receiving sheet, and wound around the rotating drum for the recording. In this manner, onto the image receiving sheet and the transfer sheet which are superimposed on each other on the rotating drum for the recording, the laser exposure is conducted by the recording head. In the recording by the laser exposure, the recording and transferring is conducted when the rotating drum for the recording is rotated in the circumference direction of the drum, and the recording head is reciprocally moved in the rotating axis direction of the rotating drum for the recording. Then, the transfer sheet onto which the first transfer is conducted, is peeled off from the image receiving sheet, and after it is delivered, the next transfer sheet is conveyed in such a manner that it is superimposed on the image receiving sheet on the rotating drum for the recording, and fixed, and after that, it is transferred onto the image receiving sheet. After the transfer process onto the image receiving sheet is conducted for a plurality of times (a plurality of colors), when the image receiving sheet onto which the transfer is conducted, is transferred onto the another sheet, a desired color recording is conducted.

In this connection, there is sometimes a case in which the foreign material such as dirt or dust is adhered onto the surface of the recording medium supply section, recording medium conveying section, recording section in the recording apparatus, or recording medium during conveying by the static electrical force, and when recording is conducted without removing these foreign material, it becomes a cause by which the image defect such as the [image reversing] due to the existence of the foreign material between the image receiving sheet and the transfer sheet, or the [ring unevenness] due to the mixing of the foreign material between the drum for the recording and the image receiving sheet or between the transfer sheet and the roller, is caused. Therefore, the adhesive roller (cleaning roller) using the adhesive rubber is arranged in order to remove the foreign material adhered onto the surface of the conveying path of the recording material or recording section in the recording apparatus, and the adhesive roller is pressed on the surface which is the object of the foreign material removal, periodically or in need, and the foreign material is removed, and the system is made so that the good recording condition is always maintained.

However, recently, there is a system in which the pressing of the adhesive roller onto the surface which is the object of the foreign material removal is conducted by a movement apparatus such as an air cylinder, and at the time of requirement or periodically, the adhesive roller is automatically moved onto the objective surface of the foreign material removal, and the foreign material of the surface is removed. However, in the adhesive roller provided with the movement mechanism, the control of the pressing force onto the foreign material removal surface, that is, the minute amount control of the movement amount of the movement mechanism is difficult, and there is a case in which a poor foreign material removal due to insufficient pressing force onto the foreign material removal surface is generated, or the position dislocation of the image receiving sheet or transfer sheet fixed onto the rotating drum for the recording due to the increase of the adhesive strength by the excessive pressing force is generated. Further, due to the excess of the pressing force onto the sheet surface of the adhesive roller, the adherence peeling of the surface layer such as the image receiving layer of the image receiving sheet or cushion layer, or the adherence peeling of the surface layer such as the color material layer of the transfer sheet or photo thermal conversion layer is frequently generated. Then, every time when the poor recording due to the adherence peeling of the image receiving sheet or transfer sheet is generated, it is necessary that the recording apparatus is stopped, and the operation such as the taking out of the poor sheet or the reset of the image receiving sheet or transfer sheet is conducted, thereby, the transfer recording efficiency of the recording apparatus is not always good, and the improvement of the foreign material removal mechanism using the adhesive roller is required.

SUMMARY OF THE INVENTION

In view of the foregoing conditions, the present invention is attained and an object of the present invention is to provide a recording apparatus by which the image defects such as the image reversing or ring unevenness generated by the foreign material adhered onto the flexible plate are reduced, and a foreign material removal method thereof.

A recording apparatus described in the first aspect of the present invention to attain the above object is characterized by comprising: a recording medium fixing member having a plurality of suction ports on the fixed surface to fix the recording medium; an adhering roller which can contact with or separate from the recording medium fixing member and which cleans the fixed surface; a flexible plate which is attached onto the fixed surface of the recording medium fixing member and whose contact surface with the recording medium is cleaned by the adhering roller; and a suction apparatus for recording medium fixing which sucks the air from the suction ports of the recording medium fixing member and sucks and fixes the flexible plate and the recording medium onto the fixed surface.

In this recording apparatus, the adhering roller is brought into contact with the flexible plate attached onto the recording medium fixing member, the foreign material adhered onto the flexible plate is sucked by the adhering roller, and the flexible plate can be cleaned. Thereby, the image defect such as the image reversing or ring unevenness generated by the foreign material adhering is reduced. Further, the suction apparatus for the recording medium fixing is operated, and flexible plate in the condition being sucked by the recording medium fixing member can be cleaned by the adhering roller. That is, the flexible plate is sucked onto the fixed surface of the recording medium fixing member and held by the high fixing force, and even by the adhesive force of the adhering roller, dislocation, floating and coming-off are not generated to the recording medium fixing member. Thereby, in the subsequent processes, the doubling or apparatus error due to the dislocation of the flexible plate is not generated, and the stability of the apparatus operation after the cleaning is enhanced.

According to a further aspect of this invention, the object of the present invention is to provide the recording apparatus by which, after the apparatus power supply is turned on, and before the supply of the recording medium to the recording section by the recording medium conveying means, the foreign material adhered onto the recording section or the recording medium conveying means such as nip roller is removed and the good image recording can be conducted. Further, another object of the present invention is to provide a foreign material removal method of the recording apparatus.

In order to attain the above object, the invention of the recording apparatus of the first aspect of the present invention is, in a recording apparatus which is provided with a recording medium conveying means which holds a recording medium and conveys it from a recording medium supplying section to a recording section, the apparatus is provided with a rotatable adhesive roller, and the adhesive roller comes into contact with a conveying roller which is a recording medium conveying means, and is rotated at least just before the recording medium is conveyed corresponding to turning-on of a apparatus power supply, or recording start command.

Then, according to the adoption of the structure described above, the adhesive roller can remove the foreign material adhered onto the recording medium conveying means when the apparatus is not used.

According to another aspect of this invention, the present invention is attained by having an eye to such the conventional problems, and the object of the present invention is to provide a recording apparatus by which the foreign material is removed by using the adhesive roller in which the pressing force is uniformly obtained over the whole width direction of the recording medium, and the aging deterioration of the adhesive strength is small, particularly the adhesive rubber roller, and a foreign material removal method.

The recording apparatus of the present invention to attain the above object is such that it is provided with a recording medium supply section, recording medium conveying section and recording section, and at least in any one of respective sections, an adhesive roller for foreign material removal using an adhesive material is provided, wherein the adhesive roller is a crown shape formed in such a manner that the diameter of the central portion is not smaller than the diameter of both end portions in the axial direction of the roller main body.

According to another feature of this invention, the object of the present invention is to provide a cleaning method of the recording medium by which, even when the adhesion property of the cleaning roller is large, the cleaning can be conducted without affecting the bad effect such as position dislocation on the fixed recording medium, and a recording apparatus.

According to yet another aspect of this invention, a cleaning method of the recording medium is as follows. A cleaning method of a recording medium by which, while a cleaning roller having the adhesion property is brought into contact with the recording medium sucked and fixed on the surface of a recording medium fixing member, a cleaning roller is relatively moved to a recording medium fixing member, and the foreign material on the recording medium surface is removed, wherein the cleaning is conducted from almost central portion of the relative movement direction of the recording medium fixed onto the recording medium fixing member to the one relative movement direction end portion, and after that, the cleaning is conducted from almost central portion of the relative movement direction of the recording medium to the other relative movement direction end portion.

In still further aspect of the invention, a cleaning roller is brought into contact with the almost central portion of the relative movement direction of the recording medium, and when the cleaning roller is relatively moved to one relative movement direction end portion, the recording medium surface is cleaned, and after that, the cleaning roller is brought into contact with the almost central portion of the relative movement direction of the recording medium again, and the cleaning roller is relatively moved to the other relative movement direction end portion, and the recording medium surface is cleaned, thereby, even when the adhesion property of the cleaning roller is large, there is no possibility that the end portion of the fixed recording medium is turned over, film peeling is caused, and the position dislocation of the recording medium is generated, and the overall recording medium surface is cleaned. Thereby, the image defect of the recording image is prevented and the high quality image formation can be conducted.

In view of the above circumstances, the present invention is attained and the object of the present invention is to provide an adhesive roller by which the excess of the pressing force (adhesive strength) of the adhesive roller is previously regulated, and by a desired pressing force, the removal of the foreign material adhered onto the surface of the foreign material removal objective surface such as the sheet or rotating drum for the recording is finely conducted, and the good image recording can be obtained.

In order to attain the above object, the adhesive roller according to the present invention is structured as follows: an adhesive roller which is provided in a recording apparatus, and has; a movement section which conducts the pressing onto the surface and separation from the surface to remove a foreign material adhered onto the surface of a recording medium supply section, recording medium conveyance section, recording section in the recording apparatus, and recording medium during the conveyance; a core portion of the cylindrical shape; and an adhesive member attached onto the core portion, wherein, at the both end portions of the adhesive roller, in order to regulate the compression deformation of the adhesive member when the adhesive roller is pressed onto the surface, regulation disks which have a diameter not larger than the outer diameter of the adhesive member, and which are formed of the material not softer than the adhesive member, are provided.

BRIEF DESCRIPTION OF THE DRAWINGS

FIG. 34 is a view showing a result in which, for the adhesive rollers having the different shapes, their performances are compared.

DESCRIPTION OF THE PREFERRED EMBODIMENTS

Figure 1:
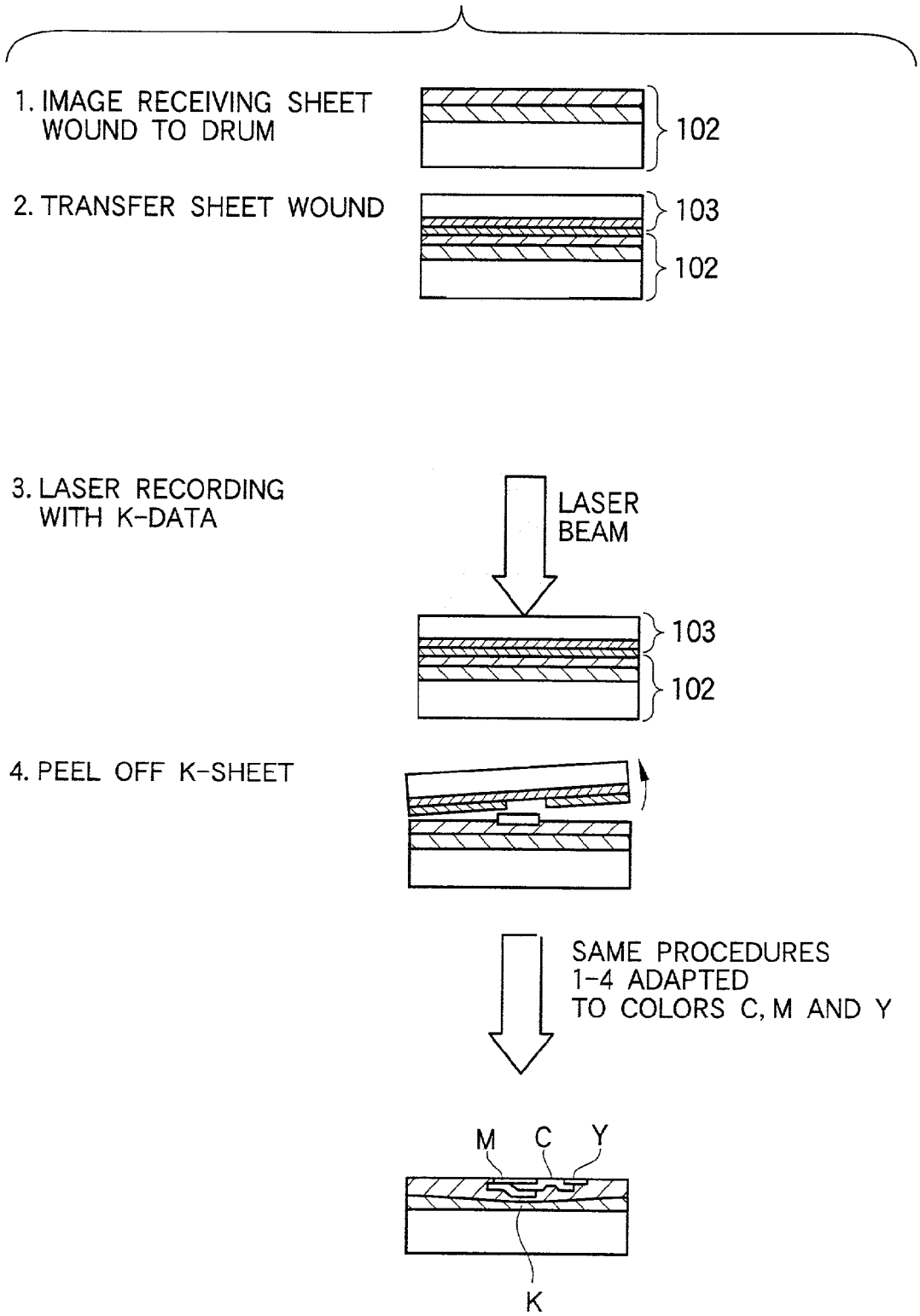
FIG. 1 is a sectional view showing a recording procedure onto the recording medium.

Referring to the drawings, the preferred embodiment of a recording apparatus used for the present invention will be described below.

Figure 2:
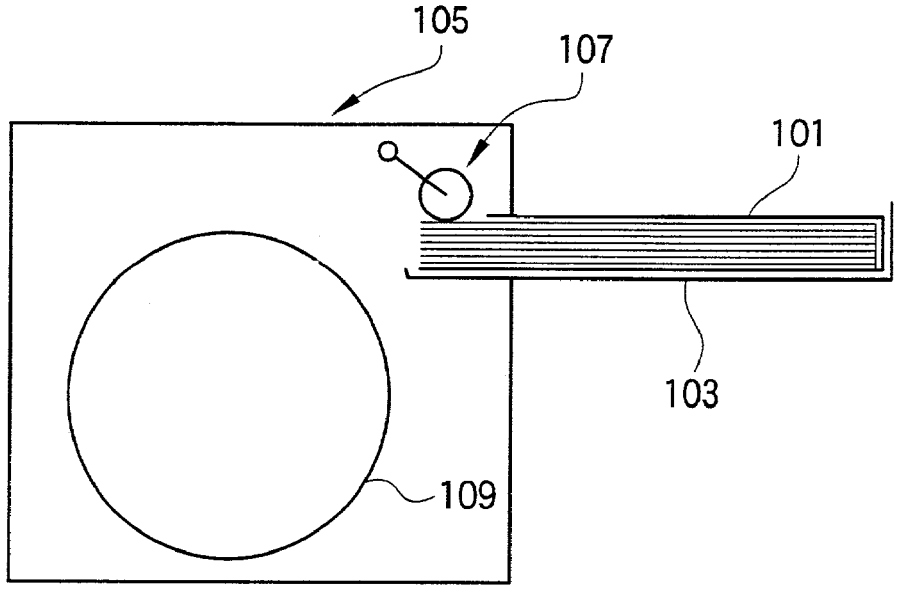
FIG. 2 is a side view showing the outline of the structure of the conventional recording apparatus.
Figure 3:
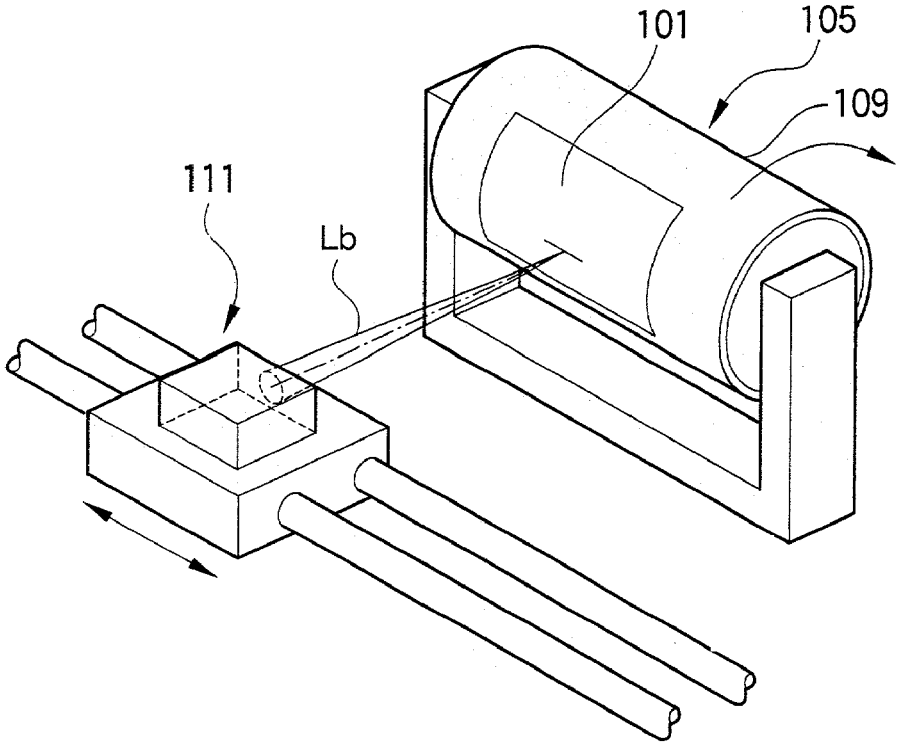
FIG. 3 is a perspective view of the recording apparatus shown in FIG. 2.
Figure 4:
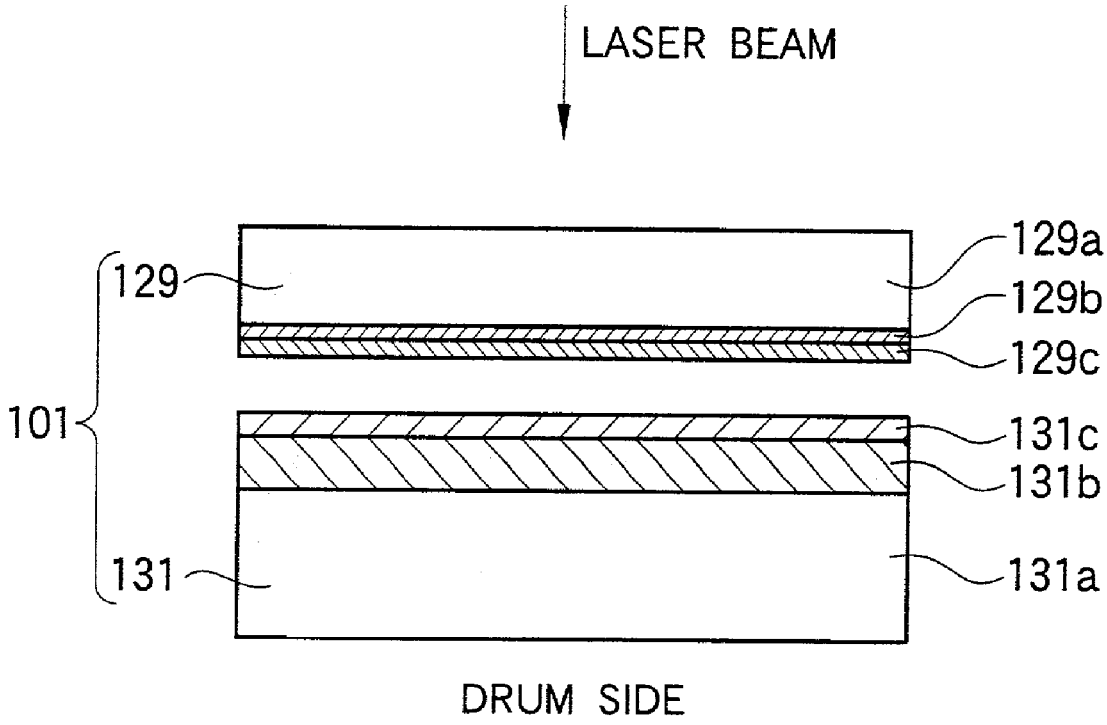
FIG. 4 is sectional view of the recording medium.
Figure 5:
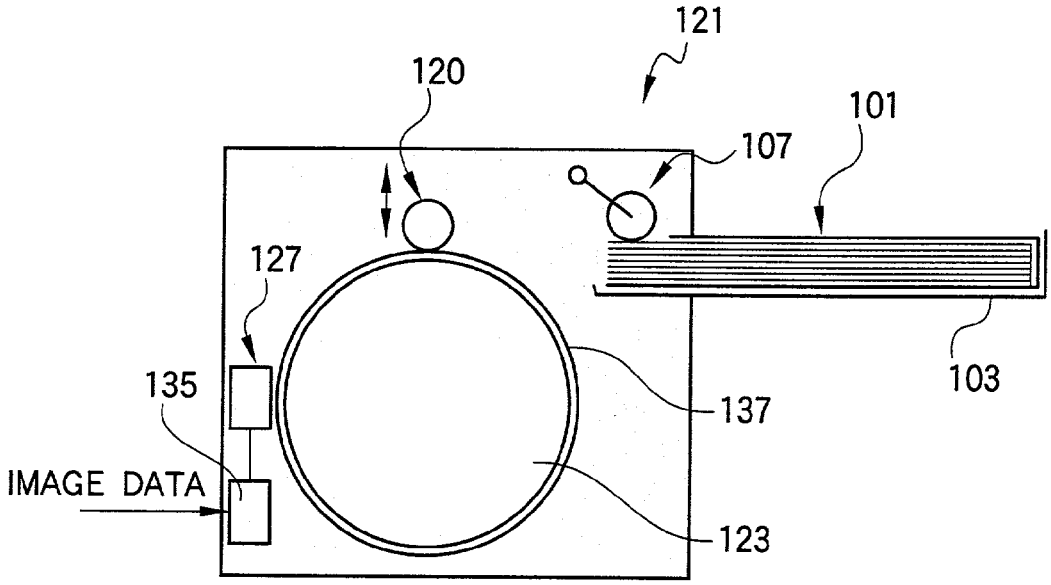
FIG. 5 is a side view showing the outline of the structure of a recording apparatus according to the present invention.
Figure 6:
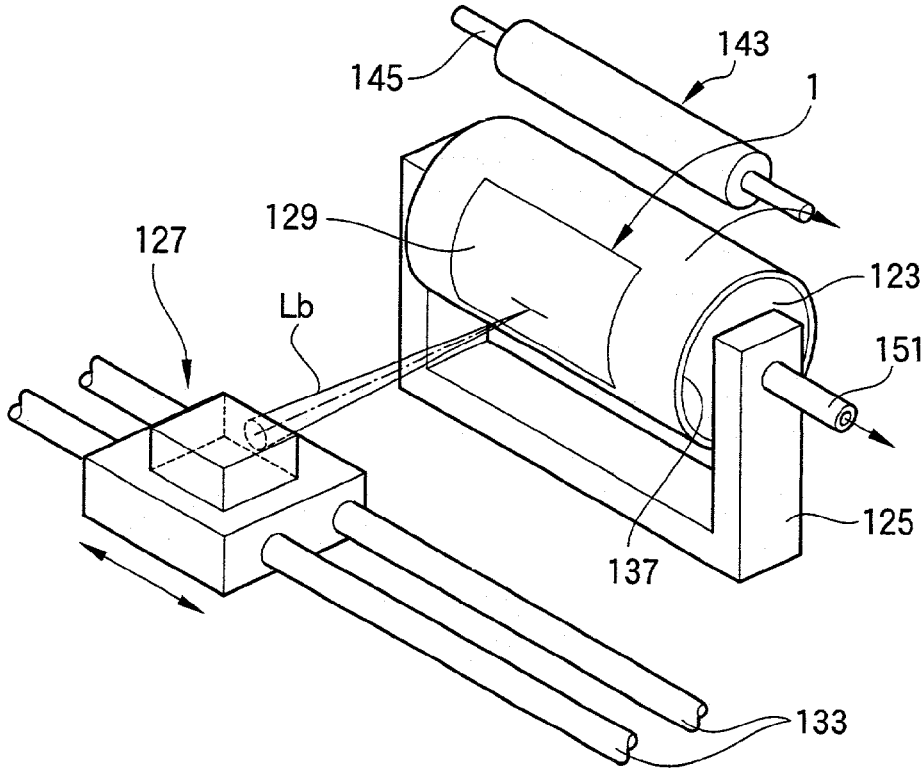
FIG. 6 is a perspective view of the recording apparatus shown in FIG. 5.
Figure 7:
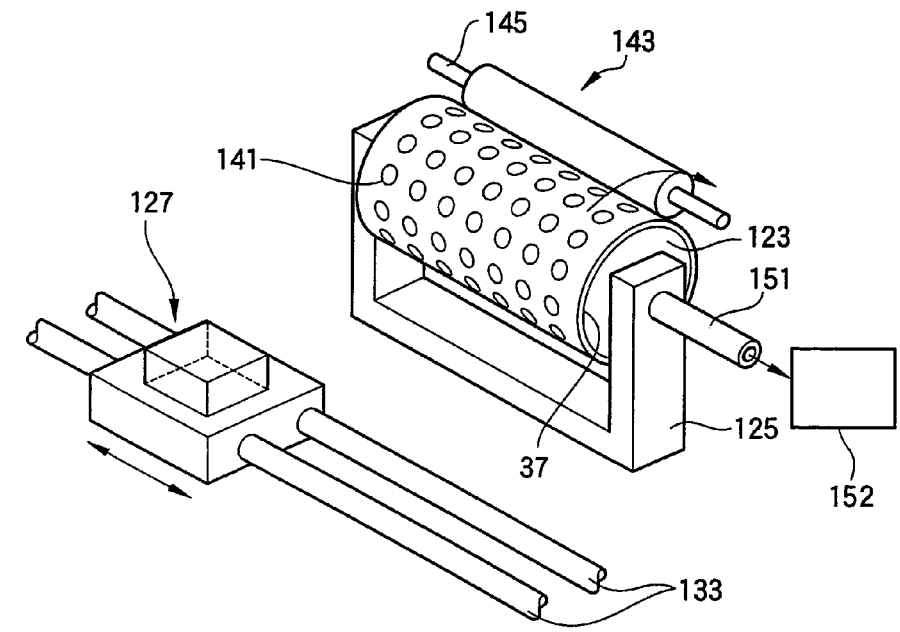
FIG. 7 is a perspective view of the recording apparatus in which a flexible plate is attached onto a recording medium fixing member.
Figure 8:
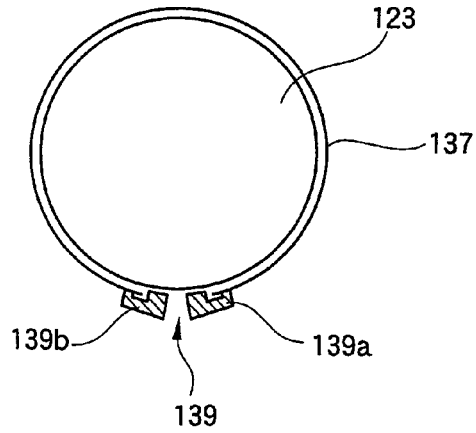
FIG. 8 is a side view expressing a fixing/releasing mechanism of the flexible plate.
Figure 9A:
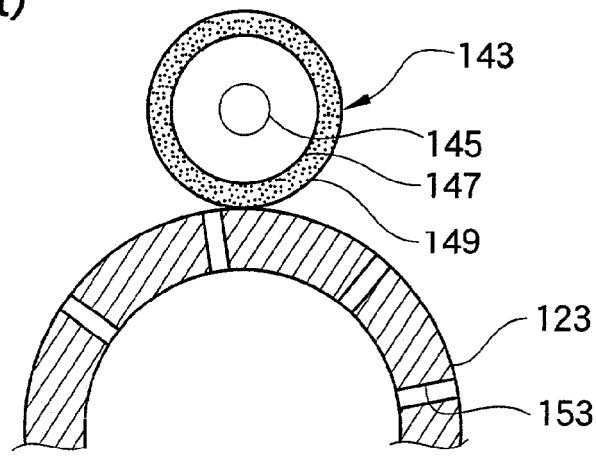
FIGS. 9(*a*) to 9(*c*) show an illustration in which the cleaning condition by an adhering roller.
Figure 9B:
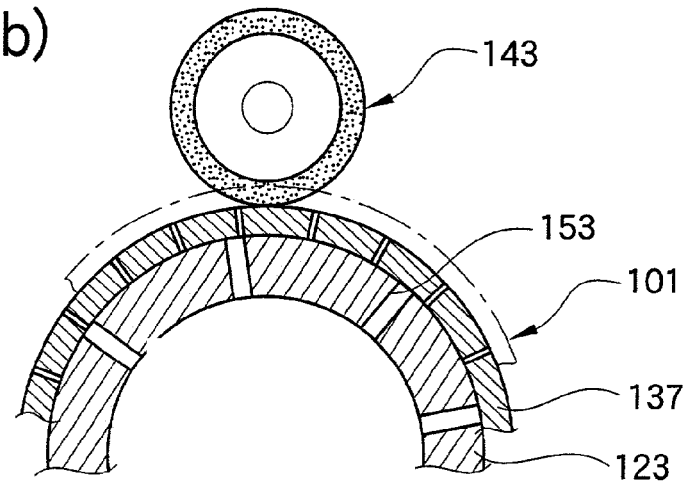
Figure 9C:
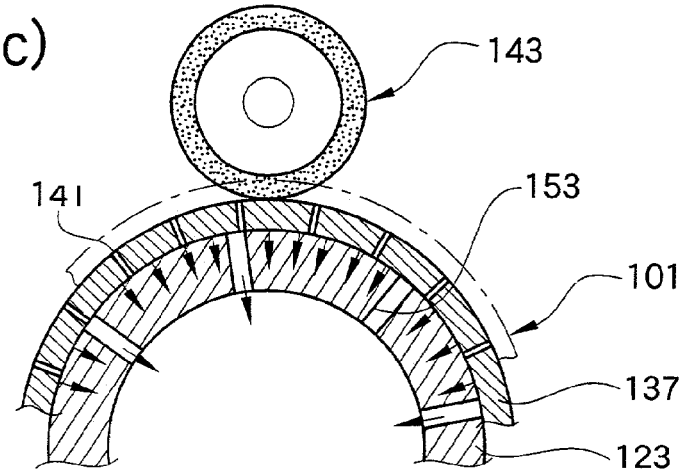

FIG. 5 is a side view showing an outline of the structure of the recording apparatus according to the present invention, FIG. 6 is a perspective view of the recording apparatus shown in FIG. 5, and FIG. 7 is a perspective view of the recording apparatus in which the flexible plate is attached onto the recording medium fixing member, FIG. 8 is a side view expressing the fixing releasing mechanism of the flexible plate, FIG. 9 is an illustration in which the cleaning condition by the adhering roller is shown by (a)-(c), FIG. 4 is a sectional view of the recording medium, and FIG. 1 is an illustration showing the recording procedure into the recording medium. In this connection, the same member as the member shown in FIG. 2 is denoted by the same sign, and the duplicated description is neglected.

A drum 123 which is a recording medium fixing member is provided in a recording section of a recording apparatus 121. The drum 123 has a hollow cylindrical shape, and is rotatably held by a frame 125 shown in FIG. 6. In the recording apparatus 121, the rotational direction of the drum 123 is a main scanning direction. The drum 123 is connected to the rotation axis of a motor, not shown, and rotated and driven by the motor.

Further, a recording head 127 is provided in the recording section. The recording head 127 can emit the laser light Lb. A toner layer of a transfer sheet 129 at the position at which this laser light Lb is emitted is transferred onto the surface of an image receiving sheet 131. Further, the recording head 127 can be linearly moved in a direction parallel to the rotation axis of the drum 103 along a guide rail 133. This movement is controlled when a control section 135 sends a control signal to the motor and a drive mechanism according to the inputted image data. In the recording apparatus 121, this movement direction is a sub scanning direction. Accordingly, by the combination of the rotation movement of the drum 123 and the linear movement of the recording head 127, the laser exposure can be conducted onto a desired position on the transfer sheet 129 which covers the image receiving sheet 131. Accordingly, the transfer sheet 129 is scanned by the laser light Lb for the drawing and when only the corresponding position according to the image information is laser-exposed, the desired image can be transferred onto the image receiving sheet 131.

In this connection, the recording head 127 is not limited to a head of the method which emits the laser light Lb, but a head of the heating method in which a plurality of heating elements are parallely arranged in the sub scanning direction, so-called a head of a method by a thermal head, may also be allowable.

Next, the following description explains the procedure in which the recording medium is supplied onto the drum 123 whose plate 137 is cleaned in the manner as will be described later in this invention, and the color image is formed.

The image receiving sheet 131 has, as shown in FIG. 4, a supporting layer 131*a*, cushion layer 131*b*, and image receiving layer 131*c*, and the cushion layer 131*b* and image receiving layer 131*c* are successively laminated on the supporting layer 131*a*. As the supporting layer 131*a*, PET polyethylene terephthalate) base, TAC (triacetyl cellulose) base, or PEN (polyethylene naphthalate) base can be used. The image receiving layer 131*c* has a function to receive the toner to be transferred. The cushion layer 131*b* has a function to absorb the step difference when a plurality of toner layers are superimposed.

The transfer sheet 129 has, as shown in FIG. 4, the supporting layer 129*a*, photo thermal conversion layer 129*b*, and toner layer 129*c*, and on the supporting layer 129*a*, the photo thermal conversion layer 129*b* and the toner layer 129*c* are successively laminated. When it is a material through which the laser light transmits, the supporting layer 129*a* can be arbitrarily selected from a general supporting material (for example, the same supporting material as the supporting layer 131*a*). The photo thermal conversion layer 129*b* has a function by which the laser energy is converted into the heat. When it is a material by which the light energy is converted into the heat energy, such as carbon, black material, infrared absorption dye, or specific wavelength absorption material, the photo thermal conversion layer 129*b* can be arbitrarily selected from a general photo thermal conversion material. As the toner layer 129*c*, each color of black (K), cyan (C), magenta (M), and yellow (Y) is prepared.

In the recording apparatus 121, the transfer sheet 129 is further superimposed and wound on the image receiving sheet 131 wound around the drum 123. Then, on the transfer sheet 129 superimposed on the image receiving sheet 131, the laser exposure is conducted according to the image information which is desired to be recorded. When the toner of the transfer sheet 129 of a portion which is heated by the laser exposure, is adhered and transferred onto the image receiving sheet 131 by the deterioration of adhesive property, fusing or sublimation, an image is formed on the image receiving sheet 131. Further, onto the same image receiving sheet 131, when a plurality of different colors (for example, black, cyan, magenta, yellow) of toners of the transfer sheet 129 are adhered, a color image can be formed on the image receiving sheet 131. This is accomplished, as will be described later, while the image receiving sheet 131 is wound around the drum 123, when the exposed transfer sheet 129 is successively replaced with the transfer sheet for another color, and the laser exposure is conducted thereon.

Next, the procedure by which a desired color image is formed on the image receiving sheet 131 by using transfer sheets of 104 colors of black, cyan, magenta, and yellow, will be described. When the cassette 103 is set to the recording apparatus 121, a pick-up mechanism 107 is moved, and as shown in FIG. 1, initially, in the step 101, the uppermost image receiving sheet 131 is supplied to the drum 123. Next, in the step 102, the transfer sheet 129 of black (K) is supplied to the drum 123. In the next step 103, the transfer sheet 129 is heated and pressed, and laminated. There is sometimes a case in which this laminating process is omitted.

In the next step 104, according to the previously given image data, the image is transferred and outputted onto the image receiving sheet 131. Herein, the given image data is further color-separated into each color of image, and the laser exposure is conducted according to the image data for each color which is color-separated. Thereby, a portion of the toner layer 129*c* of the transfer sheet 129 is transferred onto the image receiving sheet 131, and an image is formed on the image receiving sheet 131.

Then, in the step 105, only the (K) transfer sheet 129 is separated from the drum 123. Herein, for the transfer sheets 129 of all colors, it is judged whether the transferring is completed. Then, when the supply of another kind of transfer sheet 129 is necessary, the processes of the above steps 2 to 5 are repeated. That is, for the other transfer sheet 129 of each color of cyan, magenta and yellow, each operation of steps 6-17 is repeated. As the result, the toner ink KCMY of transfer sheet 129 of four colors is transferred onto the image receiving layer 131*c* of one image receiving sheet 131, and a color image is formed on the image receiving sheet 131.

Then, the image receiving sheet 131 is peeled off from the drum 123. The peeled image receiving sheet 131 is heated and pressed in the image transfer section, not shown, which is separately structured, in the condition that the image formed surface is superimposed on the printing sheet which is an object to be printed. Thereby, the toner layer on the image receiving sheet is further transferred onto the printing sheet and the color printing for correction is conducted.

First Embodiment

Next, the first embodiment of a recording apparatus and foreign material removal method according to the present invention will be detailed below.

Onto the drum 123, to avoid an image defect by the undulation of the drum surface (cutting flaw at the time of drum processing, cutting streak, a groove or hole of the recording medium fixing release mechanism), or to enable to cope with each kind of sizes of recording media, a flexible plate (plate) 137 is attached. The plate 137 is formed in a thin plate shape of synthetic resin such as acetal resin, phenol resin, urethane resin, high hardness rubber, ethylene tetra fluoride resin, or by metal, and has flexibility so that it can be wound around the outer peripheral surface of the drum 123. The plate 137 is, as shown in FIG. 7, supplied onto the outer peripheral surface of the drum 123 before the image receiving sheet 131 is supplied onto the drum 123, and attached. This plate 137 is wound around the outer periphery of the drum 123 by the rotation of the drum 123, and both ends of the drum circumference direction are fixed by a fixing/releasing clump 139 shown in FIG. 8 provided on the outer periphery of the drum 123. Herein, it is preferable that at least one of the leading edge fixed portion 139*a* and the trailing edge fixed portion 139*b* of the fixing/releasing clump 139 can be moved in the circumference direction on the outer periphery of the drum 123 so that the various length of recording media can be fixed on the drum 123.

The plate 137 can previously be made a hole (through groove, through hole, or slit) 141. When the plate 137 can be conveyed to a correct drum position, it is desirable that a hole 141 coinciding with a suction port of the drum 123, which will be described later, is made in the plate 137. It may be allowable that this hole 141 does not always coincide perfectly with the suction hole on the drum 123, or the hole 141 is thinned and made. In this case, when the original recording medium is supplied to the drum 123 and fixed, it is necessary that the hole 141 is made so that it coincides with the suction port in the degree that it does not drop from the drum 123 or does not come off from the drum 123, or the lowest number of holes 141 are provided. In such the manner, when the hole 141 is made in the plate 137, in addition to the suction ports at the upper, lower, left and right ends, provided on the drum 123, which will be described below, because a portion to suck the recording medium is increased, the recording medium can be further assuredly fixed on the drum 123.

In the vicinity of drum 123, an adhering roller 143 which is rotatable by the rotation axis of the same direction as the rotation axis of the drum 123 is arranged. This adhering roller 143 can be parallely moved by the movement mechanism in which the rotation axis 145 is not shown, and the outer peripheral surface can be brought into contact with the drum outer peripheral surface. This adhering roller 143 is structured by having the core bar 147, and a adhering rubber 149 which is provided around the core bar 147 and removes the foreign material on the recording medium by its coking property, and is structured so that it can remove the foreign material adhered onto the drum 123 and the plate 137.

Because the adhesive strength of the adhering roller 143 is within the range of 10-65 HPa, the ill effect by the adhering roller 143 is suppressed, and the cleaning function can be assured. That is, when the adhesive strength of the adhering roller 143 is not smaller than 65 HPa, the adhesive strength is too strong, and the probability that the plate 137 is floated from the drum 123 by the contact of the adhering roller 143, is generated. On the one hand, the adhesive strength of the adhering roller 143 is not larger than 10 HPa, the adhesive strength is too strong, and the sufficient foreign material removal effect can not be obtained.

Further, when the hardness of the adhering roller 143 is within the range of 10-70° (JIS A), the ill effect by the adhering roller 143 is suppressed, and the cleaning function can be assured. That is, when the hardness of the adhering roller 143 is not larger than 10°, it is too soft and when the adhering roller is pressed onto the plate 137, the adhering roller 143 is largely collapsed, and the contact surface with the plate 137 is increased, and in the same manner as the above, the possibility that the plate 137 is floated from the drum 123. On the one hand, when the hardness of the adhering roller 143 is not smaller than 70°, it is too hard, and when the adhering roller 143 is pressed onto the plate 137, the deformation of the adhering roller 143 is small, and the contact surface with the plate 137 is decreased, or a portion which is not brought into contact with the adhering roller 143, is generated in the longitudinal direction of the adhering roller, and the sufficient foreign material removal effect can not be obtained.

That is, the adhesive strength of the adhering roller 143 is decided according to the equilibrium of allowance degree of both of the foreign material removal effect and the plate floating.

TABLE 1

| | Main polymer of rubber | Filler | Plasticizer | (A) | (B) | (C) | (D) |
|---|---|---|---|---|---|---|---|
| Sample 1 | Isobutylene (polymer mainly including isobutylene) | $SiO_2$ $TiO_2$ $ZnO_2$ | Paraffin hydro carbon compound or | □ good | □ good | good | 62 |
| Sample 2 | or Copolymer of isobutylene | $SiO_2$ TiO $ZnO_2$ | hydro carbon compound having functional group such as C—O or Si—O | □ good | □ good | good | 27 |

TABLE 1-continued

| | Main polymer of rubber | Filler | Plasticizer | (A) | (B) | (C) | (D) |
|---|---|---|---|---|---|---|---|
| Sample 3 | | $SiO_2$ $BaSO_2$ $ZnO_2$ | Paraffin | □ good | bad | bad (*2) | 70 |
| Sample 4 | — | — | — | bad (*1) | bad | good | 8 |

Notes:
(*1) Adhesive strength is too weak to sufficiently remove the foreign material.
(*2) Adhesive strength is too strong, and the film of image receiving layer is peeled, and the recording medium itself is also wound.
(A) Capability to remove foreign material
(B) Deterioration due to natural aging of adhesive strength
(C) Conveyance property
(D) Adhesive strength HPa The table 101 shows the result of the analysis of the rubber material, such as sample 1, sample 2, sample 3 and sample 4, each material different from another, to show the comparison rating of their total performance. According to this, it can be seen that even when it is the same adhering roller, the adhering roller including the hydrocarbon compound having TiOx (titanium oxide) as the filler, and the functional group of C—O or Si—O as the plasticizer, as the rubber material, such as Sample 1 or Sample 2, is good in the conveyance property, and because the deterioration due to the natural aging of the adhesive strength is late, it is the optimum roller.

Inversely, the adhering roller including Ba (barium) is not so good in the conveyance property and the deterioration due to the natural aging of the adhesive strength. Accordingly, it can be seen that the adhering roller including Ba (barium) is not appropriate for the foreign material removal of the recording apparatus 121.

In the hollow portion of the drum 123, for example, a suction pipe 151 which is commonly used with the rotation axis is communicated, and to the suction tube 151, a blower (or vacuum pump) which is a suction apparatus 152 for the recording medium fixing to conduct the vacuum suction is connected. On the one hand, on the outer peripheral surface of the drum 123, a plurality of suction ports 153 to suck the air are formed. Accordingly, when the recording medium is attached onto the outer peripheral surface of the drum 123, and the blower is driven, the recording medium is sucked on the outer peripheral surface of the drum 123, and the image receiving sheet 131 and the transfer sheet 129 which are recording media, are fixed on the drum 123. In the same manner, before these recording media are fixed, when the plate 137 is supplied, the plate 137 can be fixed onto the drum 123. That is, on the drum 123, as shown in FIG. 9(*c*), the plate 137, image receiving sheet 131, and transfer sheet 129 are integrally fixed under the condition that these are successively superimposed.

Although the suction port 153 is exaggeratedly drown for the convenience of seeing in the relationship of drawing, practically, it is very smaller than that in the drawing, and scatters in larger numbers. When the air blower which is a suction source, starts the suction movement, because the air inside the drum 123 is sucked through the suction pipe 151, and the internal pressure of the drum 123 is lowered, the plate 137 and the recording media are sucked by the many suction ports 153 opened on the surface of the drum 123, and these are assuredly held and fixed on the drum 123.

More accurately describing, initially, when the plate 137 is supplied onto the drum 123, the plate 137 is fixed onto the drum 123 by the fixing/releasing cramp 139, and the plate 137 is sucked and fixed onto the drum 123 by the many suction ports 153 positioned under the plate 137. Next, when the image receiving sheet 131 is supplied onto the drum 123, the image receiving sheet 131 is fixed onto the drum 123 by the holes 141 of the plate 137 positioned under the image receiving sheet 131. Next, the transfer sheet 129 is supplied on the image receiving sheet 131. Because the transfer sheet 129 is cut slightly larger than the image receiving sheet, the four sides of the transfer sheet 129 are protruded from the image receiving sheet 131, and by the holes 141 positioned under the protruded portion, the transfer sheet 129 is sucked and fixed onto the drum 123.

Next, the foreign material removal method of the recording apparatus 121 structured in this manner, will be described.

In the recording apparatus 121, prior to the supply of the recording medium, the plate 137 is supplied to the drum 123. The plate 137 is, when being supplied to the drum 123, attached onto the drum 123 by the fixing/releasing clamp 139. Next, as shown in FIG. 9(*b*), the adhering roller 143 is moved so as to be brought into contact with the outer peripheral surface (recording medium contact surface) of the plate 137.

At least one of the drum 123 and the adhering roller 143 which are in contact with each other, is driven, and both of them are synchronously rotated. However, when the drum 123 is very poor in the weight balance in the rotational direction, or when the rotational load of the drum 123 itself is large, by the rotation drive of only the adhering roller 143, because there is a possibility that the plate 137 is dislocated, or dropped, in this case, it is desirable that the drum 123 and the adhering roller 143 are synchronized and rotation driven. Then, by this structure, when there is no difference of the rotation between the drum 123 and the adhering roller 143, the peeling force due to the rotation difference is not generated between the drum 123 and the plate 137, and the coming-off of the plate 137 is prevented.

Then, when the adhering roller 143 is brought into contact with the plate 137 and rotated, the foreign material adhered onto the plate 137 is sucked onto the adhering roller 143, and the plate 137 is cleaned. Thereby, the image defect such as the image reversing or ring unevenness generated when the foreign material is adhered onto the plate 137 is reduced.

Further, the plate 137 is, as shown in FIG. 9(*c*), is fixed by the fixing/releasing clamp 139, and it is preferable that, in the condition that it is sucked and fixed onto the drum 123 by the blower, it is cleaned by the adhering roller 143.

According to this cleaning method, the plate 137 is held by the high suction and fixing force, onto the fixed surface of the drum 123, and even by the adhesive strength of the adhering roller 143, the dislocation, floating, or coming-off is not generated to the drum 123. Thereby, the foreign material is removed from the plate 137 just before being in contact with the recording medium, or the foreign material adhering probability onto the plate 137 until the recording medium is attached is reduced, and the image defect such as the image reversing or the ring unevenness is reduced, and in addition to that, because the dislocation, floating, or coming-off is not generated in the plate 137, the doubling or apparatus error is not generated in the subsequent processes, and the stability of the apparatus movement after cleaning can be enhanced.

Further, the cleaning by the adhering roller 143 is, as shown in FIG. 9(*a*), may also be conducted on the drum 123 before the plate 137 is attached. When such the preceding cleaning is conducted, the plate 137 can be attached onto the drum 123 having the clean fixed surface onto which the foreign material is not adhered. Accordingly, when the plate 137 is attached onto the fixed surface, the foreign material adhered onto the fixed surface does not adhere onto the plate 137. In this connection, the plate 137 is attached onto the previously cleaned drum 123, and when the plate 137 after being attached onto the drum 123 is further cleaned by the adhering roller 143, the cleanliness of the plate 137 is more enhanced.

As detailed above, according to the first embodiment of the present invention, because a recording medium fixing member having a plurality of suction ports on the fixed surface; an adhering roller which cleans the fixed surface; and a suction apparatus for recording medium fixing which sucks the air from the suction ports and sucks balls and fixes the flexible plate and the recording medium onto the fixed surface, are provided, the adhering roller is brought into contact with the flexible plate attached onto the recording medium fixing member, and the flexible plate can be cleaned. Further, because the suction apparatus for recording medium fixing is moved, and the flexible plate under the condition which is sucked onto the recording medium fixing member, can be cleaned by the adhering roller, the dislocation, floating, and coming-off of the flexible plate to the recording medium fixing member can be prevented and the generation of the doubling or apparatus error can be prevented. As the result, the image defect such as the image reversing or ring unevenness generated when the foreign material is adhered onto the flexible plate, can be reduced, and the stability of the apparatus movement after the cleaning can be enhanced.

Further, because the flexible plate in the condition in which it is attached onto the recording medium fixing member, is cleaned by the adhering roller, the foreign material can be removed from the flexible plate just before contacting with the recording medium, and the foreign material adhering probability until the recording medium is attached, can also be lowered. As the result, the image defect such as the image reversing or ring unevenness generated due to the adhering of the foreign material can be reduced.

Second Embodiment

Referring to the drawings from FIG. 10 to FIG. 15, a second embodiment of the present invention will be detailed below.

Figure 10:
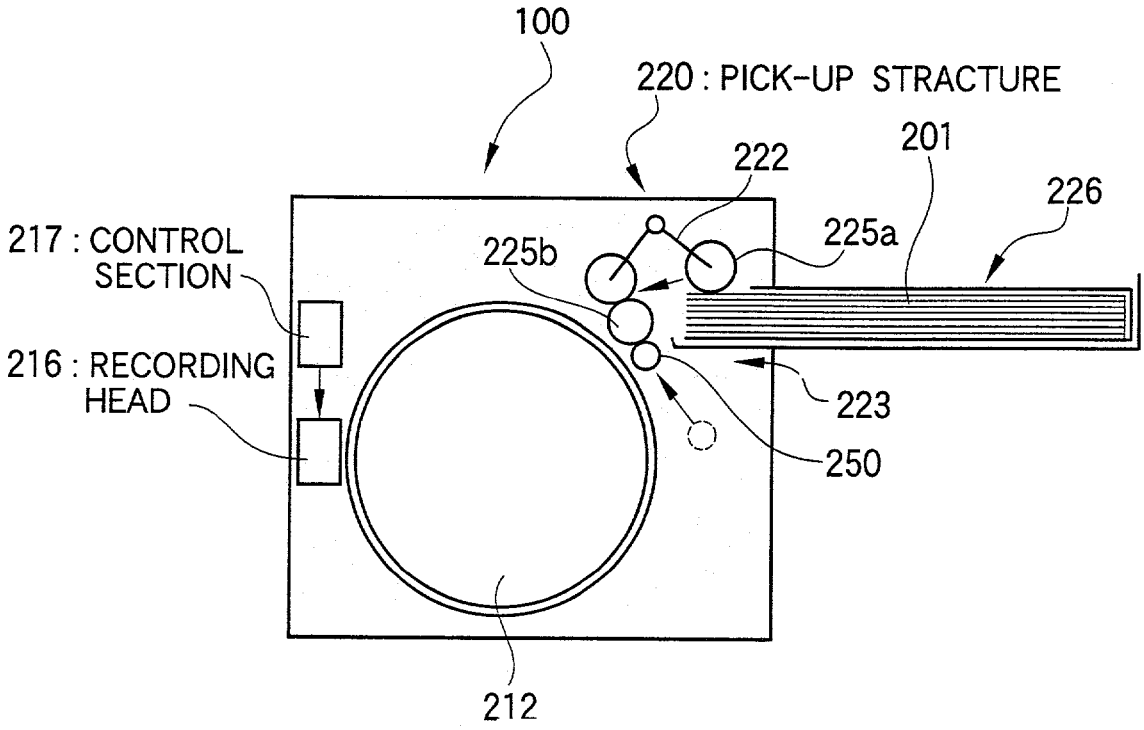
FIG. 10 is a whole structural view showing an outline structure of a recording apparatus according to the present invention.
Figure 11:
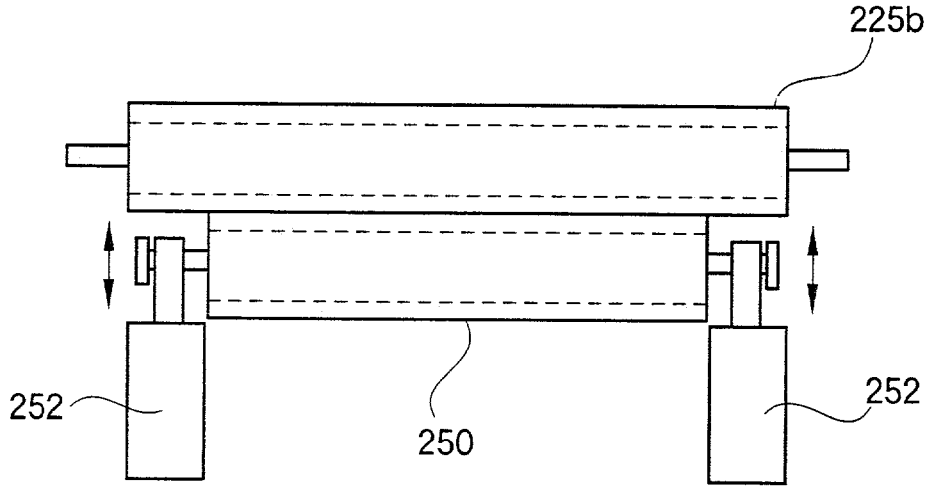
FIG. 11 is a structural view of a movement mechanism of an adhesive roller in the recording apparatus in FIG. 10.

FIG. 10 is a whole structural view showing the outline structure of a recording apparatus according to the present invention, FIG. 11 is a structural view showing the movement mechanism of an adhesive roller in the recording apparatus in FIG. 10.

In the recording apparatus to record the recording medium, there are, for example, a rotation system by which the recording medium is attached onto the rotation drum peripheral surface and the rotation drum is rotated, and on the one hand, the recording head is moved to the drum axis direction, or the laser light from the recording head is moved in the drum axis direction and the recording is conducted, or a truck system by which the laser light from the recording head is moved to the perpendicular direction in the conveying direction and the recording is conducted.

In the above recording apparatus, a recording medium supporting member corresponds to the rotating drum for the recording in case of the rotation system, and corresponds to the nip roller in the case of the truck system, and herein, a case in which the former rotating drum for the recording is used, will be described as an example.

As shown in FIG. 10, in a recording medium supply section 223 of the recording apparatus 100, a cassette 226 for the recording medium in which an image receiving sheet 202 or transfer sheet 203, which will be described later, is accommodated, is detachably provided. In the recording apparatus 100, when this cassette for the recording medium is set, a pick-up mechanism 220 which is a recording medium conveying means is moved, and picks up the recording medium 201 from the cassette for the recording medium, and conveys it to the rotating drum for the recording 212 which is a recording section.

The recording apparatus 100 of the present embodiment is structured by equipping an upper conveying roller 225*a* which is pivoted by the leading edge of an arm 222 which can be oscillated, and rotated, and takes out the recording medium 201, and a lower conveying roller 225*b* which is oscillated and displaced from the recording medium taking out position and rotated being in contact with the upper conveying roller 225*a*. Further, the recording apparatus 100 is equipped with an adhesive roller 250 which moves from an initial position at which it is separated from the lower conveying roller 225*b* due to the turning-on of the apparatus power supply to the contact position with the lower conveying roller 225*b*, and following the recording operation start, it is separated from the lower conveying roller 225*b* again, and returns to the initial position. That is, this adhesive roller 250 is structured in such a manner that it is rotated in contact with the upper or lower conveying rollers 225*a* or 225*b* before the recording operation start, and can remove the foreign material adhered onto the upper or lower conveying rollers 225*a* or 225*b* directly or indirectly.

In this connection, the adhesive roller 250 is arranged at a position in the vicinity of the outside the apparatus in an initial position separated from the lower conveying roller 225*b*, and when the open and close door, not shown, of the recording apparatus 100 is opened, the surface of the adhesive roller 250 is wiped by alcohol group such as ethanol and can be easily cleansed. Further, the adhesive roller may also be structured in such a manner that the adhesive material is wound sheet-like, and it can be easily renewed when the stained surface is peeled off by one round.

In the adhesive roller 250, as shown in FIG. 11, an air piston 252 which is a movement drive source is equipped onto the rotating axes protruded from the roller both end portion, and is guided by a guide means such as a guide groove or rail, not shown, and pressed onto the lower conveying roller 225*b*. In this connection, the adhesive roller 250 may also be structured in such a manner that it is brought into contact with the upper conveying roller 225*a*.

Further, as the movement drive source, other than the air piston 252, a motor may also be applied. Then, when the drive energy (air pressure/air flow amount/electric power) is controlled, an amount of the movement, movement force, or pressing force is controlled.

In the recording section of the recording apparatus 100, as shown in FIG. 10, the rotating drum for the recording 212 which is the recording medium supporting member, is rotatably provided, and is connected to the rotating axis of the motor, not shown, and rotated. The rotating drum for the recording 212 has the hollow cylindrical shape.

The recording medium 201 of the upper most layer is taken out from the cassette for the recording medium 226 set to the recording apparatus 100, as described above, by the pick-up mechanism 220 provided in the recording apparatus 100, and supplied into the recording apparatus 100.

As shown in FIG. 10, when the cassette for the recording medium 226 is set to the recording apparatus 100 and the apparatus power supply is turned on, or the recording start command is outputted from the control section 217, as described above, before the recording operation, the upper or lower conveying rollers 225*a* and 225*b* of the pick-up mechanism 220 which are the recording medium conveying means are cleaned by the contacting rotation of the adhesive roller 250. Thereby, the foreign material adherence from the recording medium conveying means to the recording medium is reduced, and the generation of the image defect due to the foreign material can be reduced. When the cleaning process on the recording preparation stage is completed, the upper conveying roller 225*a* is displaced to the original pick-up position, and the image receiving sheet 202 of the uppermost layer in the cassette for the recording medium 226 is supplied to the rotating drum for the recording 212.

In this embodiment, the structure is adopted by which, before the start of the recording operation, the adhesive roller 250 which is directly rotated being in contact with the lower conveying roller 225*b* and removes the foreign material X adhered onto the surface of the lower conveying roller 225*b*, or indirectly removes the foreign material X transferred from the upper conveying roller 225*a* onto the surface of the lower conveying roller 225*b*, is provided. Accordingly, these upper or lower conveying rollers 225*a*, 225*b* or the adhesive roller 250 can be used by being combined as in Table 2.

TABLE 2

| | Combination 1 | Combination 2 |
|---|---|---|
| Conveying roller | Normal rubber or metal | Adhesive rubber |
| Adhesive roller | Adhesive rubber or material in which adhesive material exists on the surface | Adhesive rubber having stronger adhesive strength or material in which adhesive material exists on the surface |

When the upper or lower conveying rollers are formed of normal rubber or metal, the adhesive roller can be formed as a structure in which the adhesive rubber or adhesive material is wound around it. Further, hen the upper or lower conveying rollers are formed of adhesive rubber, the adhesive roller can be formed as a structure in which the adhesive rubber or adhesive material whose adhesive strength is stronger than them is wound around it. Further, the upper or lower conveying rollers and the adhesive roller (cleaning roller) are formed of the same component structure and respective adhesive strength can be changed. That is, when the hardness of the rubber is changed, the difference of the adhesive strength can be realized. In the case where the cleaning roller in which the hardness of the rubber is smaller (softer) than the upper or lower conveying rollers is used, when both rollers are rotated in the condition being contacted with each other with being strongly pressed, the foreign material in the condition being nipped between both rollers can be removed in such a manner that it is thrust into the cleaning roller side whose hardness is softer than the other.

Accordingly, according to the present invention, the foreign material X adhered onto the upper or lower conveying rollers 225*a*, 225*b*, can be removed by the adhesive roller 250 which is rotated being indirectly or directly contacted with the upper or lower conveying rollers 225*a* or 225*b*.

Figure 12:
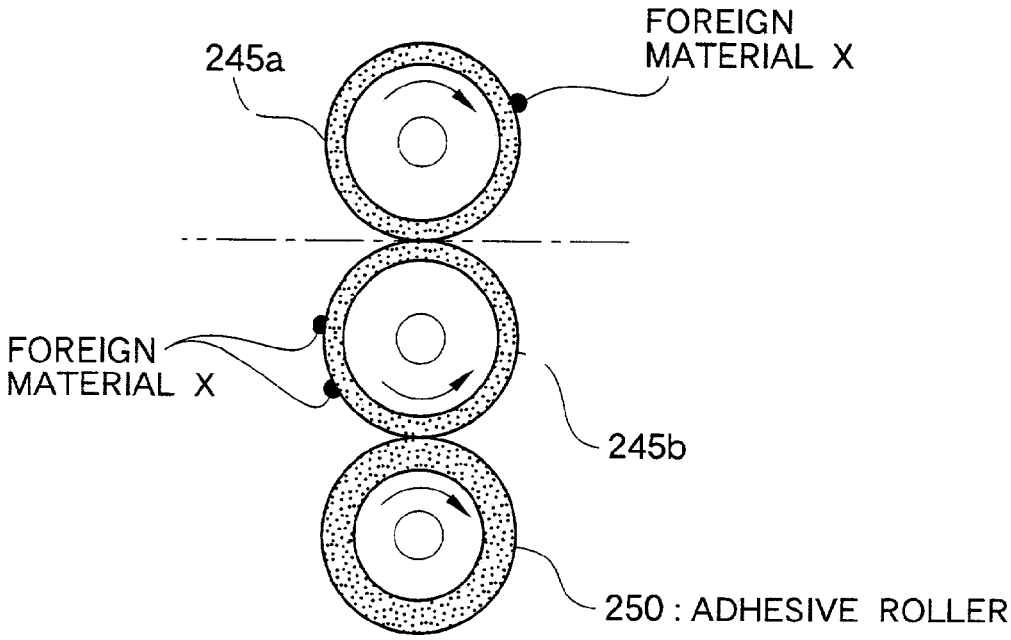
FIG. 12 is a view showing a recording medium conveying means which is one of specific positions onto which the adhesive roller according to the present invention can be applied.

FIG. 12 shows the case where the foreign material adhered onto the recording medium conveying means is removed in the same manner.

In this case, it is structured in such a manner that the adhesive roller 250, which is the same as described above, is provided on the lower conveying roller 245*b* of the nip rollers 245*a* and 245*b* which are the recording medium conveying means in the condition which is rotatable being contacted with it, and the foreign material X adhered onto the nip rollers 245*a*, 245*b* is directly or indirectly removed. In this connection, each structure and functions in FIG. 12 are almost the same as in FIG. 10, and the explanation will be neglected. The different point between FIG. 12 and FIG. 10 is that, in FIG. 10, the adhesive roller 250 is moved in the time of cleaning (preparation process) before the start of the recording operation and brought into contact with the conveying roller, however, in contrast to that, in the structure in FIG. 12, it is in the fixed condition of always being in contact with it. Thereby, the foreign material adhered onto the recording medium at the time of recording operation can also be removed through the nip roller.

Figure 13:
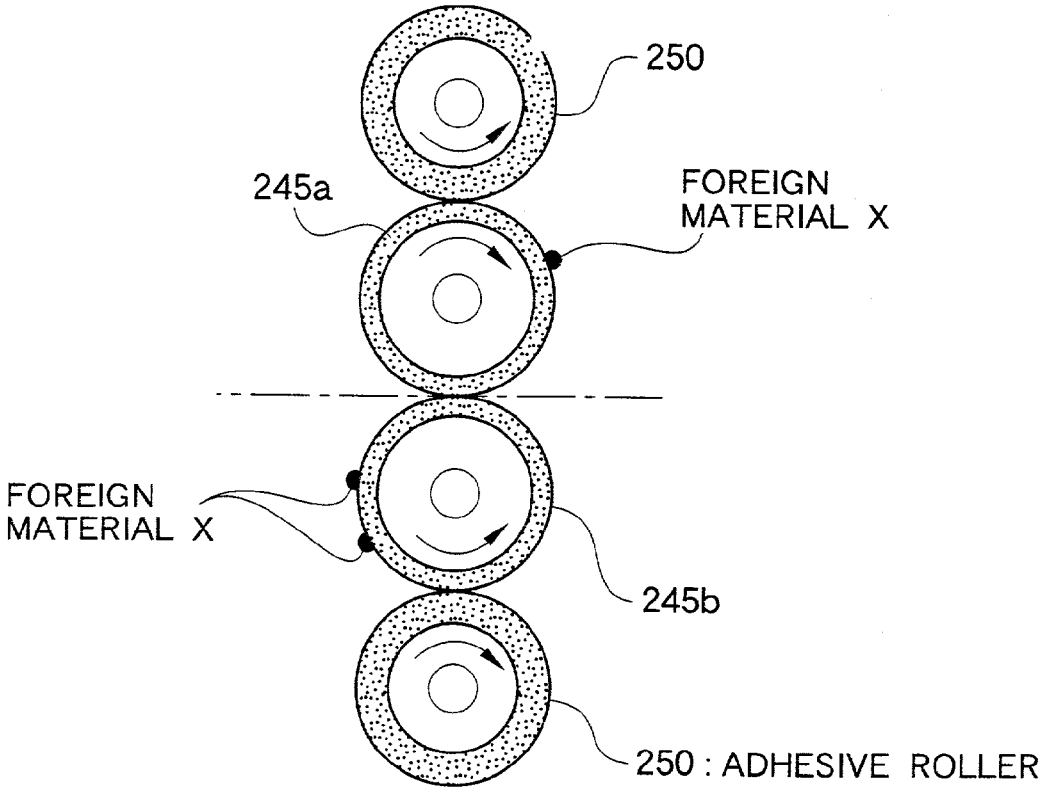
FIG. 13 is a view showing another recording medium conveying means which is one of specific positions onto which the adhesive roller according to the present invention can be applied.

Further, in FIG. 13, the system is structured in such a manner that the adhesive roller 250 is provided in the contact condition and rotatably, also onto the upper conveying roller 245*a* of the nip rollers 245*a* and 245*b*, and foreign material X adhered onto the upper or lower rollers can be respectively removed directly.

Figure 14:
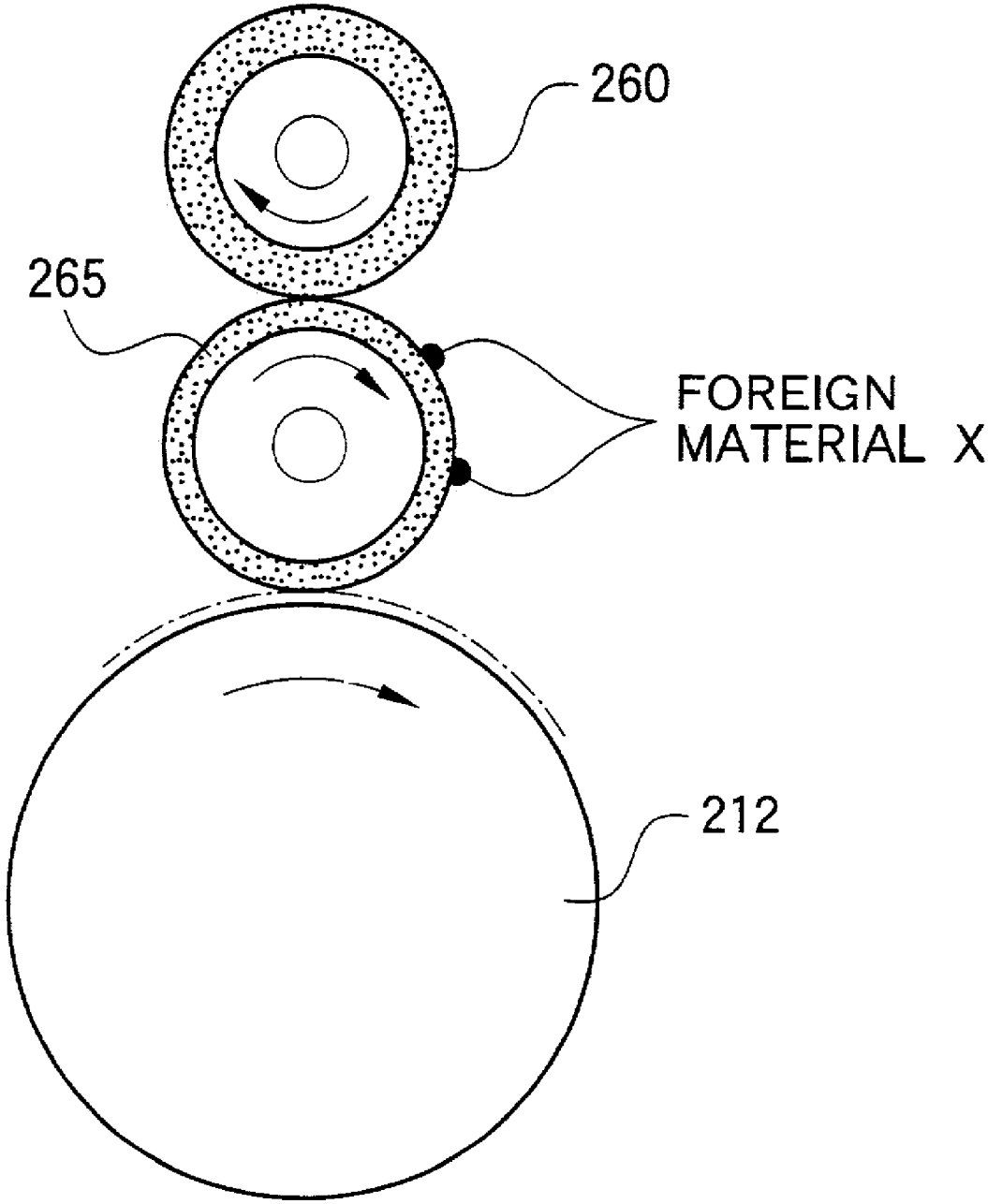
FIG. 14 is a view showing yet another recording medium conveying means which is one of specific positions onto which the adhesive roller according to the present invention can be applied.

Further, in FIG. 14, the adhesive roller 260 is rotatably provided in the contact condition with the conveying roller 265 which is arranged being in contact with the rotating drum for the recording 212 thereon.

Figure 15:
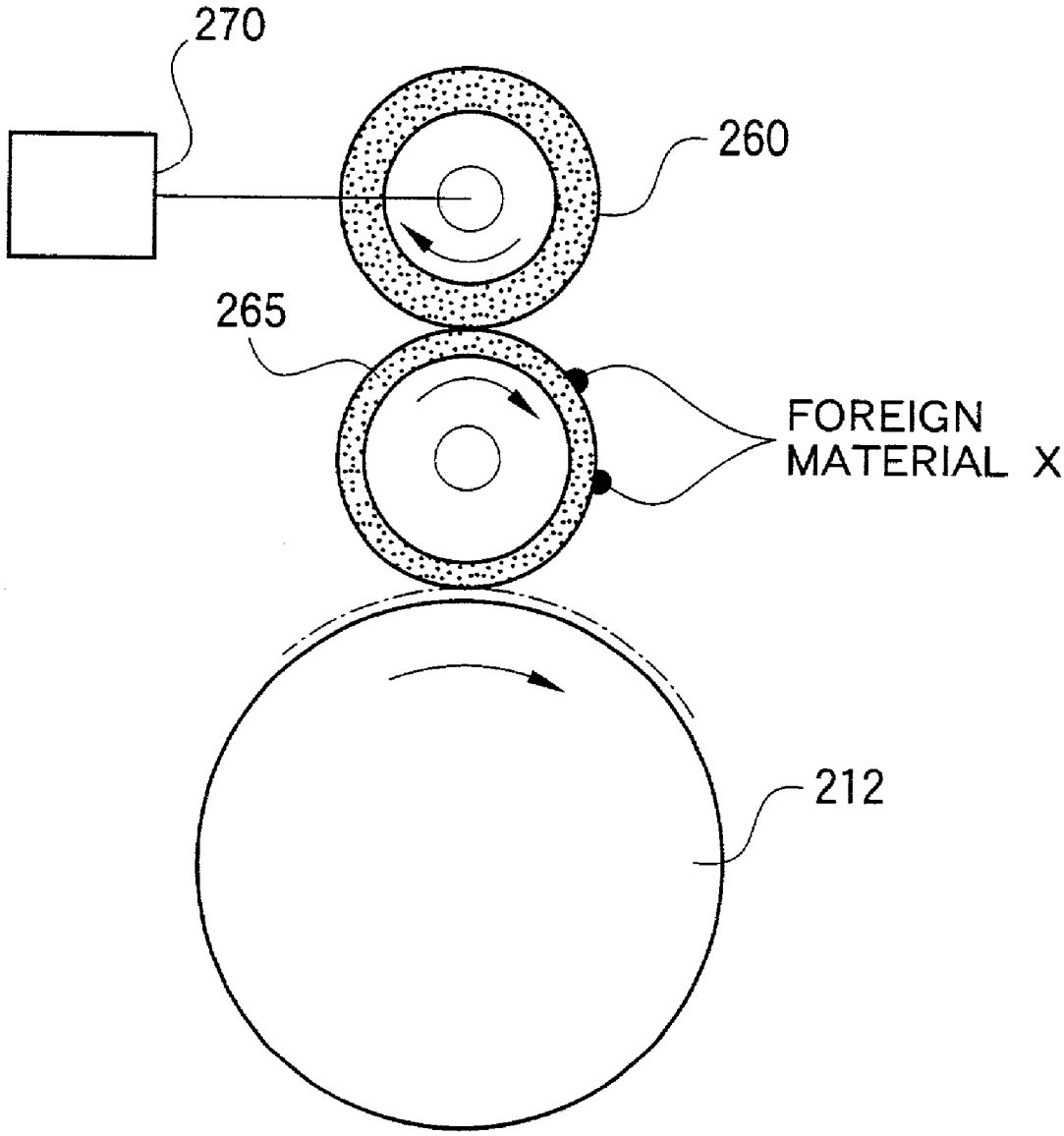
FIG. 15 is a view showing another structure of the recording medium conveying means which is one of specific positions onto which the adhesive roller according to the present invention can be applied.

Further, in FIG. 15, in the same manner as the structure in FIG. 14, the adhesive roller 260 is provided to the conveying roller 265 which is arranged in contact with the rotating drum for the recording 212 thereon, and including also the structure in FIG. 15, the difference from each structure described above is a point that the adhesive roller itself is rotated being connected to the drive axis of the motor 270. When being structured as described above, although there is a disadvantage that it is necessary to separately provide the motor, the slip due to the contamination of the contact surface with the conveying roller is eliminated, and the contact rotation with the conveying roller can be made sure.

As the component structure when the adhesive roller is rubber roller, for example, a material including $TiO_x$ (titanium oxide), and/or hydrocarbon compound having the functional group of C—O or Si—O and not including Ba (barium), may be used. As the adhesive rubber roller of the above structural component, specifically, a rubber roller having the performance of Table 2 of the grade of LT or ST whose trade mane is [CARBOLESS MIMOZA] made by Miyagawa roller Co., is finely used.

TABLE 3

| Grade | Sample 1 | Sample 2 |
|---|---|---|
| Adhesive strength [hPa] | 62 | 27 |
| Hardness [°] (JIS A) | 25 | 35 |
| Electric resistance value [Ω] | $8 \times 10^7$ | $4 \times 10^7$ |

In Table 3, the adhesive strength, hardness, and electric resistance value are respectively shown for Sample 1 and Sample 2.

The characteristic of the rubber roller is that, because the electric resistance value is small, the electrostatic electricity generated in the recording medium can be removed.

As for the comparison of the result of analysis of the rubber material and the total performance is shown in the Table 1 as already described in the first embodiment.

When the adhesive rubber roller of such the component structure, or the adhesive roller around which the adhesive material is wound is applied on at least any one of the recording medium conveying means, and is operated after the power supply of the apparatus is turned on and before the start of the recording operation (before the recording medium supply), the foreign material adhered (piled) onto the recording medium conveying means at the time of standby of the apparatus such as at the time when the apparatus is not used, or before recording medium supply, which can not be removed by the conventional apparatus, can be removed.

Further, as the recording apparatus, the rotating drum can be used as the high speed scanning (main scanning) unit, and the laser light by the optical head can be used for the laser recording apparatus in which the laser light scans (sub scanning) at the low speed in the rotation drum axis direction. In this connection, in the above embodiments, although any one of them is not structured in such a manner that the adhesive roller is commonly used to the conveying roller and brought into directly contact with the recording medium, this is for the reason why the ill effect generated when being in directly contact with the recording medium by the strong adhesive strength is avoided.

As detailed above, according to this embodiment, in the stage of the preparation before the recording medium is supplied to the recording section, because the adhesive roller is rotated in the condition that the adhesive roller is in contact with the recording medium conveying means which is idly rotated, the foreign material adhered and piled onto the recording medium conveying means or recording section when the apparatus is not used or at the time of the recording operation standby, can be assuredly removed, and the generation of the image defect can be reduced.

Third Embodiment

Referring to the drawings of FIG. 10 as well as FIG. 16 to FIG. 31, from the third to the fifth embodiments of the present invention will be detailed below.

The outline structure of a recording apparatus is a structural view as already shown in beginning of this section. That is to say, in the recording apparatus to record on the recording medium, for example, there is a drum rotation recording method by which the recording medium is attached around the peripheral surface of the rotating drum and rotating drum is rotated, and on the one hand, the recording head is moved in the drum axis direction, or the laser light from the recording head is moved in the drum axis direction and recording is conducted, and a self-travel recording method by which the recording medium is conveyed to the recording position by a conveying roller, or the laser light from the recording head is moved to the direction perpendicular to the conveying direction and the recording is conducted. Herein, the drum rotation recording method is described as an example, however, the present invention is not limited to this method.

Figure 16A:
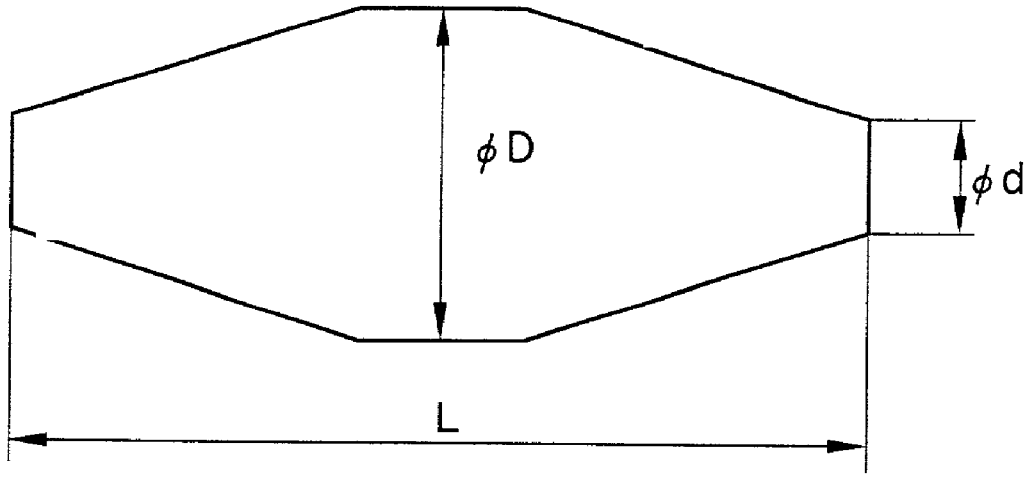
FIGS. 16(*a*) to 16(*b*) show views showing a conceptual shape of a pick-up roller which is an adhesive roller: (a) is a taper crown shape; and (b) is a radial crown shape.
Figure 16B:
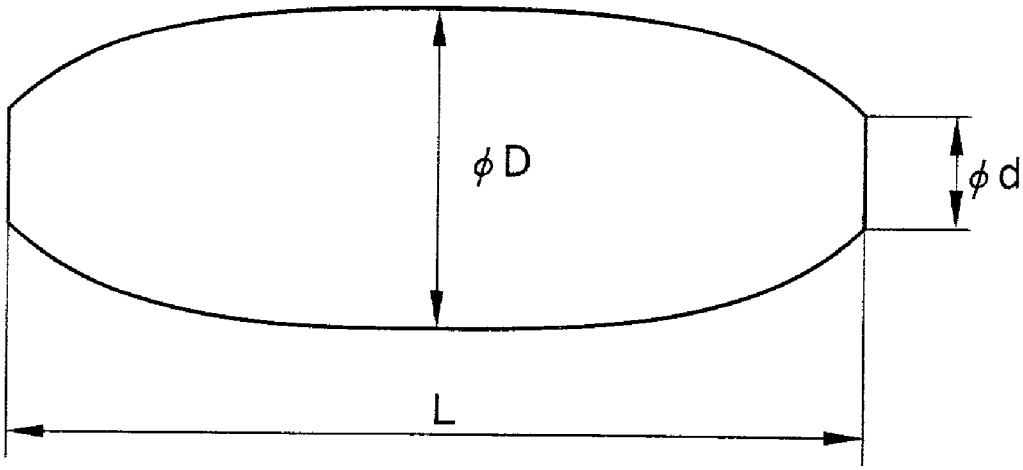

Now, the adhesive roller used for the recording apparatus 100 which is a feature portion of the present invention, will be described below. In the present embodiment, the pick-up roller 222 is structured as the adhesive roller, and the shape of the pick-up roller 222 is a crown shape having the difference between the diameter at the central position in the width direction of the roller and the diameter at the position near to the end portion in the width direction. The conceptual shape of the pick-up roller 222 which is an adhesive roller, is shown in FIG. 16. FIG. 16(*a*) is a taper crown shape having the taper surface on the end portion in the width direction, and FIG. 16(*b*) is a radial crown shape formed into the curved surface over whole width direction. Even when it is either crown shape, it can be applied as the roller of the present embodiment.

The pick-up roller of the present embodiment is structured in such a manner that the cylindrical rubber body of the crown shape is covered onto the core metal having the supporting portion on both ends, and specific dimension is, for example, as follows.

The axial direction length of the main body (rubber roller width): 500 mm

| | |
|---|---|
| Rubber roller central portion diameter | 40 mm |
| Rubber roller end portion diameter | 39 mm |
| Crown shape | Taper crown |

In the pick-up roller of above shape, the support member of both ends is connected to the drive mechanism such as an air piston, and by this drive mechanism, the predetermined pressing force (for example, 98N (10 kgf)) is respectively applied on each support portion. When this pressing force is applied on the recording medium 201 placed in the support tray 220, because the pick-up roller 222 is the crown shape, the pressing force of the central portion in the width direction is not lowered and the pick-up roller 222 is uniformly pressed by the predetermined surface pressure over the whole in the width direction of the recording medium 201, and by the adhesive property of the pick-up roller 222 itself the foreign material on the surface of the recording medium 201 is removed. Further, when the roller is brought into contact with only a portion of the recording medium 201, a roller mark is left on a portion of the film surface of the recording medium 201, and due to the existence of the roller mark, the recording sensitivity (density) is changed, and the image defect is generated, however, when the roller pressure is made uniform in the roller width direction, the pressing force is uniformly dispersed, and the force is not locally applied, thereby, the generation of the image defect or generation of the disadvantage such as film peeling can be prevented.

Herein, it is preferable that the crown shape of the pick-up roller 222 is set to the dimension shown below.

(A1) The diameter difference between the diameter D at the central position in the width direction of the roller and the diameter d at the position near to the end portion in the width direction is 0.1-2 mm.

(A2) $1.002 \leqq D/d \leqq 1.11$

For example, when the diameter D at almost the central portion is ϕ40 mm, the diameter range of both end portions is set to not smaller than 36 mm, and not larger than 39.9 mm.

(A3) $0.0001 \leqq (D-d)/L \leqq 0.005$

For example, when the diameter D at almost the central portion is ϕ40 mm, and the roller length L is 500 mm, the diameter range of both end portions is set to not smaller than 37.5 mm, and not larger than 39.9 mm.

By setting to the above dimensional range, the uniformalization of the pressing force by the crown shape can be specially enhanced.

Further, as the material of the adhesive rubber used for the adhesive rubber roller (pick-up roller 222), the adhesive rubber including $TiO_x$ (titanium oxide), and (or) hydrocarbon compound having the functional group of C—O or Si—O, and not including Ba (barium), can be finely used. By using this material, the foreign material adhered onto the recording medium can be removed covering a long period of time. The material having the performance in which the grade is Sample 1 or Sample 2 (refer to Table 1) is preferable.

Figure 17:
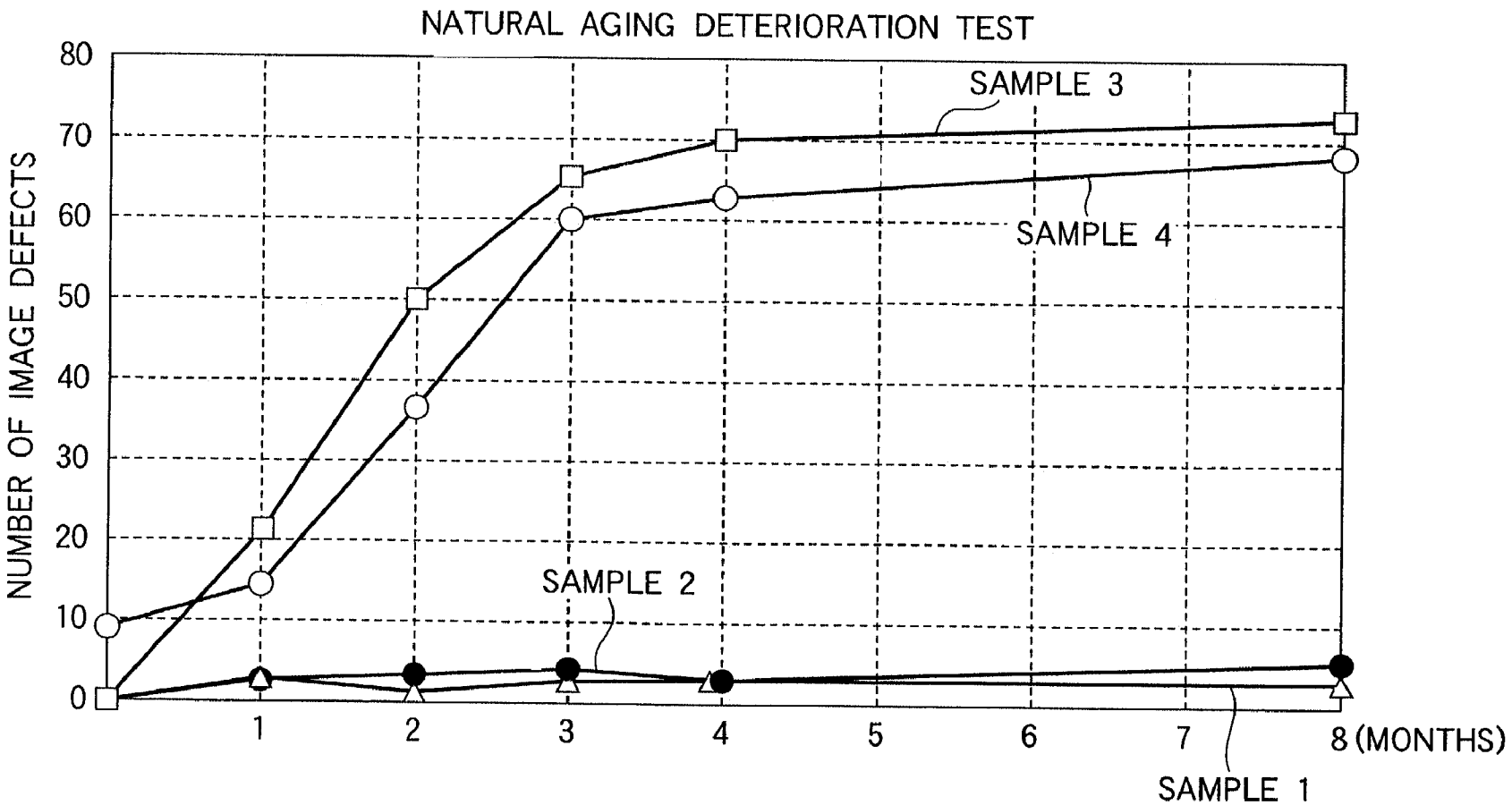
FIG. 17 is a view showing a result of a natural aging deterioration test of the foreign material removal.

Further, as to four kinds of said samples, namely Sample 1, Sample 2, Sample 3 and Sample 4, the result of the natural aging deterioration test of the foreign material removal is shown in FIG. 17. The graph shown in FIG. 17 is a result in which the number of image defects due to foreign material is counted in the case where it is left in unused condition for a month, and is used after one month and the image recording is conducted. The horizontal axis shows the number of elapsed months, and the vertical axis shows the number of image defect due to the foreign material.

According to this comparison result, as for Sample 1 and Sample 2, the number of their image defects is not larger than 10 even after eight months passed by, to the contrary, as for Sample 4, the number of image defects due to the foreign material after one month is over 10 already (the number of image defects=15), and after two months, it becomes 36, and after three months, 67, and when eight months passed by, the number of image defects becomes almost 70. Further, as for Sample 3, after one month, the image defect due to the foreign material exceeds 20 already, and after two months, 50, after three months, 67, and when eight months passed by, the number of image defects exceeds 70. As described above, even in the same adhesive rubber material, the large difference is identified. As to the comparison of the result of analysis and the total performance of those rubber material are shown in the Table 1 which was already described.

Reflecting those results being brought by the analysis, as the constituent composition applicable to the roller of the present embodiment, any one of following (B1)-(B5) is preferable.

(B1) $TiO_x$ is included.

(B2) $TiO_x$ is included, and Ba is not included.

(B3) Hydrocarbon compound having functional group of C—O or Si—O is included.

(B4) $TiO_x$ is included, and hydrocarbon compound having functional group of C—O or Si—O is included.

(B5) $TiO_x$ is included, and hydrocarbon compound having functional group of C—O or Si—O is included, and Ba is not included.

By the pick-up 222 roller using the adhesive rubber roller of such the constituent composition, the foreign material on the recording medium 201 surface can be removed before it is conveyed into the recording apparatus 100, thereby, the foreign material introduction into the apparatus is prevented, and the image defect generation of the recording image is prevented over the long period of time.

Figure 18:
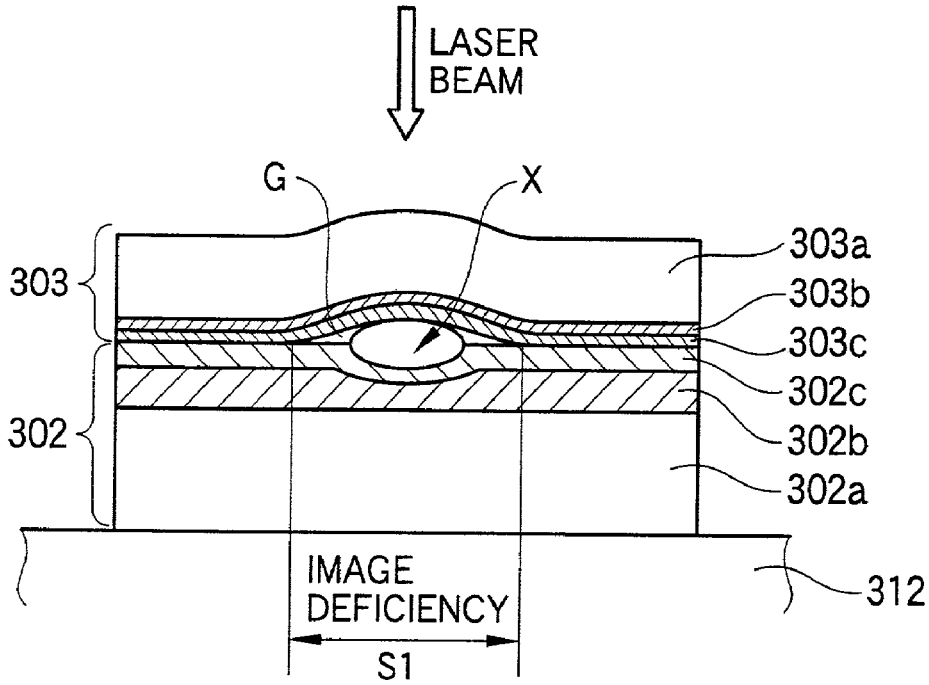
FIG. 18 is a view showing a condition in which, after the image receiving sheet onto which the foreign material is adhered is set onto a rotating drum for the recording, a color material sheet is set around its outer periphery.

FIG. 18 is a view showing the condition in which, after the receiving sheet 302 onto which the foreign material is adhered is set onto the rotating drum for the recording 312, the color material sheet 303 is set onto its outer periphery. The image receiving layer 202*c* of the image receiving sheet 302 and the color material layer 303*c* of the color material sheet are sucked in the laminated condition, and as shown in FIG. 18, when the foreign material X such as dusts invades between each of sheets, a gap G is formed between the image receiving sheet 302 and the color material sheet 303 ranging over a broad range S1. In the range S1 in which this color material sheet 303 is deformed convex-like and the gap G is formed, the image reversing or an image deficiency is generated in the recording image. However, in the present embodiment, as described above, because the uniform pressing force is obtained ranging over the whole width direction of the roller onto the recording medium 301 surface, and the recording medium 301 is taken out while being cleaned by using the adhesive roller in which the aging deterioration of the adhesive strength is small, the sure foreign material removal can be conducted at the entrance of the recording apparatus 100, thereby, the foreign material on the recording medium 301 is assuredly removed, and the image defect such as image reversing can be prevented from generating in the recording image.

Herein, when the recording medium 301 is supplied to the recording apparatus 100, a modified example of the present embodiment in which the recording medium cassette in which the image receiving sheet 302 or color material sheet 303 is previously laminated in a predetermined order and accommodated, is used, and the recording medium 301 is successively taken out from this recording medium cassette, will be described below.

Figure 19:
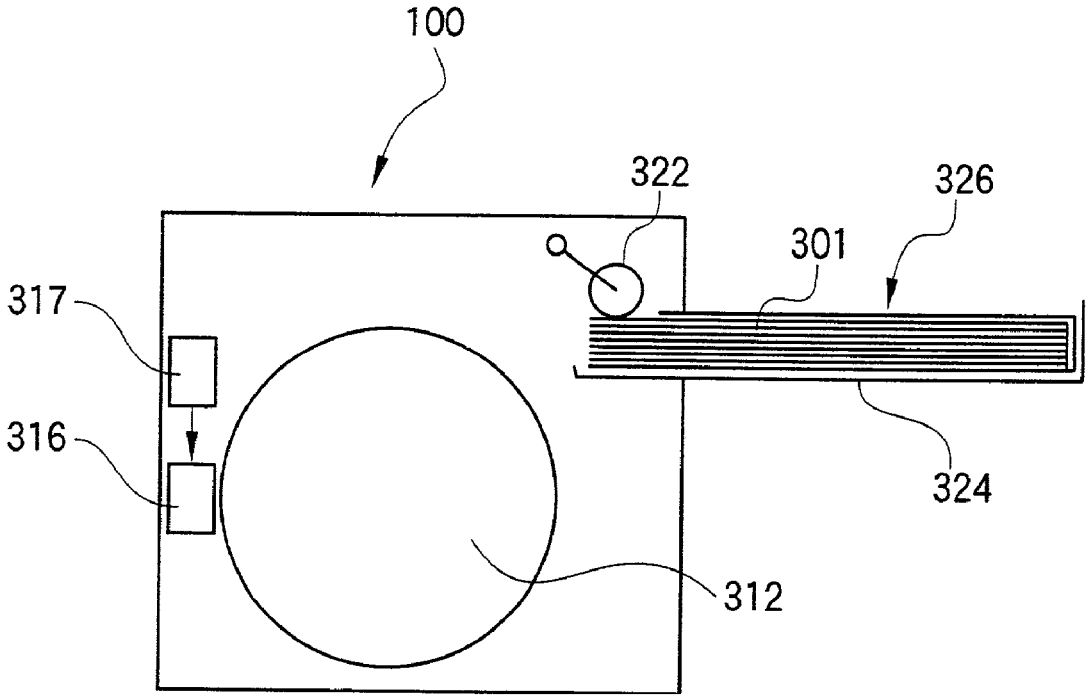
FIG. 19 is an overall view showing an outline structure of the recording apparatus in a modified example of the first embodiment.

The recording apparatus of the present modified example is, as shown in the overall view showing an outline structure in FIG. 19, a cassette base 324 is provided at the recording medium supply position, and the recording medium cassette 326 in which the recording medium is accommodated, is directly detachably loaded on this cassette base 324. When the recording medium cassette 326 is loaded on this cassette base 324, the recording apparatus 100 takes out the recording medium from the recording medium cassette 326 and supplies and conveys it onto the rotating drum for the recording 312.

Figure 20:
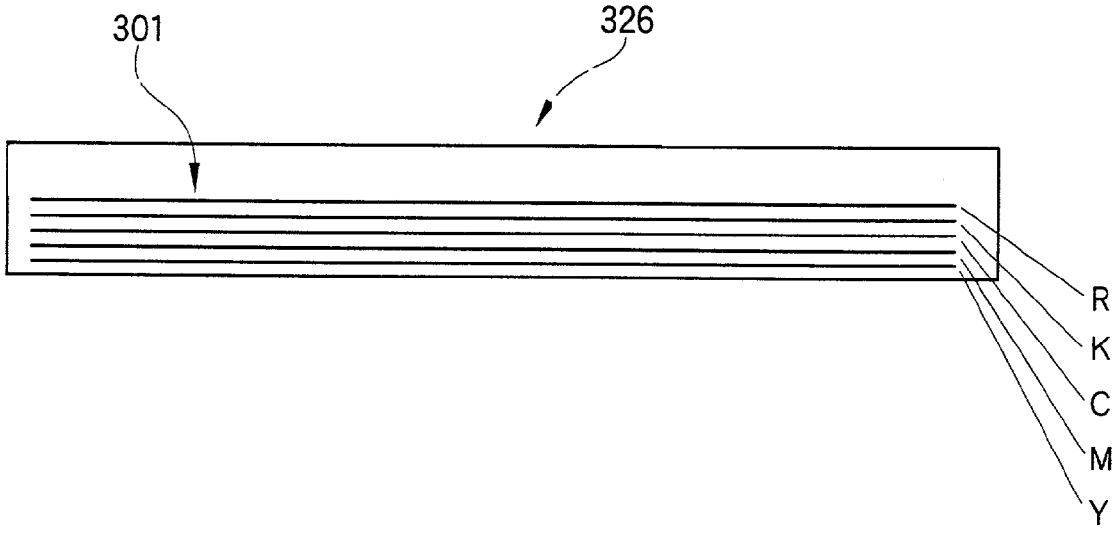
FIG. 20 is a sectional view of a recording medium cassette.

A sectional view of the recording medium cassette 326 is shown in FIG. 20. In this the recording medium cassette 326, the image receiving sheet 302 and the color material sheet 303, which are recording medium 301, are laminated in the supplying order to the rotating drum for the recording 312 and accommodated. For example, when the supply conveyance order to the rotating drum for the recording 312 is the image receiving sheet R, K color material sheet, C color material sheet, M color material sheet, and Y color material sheet, these are laminated from the upper layer in the order of RKCMY. In the recording medium cassette 326 set in the recording apparatus 100, the recording medium is taken out in the order from the recording medium of the uppermost layer by the pick-up roller 322 of the recording apparatus 100 and supplied into the recording apparatus 100. In this connection, in FIG. 20, only one set of respective recording media is shown, however, a plurality of sets can also be accommodated, and the continuous supply can be realized.

As described above, when the recording medium 301 is accommodated in the recording medium cassette 326 and the cassette 326 is loaded into the recording apparatus 100, the continuous supply of the recording medium 301 becomes possible, and man-hours for the recording are reduced, and the provability of the foreign material attachment from the clothes of the loading operator or the air to the recording medium 301 can be reduced. In this connection, when the cassette main body is made of metal, the charge of the static electricity of the recording medium 301 can be prevented.

Fourth Embodiment

Next, the fourth embodiment of the recording apparatus according to the present invention will be described.

Figure 21:
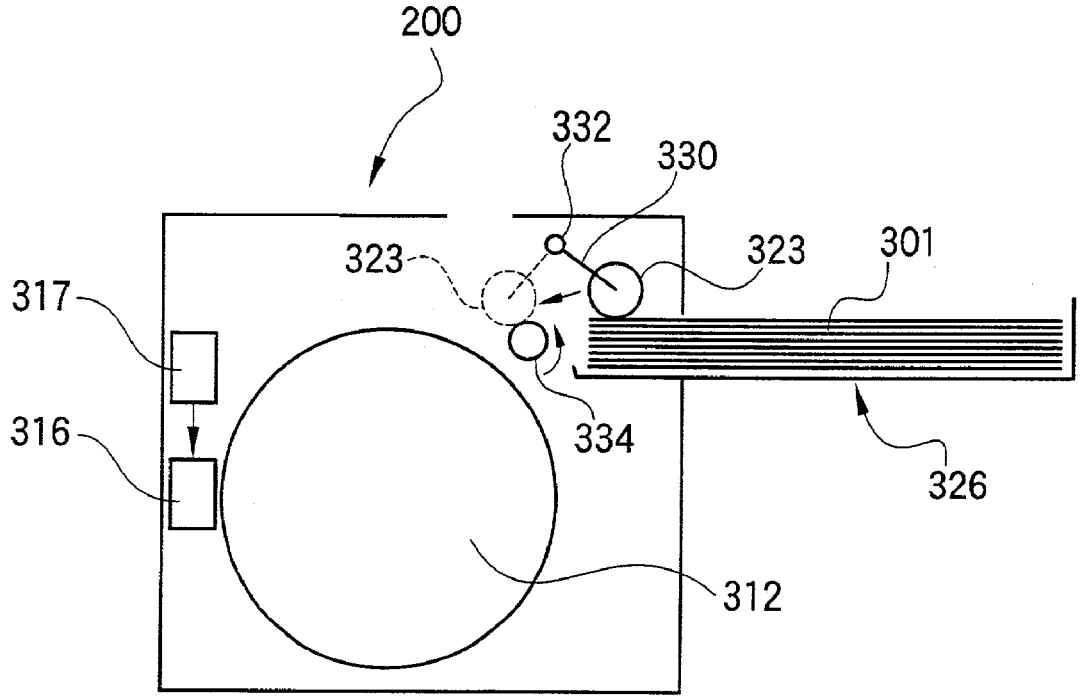
FIG. 21 is an overall structural view expressing an outline structure of the recording apparatus of the second embodiment.

The overall structural view showing an outline structure of the recording apparatus 200 of the present embodiment is shown in FIG. 21. Hereinafter, members having the same function as the members shown in FIG. 1 will be denoted by the same reference signs, and their explanations will be omitted.

The pick-up roller 323 of the present embodiment is formed of rubber roller, and both ends of the pick-up roller 323 are axially supported by the arms 330. The arm 330 is attached to the apparatus main body side so that it can be oscillated around the fulcrum 332, and can selectively move the pick-up roller 323 to the pick-up position shown by a solid line, and to the cleaning position shown by a dashed line. Then, at the cleaning position, it is provided at a position at which the cleaning roller 334 formed of the adhesive roller is contacted with the pick-up roller 323, and when the pick-up roller 323 oscillated to the cleaning position is brought into contact with the cleaning roller 334, the cleaning roller 334 is rotated, or rotated by being driven following the pick-up roller 323. Thereby, the foreign material is removed from the surface of the pick-up roller 323. This cleaning roller 334 is formed into the same crown shape as in the embodiment described above, and further, also as the constituent of the adhesive rubber material, the same material is used.

According to the above structure, when the recording medium 301 is taken out from the recording medium cassette 326 by the pick-up roller 323, even when the pick-up roller 323 is adhered by the foreign material from the recording medium 301 and stained, by oscillating the pick-up roller 323 from the pick-up position to the cleaning position and rotating it while coming into contact with the cleaning roller 334, the foreign material adhered onto the pick-up roller 323 surface can be removed. This cleaning operation can be conducted at the start of the operation or start of the recording of the recording apparatus, or every predetermined time during the operation of the recording apparatus.

Specially, in the structure of the present embodiment, because the cleaning roller 334 has the crown shape, the pick-up roller is brought into contact with the cleaning roller with the uniform pressing force ranging over the whole of the width direction of the pick-up roller 323, thereby, the uniform removal of the foreign material becomes possible. Further, because the adhesive property is not aging-deteriorated, and the optimum adhesive strength can be always maintained, thereby, the image defect of the recording image can be prevented extending over a long period of time.

Fifth Embodiment

Figure 22:
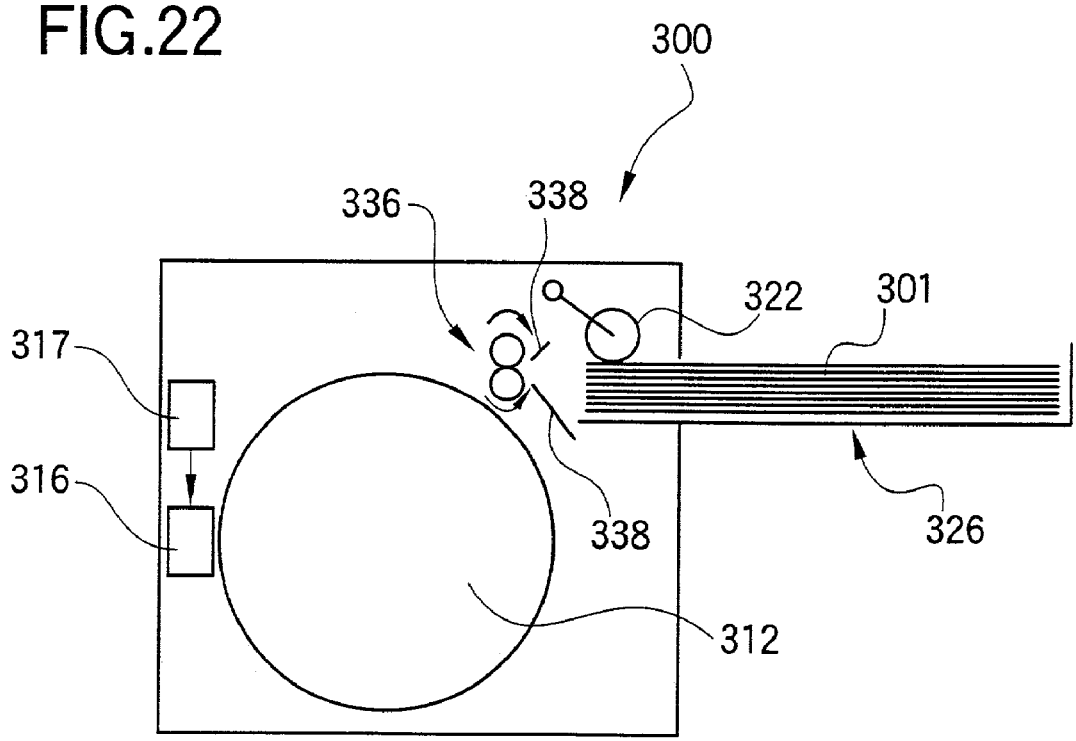
FIG. 22 is an overall structural view expressing an outline structure of the recording apparatus of the third embodiment.

Next, the fifth embodiment of the recording apparatus according to the present invention will be described. The whole structural view expressing the outline structure of the recording apparatus 300 of the present embodiment is shown in FIG. 22. The pick-up roller 322 of the present embodiment is formed of a rubber roller, and takes out the recording medium 301 from the recording medium cassette 326. The taken out recording medium 301 guided by a pair of the upper and lower nip roller pair 336 composed of adhesive rollers, conveyance guide plates 338, 338, provided on the midway of conveying path to the rotating drum for the recording 312 and introduced. In this connection, as the nip roller pair 336, at least either one roller may be an adhesive roller, however, when both are adhesive rollers, the both surfaces of image receiving sheet 302 can be cleaned, and the foreign material removal effect becomes large. Then, at least either one roller of the nip roller pair 336 is formed into the same crown shape as in the above embodiment, and the same constituent of the adhesive rubber material as the above one is used. In this connection, the nip roller pair 336 formed of adhesive roller of the present embodiment may be provided at, other than the position proximate to the pick-up roller 322, any position on the midway of the conveying path to the rotating drum for the recording 312.

According to the structure of the present embodiment, because the nip roller pair 336 includes the roller of the crown shape, the recording medium 301 can be uniformly pressed ranging over the whole width direction, thereby, the uniform removal of the foreign material becomes possible ranging over the whole surface of the recording medium 301. Further, the adhesive property does not aging-deteriorate, and the optimum adhesive strength can be always maintained.

Figure 23:
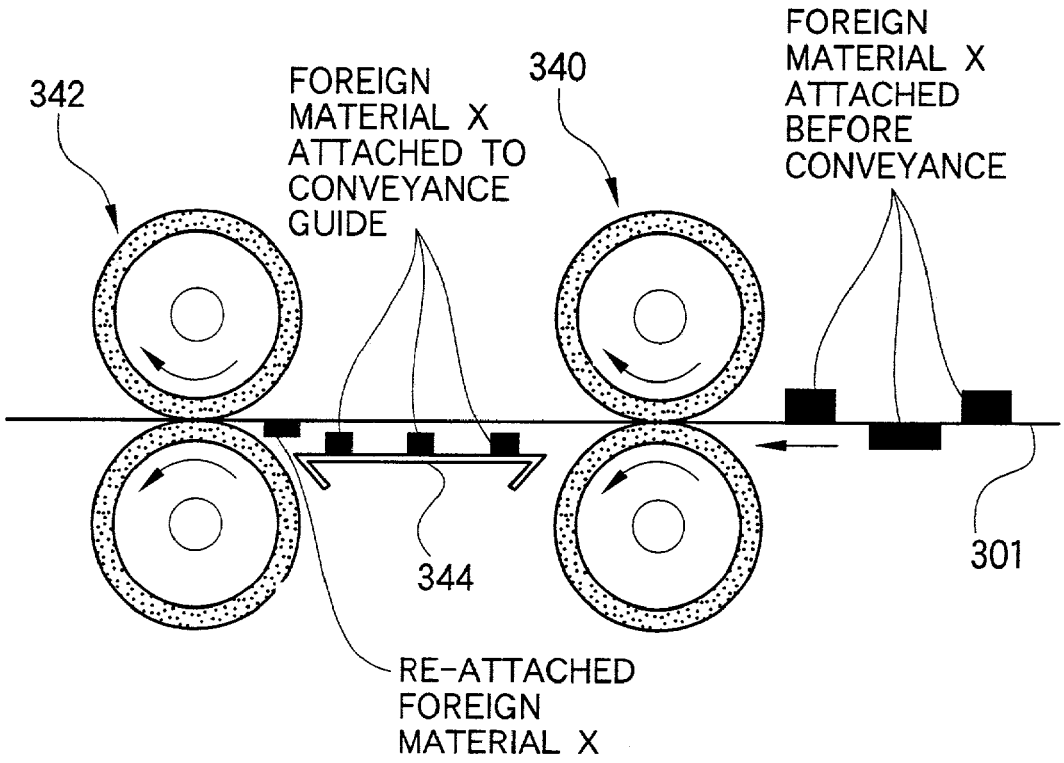
FIG. 23 is a modified example of the third embodiment, and a view showing a structural example in which a plurality of nipple roller pairs composed of a pair of upper and lower adhesive rollers are provided.

FIG. 23 is a modified example of the present embodiment, and shows a structural example in which a plurality of nip roller pairs composed of a pair of the upper and lower adhesive rollers are provided. In the present modified example, a upstream side nip roller pair 340 positioned on the upstream side of the conveying direction, and the downstream side nip roller pair 342 positioned on the downstream side of the conveying direction are provided, and between them, a conveyance guide plate 344 is provided. When the foreign material is adhered onto the conveyance guide plate 344, the foreign material is adhered onto the recording medium 301 being conveyed.

According to this structure, the foreign material adhered onto the recording medium 301 before the conveyance is removed by the upstream side nip roller pair 340, and the recording medium 301 passes the upstream side nip roller pair 340. Then, when it is guided slidingly contacted with the conveyance guide plate 344, there is a case where the foreign material on the conveyance guide plate 344 is adhered onto the recording medium, however, the adhered foreign material is removed by the downstream side nip roller pair 342. In this manner, even when there is a chance in which the recording medium 301 slidingly contacts with a portion such as the conveyance guide plate 344 onto which there is a possibility for the foreign material to adhere, when the above adhesive roller is provided on the downstream side of the conveyance of the portion, the newly adhered foreign material can be removed and conveyed.

In this connection, the conveying roller is composed of the adhesive roller and also given the cleaning effect together, however, the structure in which the cleaning roller whose purpose is only to remove the foreign material is appropriately provided separately from the conveying roller, may also be allowable. In this case, when the cleaning roller is structured to have the crown shape and structured by using the adhesive rubber material having the above constituent composition, the recording medium 301 can be uniformly pressed ranging over the whole width direction, and the uniform foreign material removal becomes possible. Further, the adhesive property is not aging-deteriorated, and because the optimum adhesive strength can be maintained always, it can be prevented extending over a long period of time that the image defect is generated in the recording image.

Sixth Embodiment

Next, the sixth embodiment of the recording apparatus of the present invention will be described. In the recording apparatus of the present invention, in order to clean the surface of the rotating drum for the recording 312 and the surface of the recording medium set on the drum surface, the cleaning roller composed of the adhesive roller is provided so that it can contact with separate from the drum surface.

Figure 24:
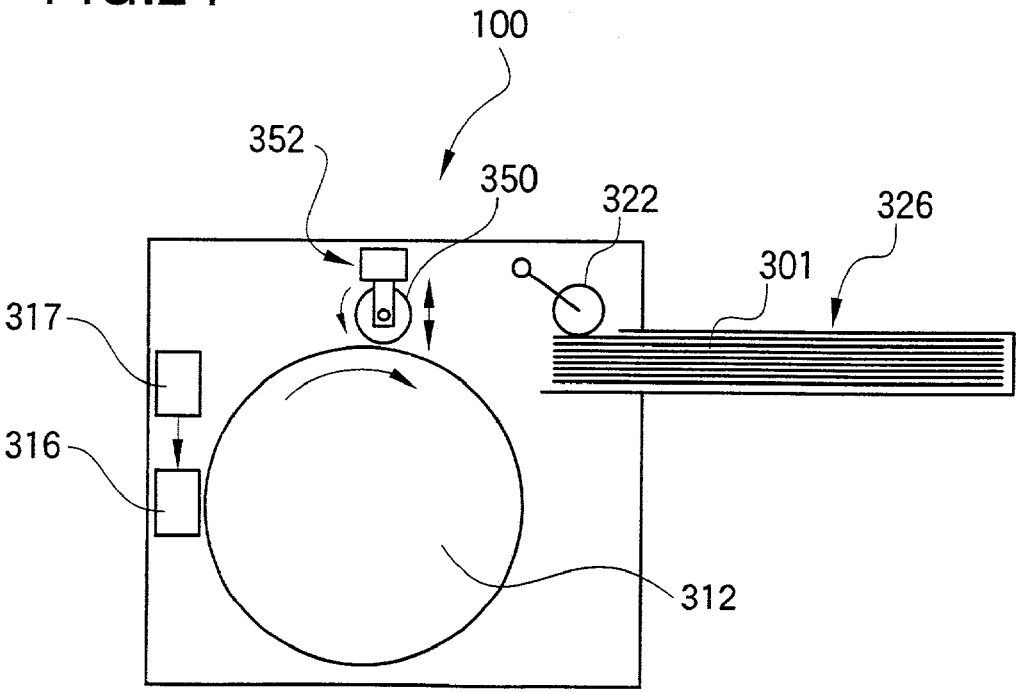
FIG. 24 is an overall structural view expressing an outline structure of the recording apparatus of the forth embodiment.

In FIG. 24, a general view expressing an outline structure of the recording apparatus 400 of the present embodiment is shown. In the cleaning roller 350, the support portion of both end of the roller is connected to the drive mechanism 352 such as an air piston, and by driving the drive mechanism 352, the cleaning roller 350 is brought into contact with separated from the surface of the rotating drum for the recording 312 at a predetermined timing. This cleaning roller 350 is formed into the same crown shape as in the above embodiment, and the same constituent of the adhesive rubber material as in the above embodiment, is also used.

Figure 25:
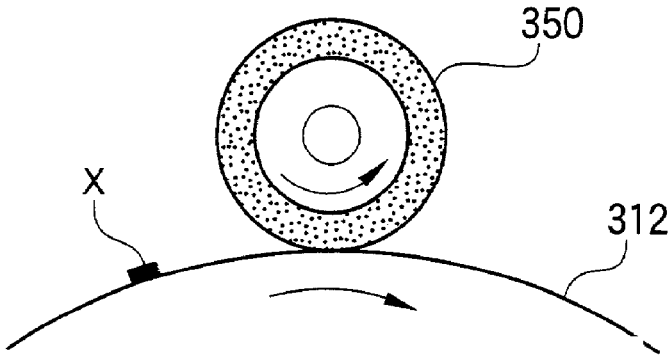
FIG. 25 is a view showing a condition in which, before the recording medium is set onto the rotating drum for the recording, the surface of the rotating drum for the recording is cleaned.
Figure 26:
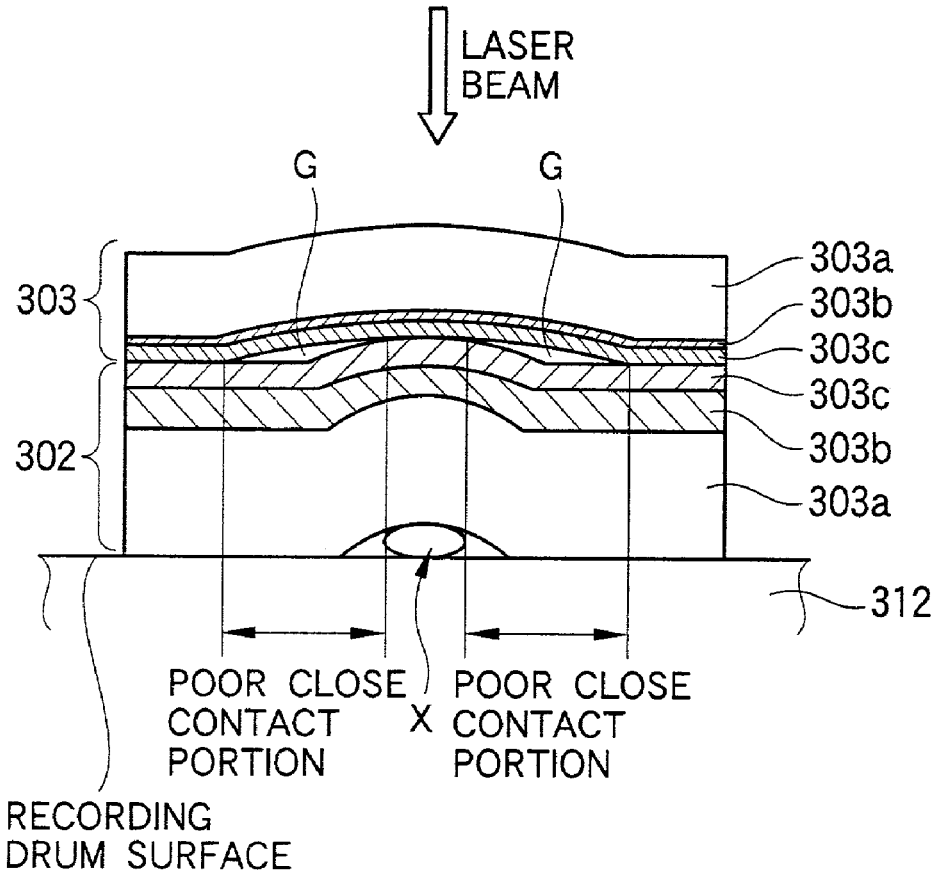
FIG. 26 is a view showing a condition in which the foreign material exists between the surface of the rotating drum for the recording and the image receiving sheet.

Herein, the timing at which the foreign material removal is conducted by the cleaning roller 350, will be successively described below. FIG. 25 shows the condition in which the surface of the rotating drum for the recording 312 is cleaned before the recording medium is set onto the rotating drum for the recording 312. When the recording is conducted under the condition that the foreign material is adhered onto the surface of the rotating drum for the recording 312, the poor close contact portion shown in FIG. 26 is caused. That is, as shown in FIG. 26, when the foreign material X exists between the surface of the rotating drum for the recording 312 and the image receiving sheet 302, the image receiving sheet 303 is deformed convex like around the position at which the foreign material X exists. The color material sheet 303 receives the convex-like deformation and the gap G is formed between the image receiving sheet 302 and the sheet 303 around the foreign material position. As the result, the image defect called ring clearness is generated. Accordingly, according to the cleaning roller 350 of the present embodiment, when the surface of the rotating drum for the recording 312 is previously cleaned before the recording medium setting, while the pressing force onto the drum surface is made uniform ranging over the whole width of the roller, the foreign material is assuredly removed ranging over the whole of the width direction of the drum surface. Thereby, the generation of the image defect due to the foreign material is prevented.

Figure 27:
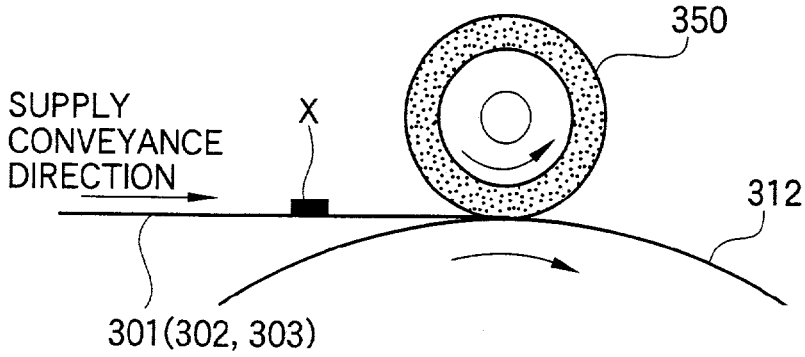
FIG. 27 is a view showing a condition in which, when the recording medium(image receiving sheet or color material sheet) is set onto the rotating drum for the recording, the surface of the recording medium is cleaned.

FIG. 27 shows the condition that, when the recording medium(image receiving sheet 302 or color material sheet 3) is set onto the rotating drum for the recording 312, the surface of the recording medium 301 is cleaned. When the recording is conducted under the condition that the foreign material is adhered onto the surface of the recording medium 301, as shown in FIG. 18, the image reversing is generated in the recording image. Further, under the condition that the foreign material X is adhered onto the supporting layer 303*a* of the color material sheet 303, at the time of laser exposure by the recording head 316, the foreign material X exists on the outermost peripheral surface side of the recording medium 301, and at the time of recording, the foreign material X generates the shadow of the laser, and on the photothermal conversion layer 303*b*, the energy is insufficient, as the result, the image clearness is generated in the recording image. Accordingly, when the foreign material is removed simultaneously with the setting of the recording medium 301 onto the rotating drum for the recording 312, the generation of the image defect is prevented.

Figure 28:
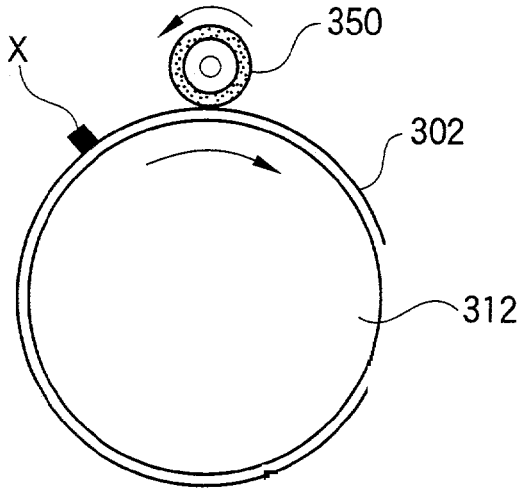
FIG. 28 is a view showing a condition in which, after the image receiving sheet is set onto the rotating drum for the recording, the surface of the image receiving sheet is cleaned.
Figure 29:
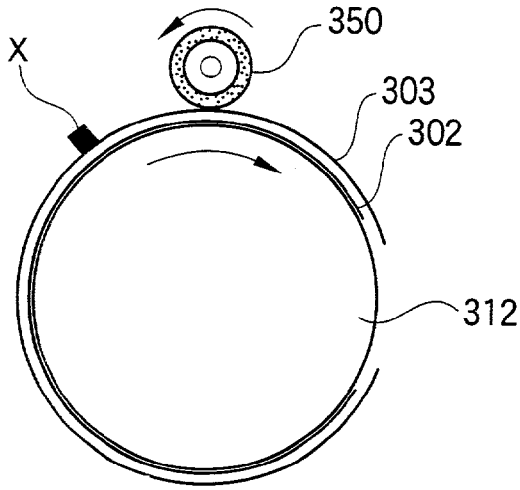
FIG. 29 is a view showing a condition in which, after the color material sheet is set onto the rotating drum for the recording onto which the image receiving sheet is set, the surface of the color material sheet is cleaned.

FIG. 28 shows the condition that the surface of the image receiving sheet 302 is cleaned after the image receiving sheet 302 is set onto the rotating drum for the recording 312, and further, FIG. 29 shows the condition that the surface of the color material sheet 303 is cleaned after the color material sheet 303 is set onto the rotating drum for the recording 312 onto which the image receiving sheet 302 is set. In either timing, the foreign material X adhered onto the image receiving sheet 302 or color material sheet 303 is removed by equally being pressed by the cleaning roller 350.

Figure 30:
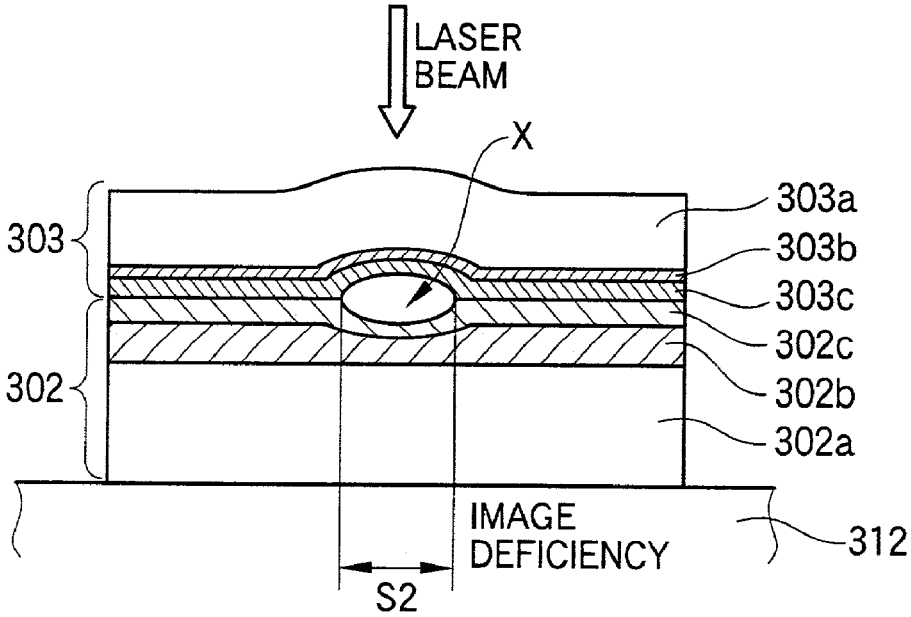
FIG. 30 is a view showing a condition in which the foreign material is strongly pressed between the image receiving sheet and the color material sheet, and a gap between each of sheets slightly exists.

Further, when the cleaning roller 350 having the crown shape is pressed under the condition that the image receiving sheet 302 and color material sheet 303 are superimposed, the close contact property between respective sheets is uniformly increased ranging over the whole surface. By this increase of the close contact property, even when the fine foreign material is not removed in the worst case, as shown in FIG. 30, because the foreign material is strongly pressed between respective sheets, the gap between the image receiving sheet 302 and color material sheet 303 slightly exists, and the range which is deformed convex-like, is reduced from S1 to S2 shown in FIG. 18. Accordingly, the image defect called the image reversing is limited to only the position at which the dust X exists, and the range of the image reversing can be reduced.

Figure 31:
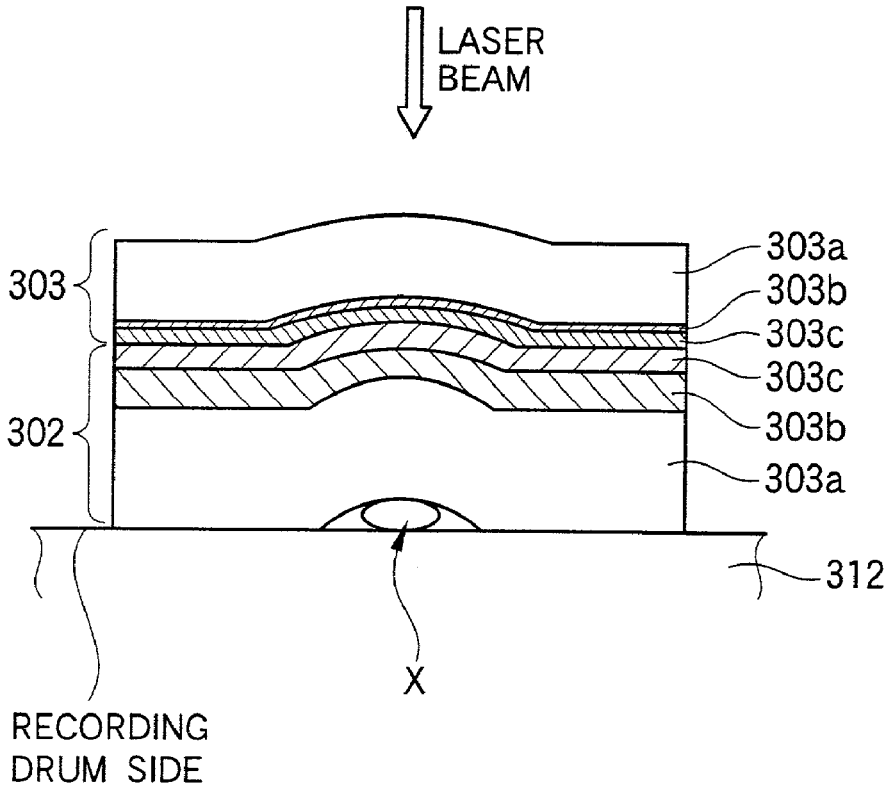
FIG. 31 is a view showing a condition in which the image receiving sheet is strongly pressed onto the surface of the rotating drum for the recording, and a gap slightly exists.

In the same manner, even when the fine foreign material can not be removed in the worst case between the surface of the rotating drum for the recording 312 and the image receiving sheet 302, as shown in FIG. 31, because the image receiving sheet 302 is strongly pressed on the surface of the of the rotating drum for the recording 312, the gap G as shown in FIG. 26 slightly exists, and the image receiving sheet 302 and the color material sheet 303 are closely contacted with each other. Accordingly, the generation of the ring clearness is prevented.

As described above, when the adhesive roller is brought into contact with the image receiving layer 202*c* of the image receiving sheet 302 at the time of the supply of the image receiving sheet 302 or after the supply, the image reversing of the recording image can be prevented, and when it is brought into contact with the supporting layer 202*a*, the ring clearness can be prevented. Further, when the adhesive roller is brought into contact with the color material layer 303*c* of the color material sheet 303 at the time of the supply of the color material sheet 303 or after the supply, the image reversing of the recording image can be prevented, and when it is brought into contact with the supporting layer 303*a*, the image clearness can be prevented.

Figure 32:
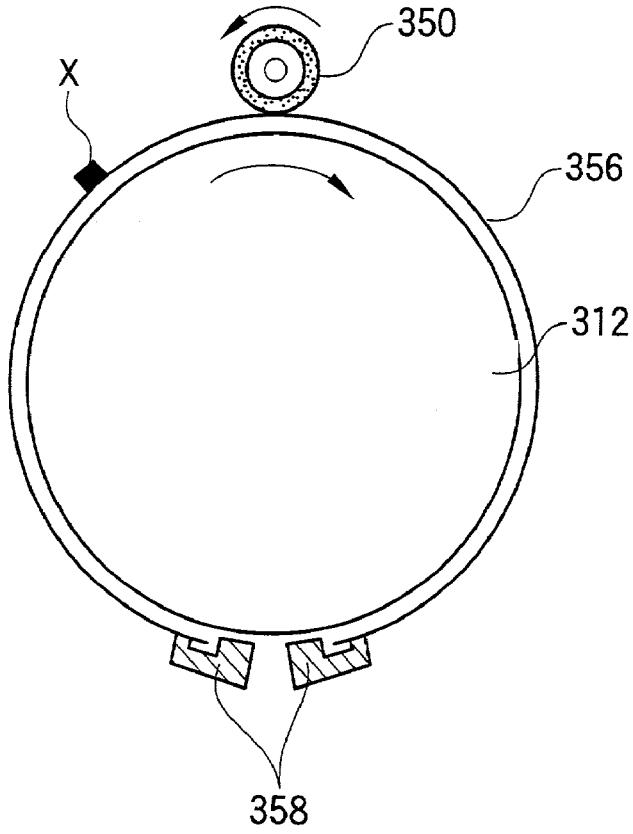
FIG. 32 is a view showing the recording medium surface fixing member fixed onto the rotating drum for the recording.

Further, there is a case where, in order to prevent the image defect such as the ring clearness by smoothing the surface, and to smoothly set the various sizes of recording media onto the rotating drum for the recording 312, the recording medium surface fixing member is attached onto the rotating drum for the recording 312. This recording medium surface fixing member is composed of, as shown in FIG. 32, a plate member whose surface is smooth, made of resin or metal, and clumped and fixed by fixing releasing mechanism 358 which is wound around the peripheral surface of the rotating drum for the recording 312 and provided on the rotating drum for the recording 312. Thereby, the peripheral surface of the rotating drum for the recording 312 can be formed into the smooth surface, and it is prevented that the undulation is generated in the set recording medium.

Onto also the surface of the recording medium surface fixing member 356, the foreign material removal can be conducted by the cleaning roller 350. Thereby, the foreign material X adhered onto the recording medium surface fixing member 356 can be surely removed by applying the uniform pressing force onto the whole width of the roller, and the recording image can be finished to the high quality all over.

Figure 33:
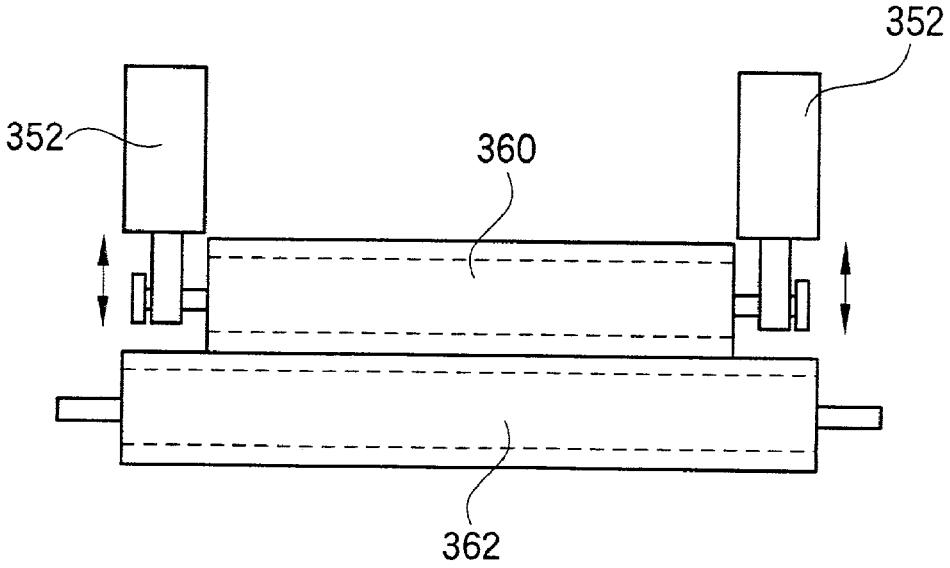
FIG. 33 is a view showing a structure in which the adhesive roller is brought into contact with the recording medium or the rotating drum for the recording through a rubber roller formed of rubber material with the low hardness.
Figure 35A:
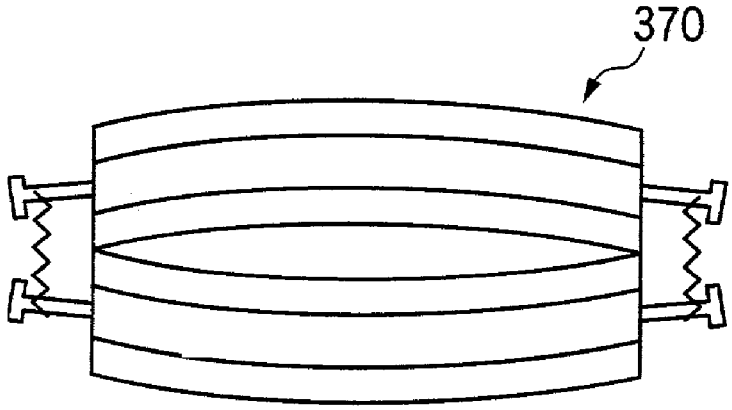
FIG. 35 is a view showing the conventional roller, and (a) is a view showing the flexure when the nip rollers are nipped by the predetermined pressing force, and (b) is a view showing the flexure when the roller is pressed onto the opposite surface by a drive mechanism.
Figure 35B:
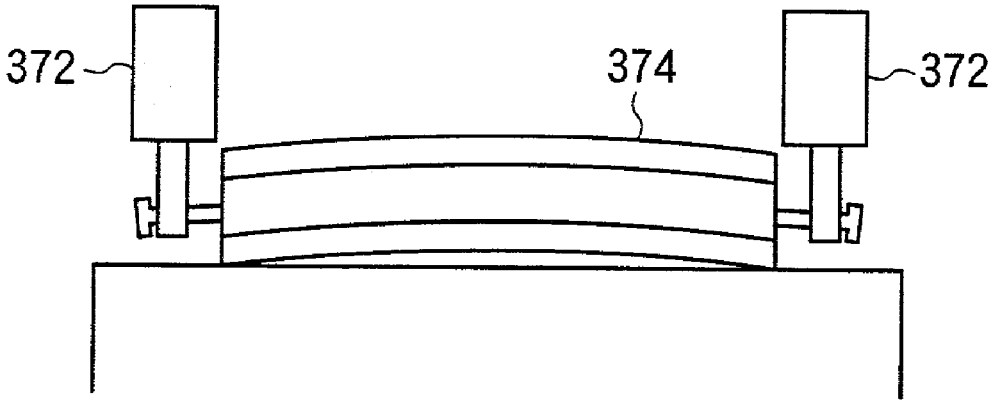

In each embodiment described above, the adhesive roller is provided at a position at which it is directly brought into contact with the recording medium or the peripheral surface of the rotating drum for the recording, and other then this, for example, as shown in FIG. 33, the system may be structured such that the adhesive roller 360 formed into the crown shape by using the adhesive material described above is brought into contact with the recording medium or the rotating drum for the recording through the rubber roller formed of the rubber material with the low hardness. In this case, the foreign material is transferred from the recording medium or the rotating drum for the recording onto the rubber roller 362, and this transferred foreign material is sucked and removed by the adhesive roller. Thereby, even when the adhesive roller can not be directly brought into contact with the recording medium which is easily peeled, the removal of the foreign material can be conducted uniformly ranging over the whole surface and extending over the long period of time without the adhesive strength being lowered.

Now, the performances of the adhesive rollers whose shape is different from each other are compared. The result is shown in FIG. 34.

In the comparative example 301, the shape is a straight type, and any one of the above conditions (A1)-(A3) is not satisfied. In this shape, the pressure at the central portion of the roller width direction is slightly obtained, and at only both end portions, the sufficient pressure can be obtained. As the result, the foreign material remains on the recording medium, and the sufficient cleansing effect can not be obtained.

In Example A, the roller shape is as follows: the diameter D of the central portion of the adhesive roller is 40 mm, and the diameter d of both end portions is 39.9 mm and its shape is a crown type, and the roller length L is 500 mm. In this shape, all of the conditions of (A1)-(A3) are satisfied, and at the central portion of the roller width direction and both end portions, the sufficient pressure is obtained, and the cleaning effect is also good.

In Example B, the diameter d of both end portions of the roller width direction is 39.2 mm, and in Example C, the diameter d of both end portions of the roller width direction is 38 mm, and in both of them, the sufficient pressure and cleaning effect can be obtained.

In Example D, the diameter d of both end portions of the roller width direction is 37.5 mm, and the condition (A1) is not satisfied. In this shape, the pressure at the both end portions is slightly insufficient, and the cleaning effect becomes weak.

In Example E, the diameter d of both end portions of the roller width direction is 36 mm, and the conditions (A1) and (A3) are not satisfied. In this shape, the pressure at the both end portions is slightly insufficient, and the cleaning effect becomes weak.

In comparative example 2, the diameter d of both end portions of the roller width direction is 35 mm, and any one of the conditions (A1)-(A3) is not satisfied. In this shape, the pressure at the central portion of the roller width direction is sufficiently obtained, however, the pressure at both end portions is slightly obtained. As the result, the foreign material remains on the recording medium, and the sufficient cleaning effect can not be obtained.

In Example F, the shape is as follows: the diameter D of the central portion of the roller width is 50 mm, and the diameter d of both end portions is 49 mm. In this shape, all of the conditions of (A1)-(A3) are satisfied, and the sufficient pressure can be obtained at both of the central portion of the roller width direction and both end portions, and the cleaning effect is also good.

In Example G, the roller length L is 1000 mm, and the other is the same shape as in the Example B. In this shape, all of the conditions of (A1)-(A3) are satisfied, and the sufficient pressure can be obtained at both of the central portion of the roller width direction and both end portions, and the cleaning effect is also good.

As described in detail above, according to the recording apparatus and foreign material removal method of the present invention, when the adhesive roller provided in the apparatus is formed into the crown shape, the uniform pressing force can be generated ranging over the whole width direction, and for the recording medium or rotating drum for the recording, the uniform foreign material removal ranging over the whole surface can be conducted. Further, as the adhesive material of the adhesive roller, when the material in which TiOx (titanium oxide) is included and Ba (barium) is not included, or the hydrocarbon compound having the functional group of C—O or Si—O is included, is used, the adhesive property is not aging-changed, and the optimum adhesive strength can be maintained always. Thereby, the image defect of the recording image can be prevented extending over a long period of time.

Seventh Embodiment

Figure 36:
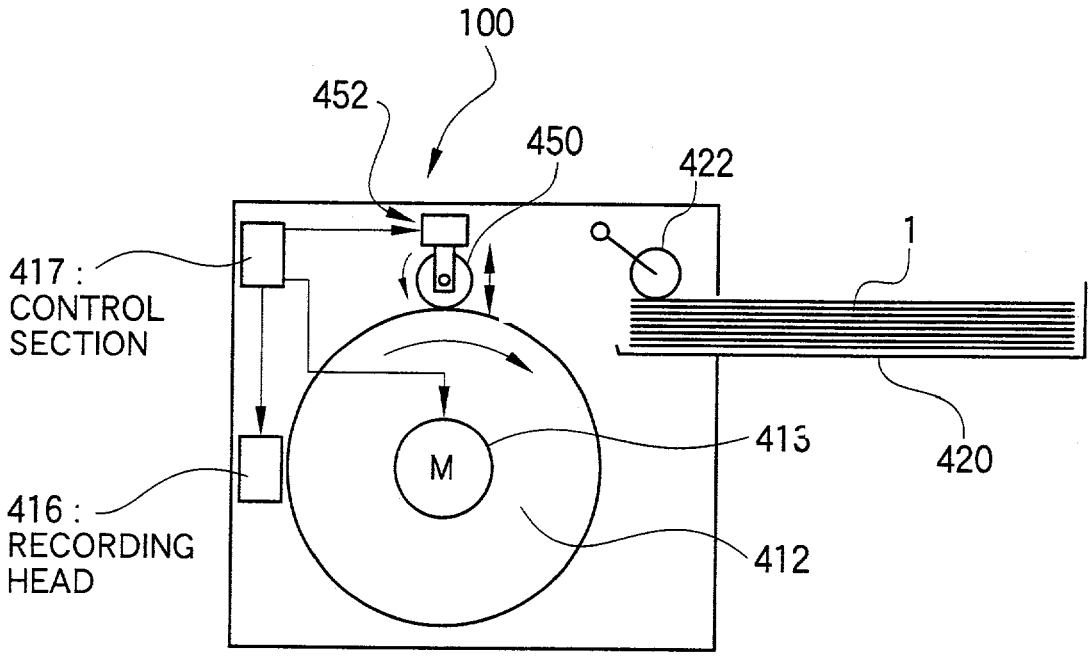
FIG. 36 is an overall structural view showing an outline structure of a recording apparatus according to the present invention.

Referring to the drawings from FIG. 36 to FIG. 43, a seventh preferred embodiment of a cleaning method of the recording medium and a recording apparatus according to the present invention will be detailed below. FIG. 36 is an overall structural view showing an outline structure of the recording apparatus according to the present invention, FIG. 37 is a structural view showing a recording head section of the recording apparatus according to the present invention.

Generally, in the recording apparatus to record on the recording medium, for example, there is the drum rotation recording method by which the recording medium is set on the rotating drum peripheral surface and the rotating drum is rotated, and on the one hand, the recording head is moved in the drum axis direction, or the laser light from the recording head is moved in the drum axis direction and the recording is conducted, or the self-traveling recording method by which the recording medium is conveyed to the recording position by the conveying roller, and on the one hand, the recording head is moved in the perpendicular to the conveyance direction, or the laser light from the recording head is moved in the direction perpendicular to the conveyance direction and recording is conducted. Herein, the drum rotation recording method will be described as an example, but the present invention is not limited to this method.

Initially, the structure of the recording apparatus of the present embodiment will be described below.

Figure 37:
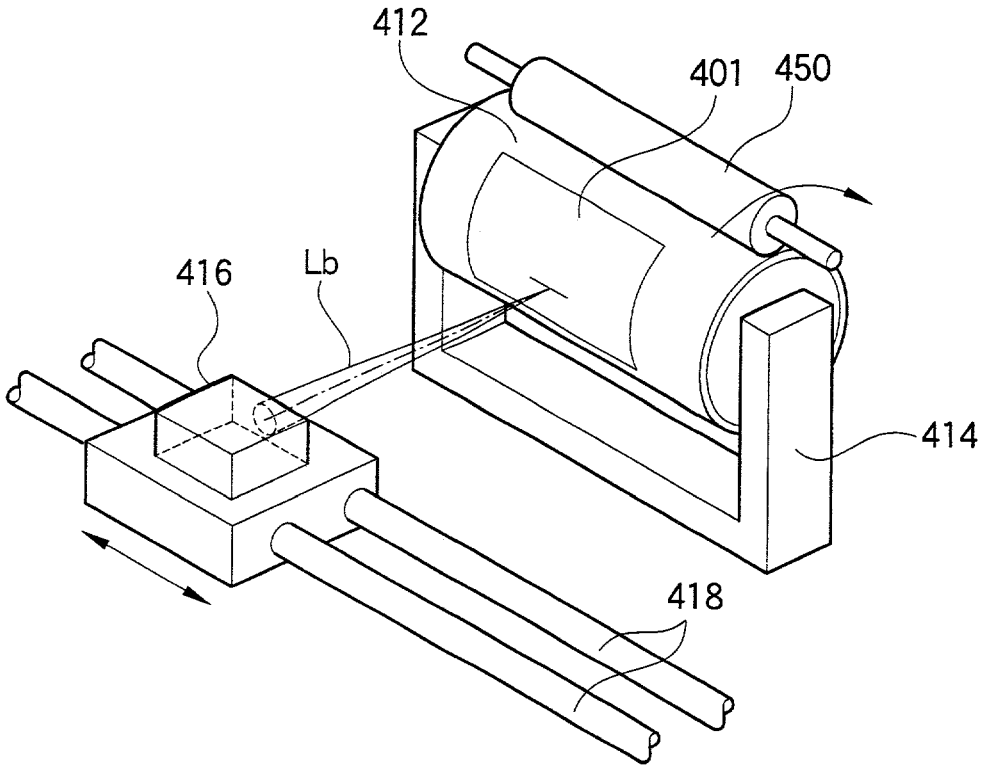
FIG. 37 is a structural view showing the structure of a recording head section of the recording apparatus according to the present invention.
Figure 38A:
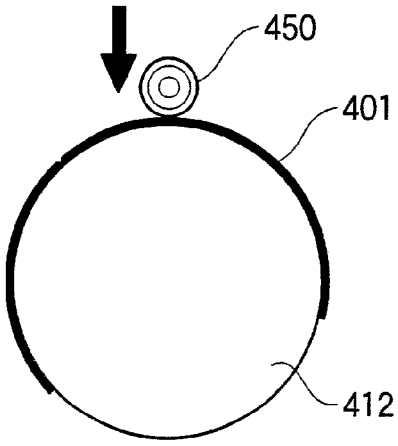
FIGS. 38(*a*) to 38(*f*) show views showing the position relationship of the recording medium set onto a rotating drum for the recording and a cleaning roller.
Figure 38D:
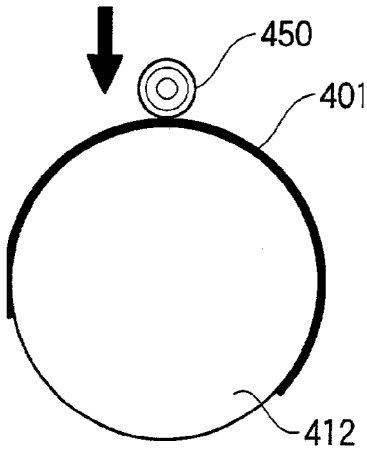
Figure 38B:
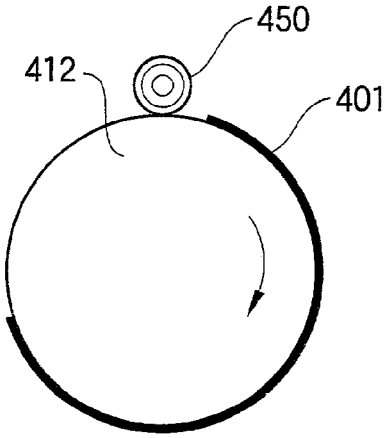
Figure 38E:
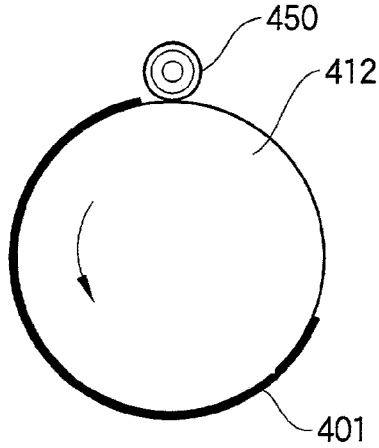
Figure 38C:
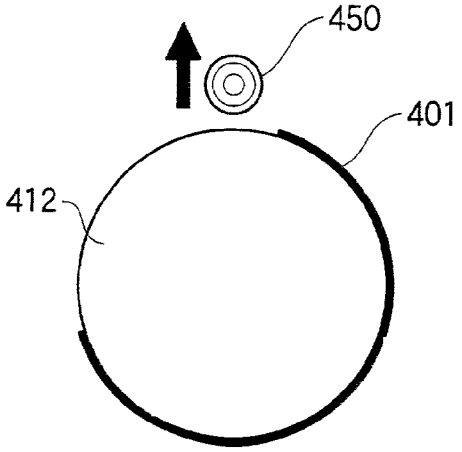
Figure 38F:
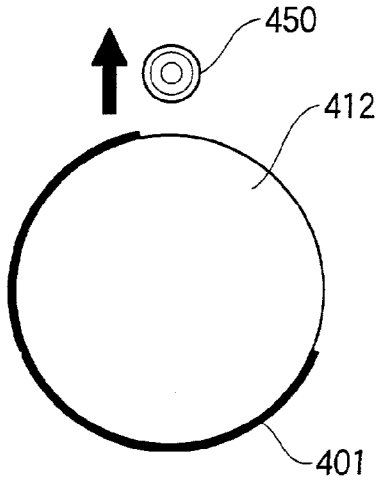
Figure 39A:
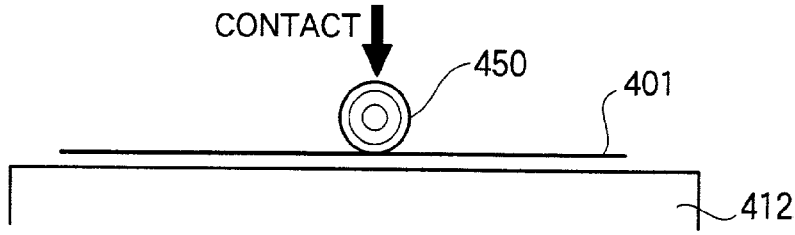
FIGS. 39(*a*) to 39(*f*) show views in which the rotating drum for the recording peripheral surface is developed and which shows the position relationship of the recording medium and a cleaning roller.
Figure 39B:
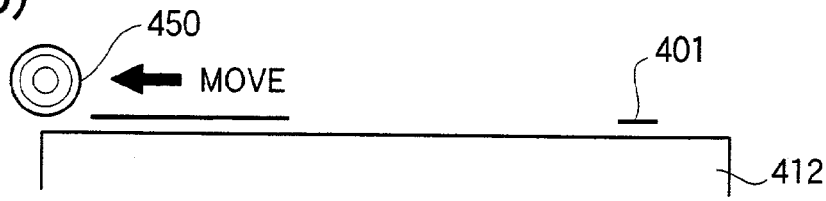
Figure 39C:
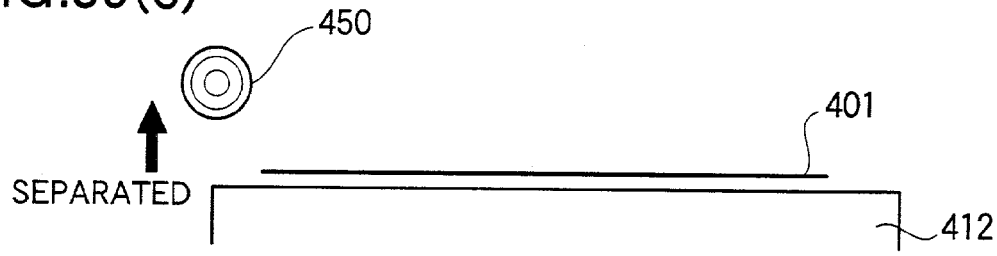
Figure 39D:
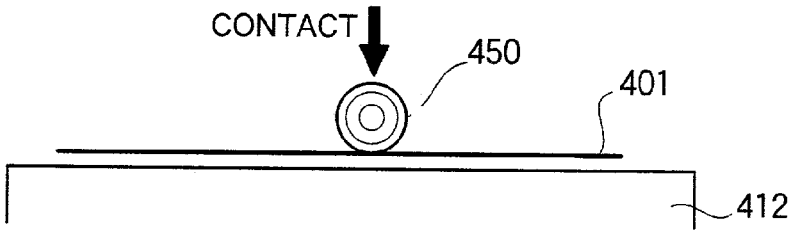
Figure 39E:
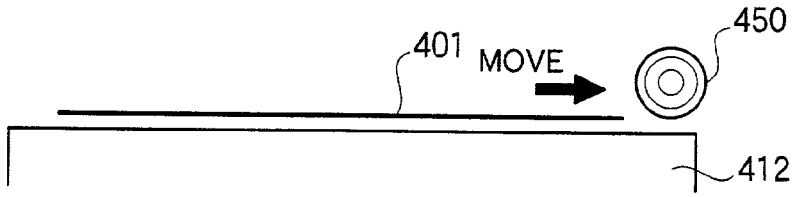
Figure 39F:
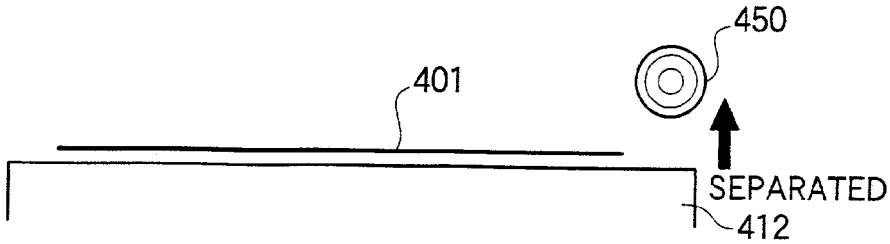

As shown in FIG. 36 and FIG. 37, a rotating drum for the recording (recording medium fixing member) 412 is provided in the recording section in a recording apparatus 100, and a recording head 416 is provided opposite to the rotating drum for the recording 412. Further, a signal according to the image data is supplied to the recording head 416, and further the control section 417 to control the motion of the whole recording apparatus 100 is connected to it. To the recording section having the rotating drum for the recording 412 and the recording head 416, a recording medium 401 is supplied from a recording medium supply section composed of a supply tray 420 and a pick-up roller 422. Further, a cleaning roller 450 is provided oppositely to the peripheral surface of the rotating drum for the recording 412 so as to be contactable with and separable from the drum peripheral surface.

The rotating drum for the recording 412 is a hollow cylindrical shape, and axially supported rotatably by a frame 414 shown in FIG. 37. The rotating drum for the recording 412 is connected to the rotation axis of a motor 413 and rotated. On the rotating drum for the recording 412, the recording medium 401 formed of the image receiving sheet having the image receiving layer and the color material sheet having the color material layer is superimposed, and sucked and fixed by the vacuum suction by the vacuum suction apparatus such as a vacuum pump, not shown. In this connection, in the present recording apparatus 100, the rotation direction of the rotating drum for the recording 412 is the main scanning direction.

The recording head 416 is attached so as to be straightly movable in the parallel direction to the rotation axis of the rotating drum for the recording 412 along the guide rail 418 by the drive apparatus, not shown. This movement direction is the sub scanning direction. Further, the recording head 416 emits the laser light Lb onto the rotating drum for the recording 412 side, and transfers the image receiving layer of the color material sheet at the irradiation position of this laser light Lb onto the image receiving layer of the image receiving sheet. Accordingly, by the combination of the rotation (main scanning) of the rotating drum for the recording 412 and the straight movement (sub scanning) of the recording head 416, a desired position on the color material sheet covering the image receiving sheet can be selectively laser-exposed. Accordingly, the recording medium 401 placed in the supply tray 420 is taken out from the upper side by a pick-up roller 422 and is set onto the rotating drum for the recording 412, and the laser light Lb for the drawing scans on the recording medium 401, and exposes the recording medium 401 by on-off modulation of the laser light Lb according to the image information, thereby, a desired image is formed on the recording medium 401.

In a cleaning roller 450, the supporting portions of both ends of the roller are connected to the drive mechanism 452 such as an air piston. and by moving the drive mechanism 452, at a predetermined timing, the cleaning roller 450 is brought into contact with separated from the rotating drum for the recording 412 surface.

The motor 413 for the rotation drive of the rotating drum for the recording 412, recording head 416, and the drive mechanism 452 of cleaning roller 450 are connected to the control section 417 and respectively controlled.

Next, referring to FIG. 38 and FIG. 39, the procedure to clean the surface of the recording medium (image receiving sheet and color material sheet) set on the rotating drum for the recording 412 peripheral surface will be described.

FIG. 38 is a view showing the position relationship of the recording medium set on the rotating drum for the recording and the cleaning roller, and FIG. 39 is a view in which the rotating drum for the recording peripheral surface is developed, and which shows the position relationship of the recording medium and the cleaning roller.

Initially, as shown in FIG. 38(*a*) and FIG. 39(*a*), the cleaning roller 450 is brought into contact with an almost central portion of the peripheral direction (relative movement direction to the cleaning roller 50) of the recording medium 401 fixed on the rotating drum for the recording 412, and as shown in FIG. 38(*b*) and FIG. 39(*b*), the rotating drum for the recording 412 is rotated (herein, as an example, clockwise). Then, as shown in FIG. 38(*c*) and FIG. 39(*c*), after the cleaning roller 450 passes one peripheral direction end portion of the recording medium 401, the cleaning roller 450 is almost vertically separated from the recording medium 401 surface. According to the above motions, the cleaning is conducted on an area from the peripheral direction central portion at which the cleaning roller 450 is brought into contact with the recording medium 401 at first, to one peripheral direction end portion.

Next, as shown in FIG. 38(*d*) and FIG. 39(*d*), the cleaning roller 450 is brought into contact with the peripheral direction almost central portion of the recording medium 401 fixed on the rotating drum for the recording 412 again, and as shown in FIG. 38(*e*) and FIG. 39(*e*), the rotating drum for the recording is rotated in the reversal direction (herein, counterclockwise) to the preceding rotation. Then, as shown in FIG. 38(*f*) and FIG. 39(*f*), after the cleaning roller 450 passes the other peripheral direction end portion of the recording medium 401, the cleaning roller 450 is separated from the recording medium surface almost vertically. According to the above motions, the cleaning is conducted on an area from the peripheral direction central portion at which the cleaning roller 450 is brought into contact with the recording medium 401 again, to the other peripheral direction end portion, and the cleaning is conducted ranging over whole surface of the recording medium.

Figure 40:
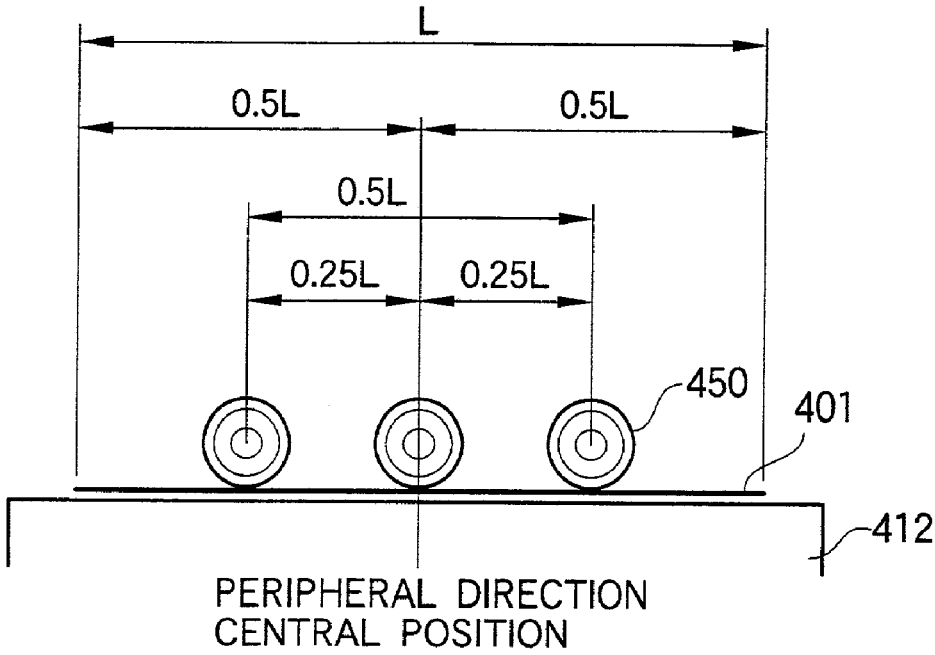
FIG. 40 is a view showing a contact start position of the cleaning roller with the recording medium on the rotating drum for the recording peripheral surface.

Herein, it is preferable that the position at which the cleaning roller is brought into contact with the recording medium is set to the following position. In FIG. 40, a contact start position of the cleaning roller with the recording medium on the rotating drum for the recording peripheral surface is shown. As shown in FIG. 40, when the peripheral direction length of the recording medium 401 is L, the peripheral direction central position of the recording medium is a position of 0.5 L from the peripheral direction end portion of the recording medium 401. It is preferable that the contact of the cleaning roller is started within the range of ±0.25 L from the peripheral direction central position to the peripheral direction, that is, the range of 50% of the peripheral direction length centering around the peripheral direction central position. When, within this range, the contact is started, a sufficient length from the peripheral direction end portion of the recording medium can be kept, and the cleaning area per one motion can be expanded, and the effective cleaning can be conducted.

Figure 41:
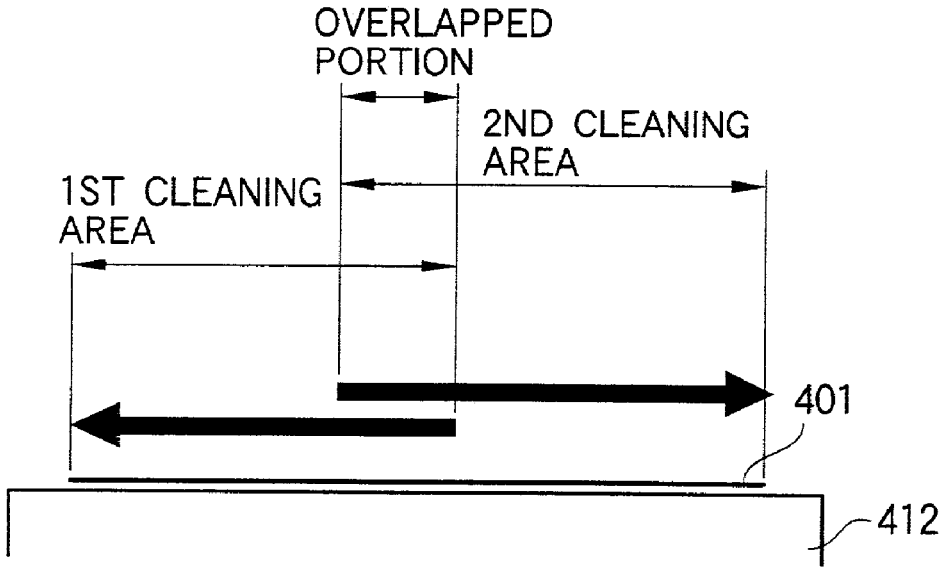
FIG. 41 is a view showing a condition in which a cleaning area to one peripheral direction end portion of the recording medium and a cleaning area to the other peripheral direction end portion are overlapped.

Further, in FIG. 41, a condition that the first cleaning area to the one peripheral direction end portion of the recording medium 401 and the second cleaning area to the other peripheral direction end portion are overlapped with each other, is shown. As shown in FIG. 41, when the cleaning area to each direction are overlapped, the cleaning can be conducted ranging over whole surface of the recording medium 401 without gap. As this overlap amount, when it is set to a value not larger than 45% of the recording medium peripheral direction length, even when the rotation position error of the rotating drum for the recording or the fixed position error of the recording medium is generated, the overlap can be surely conducted and the cleaning can be conducted, and further, the useless cleaning by the excessive overlap can be prevented.

According to the above cleaning method of the recording medium 401, it is prevented that the recording medium 401 is turned over from the rotating drum for the recording 412 surface, the recording medium 401 generates the position dislocation, the film peeling is generated, or the recording medium 401 is separated from the rotating drum for the recording 412. Then, when the cleaning roller 450 cleans the image receiving sheet 402, the foreign material adhered onto the image receiving layer 2*c* of the image receiving sheet 402 is removed, and the generation of the image clearness shown in FIG. 11 can be prevented, and when the color material sheet 403 on the image receiving sheet 402 is cleaned, the foreign material on the support layer 3*a* of the color material sheet 403 is removed, and the laser light irradiated at the time of recording is not interrupted, and the generation of the image clearness can be prevented.

Further, onto the rotating drum for the recording 412, in order to smooth the surface and prevent the image defect such as the ring clearness, and smoothly set the various sizes of recording media on the rotating drum for the recording 412, the recording medium surface fixing member is sometimes attached.

Figure 42:
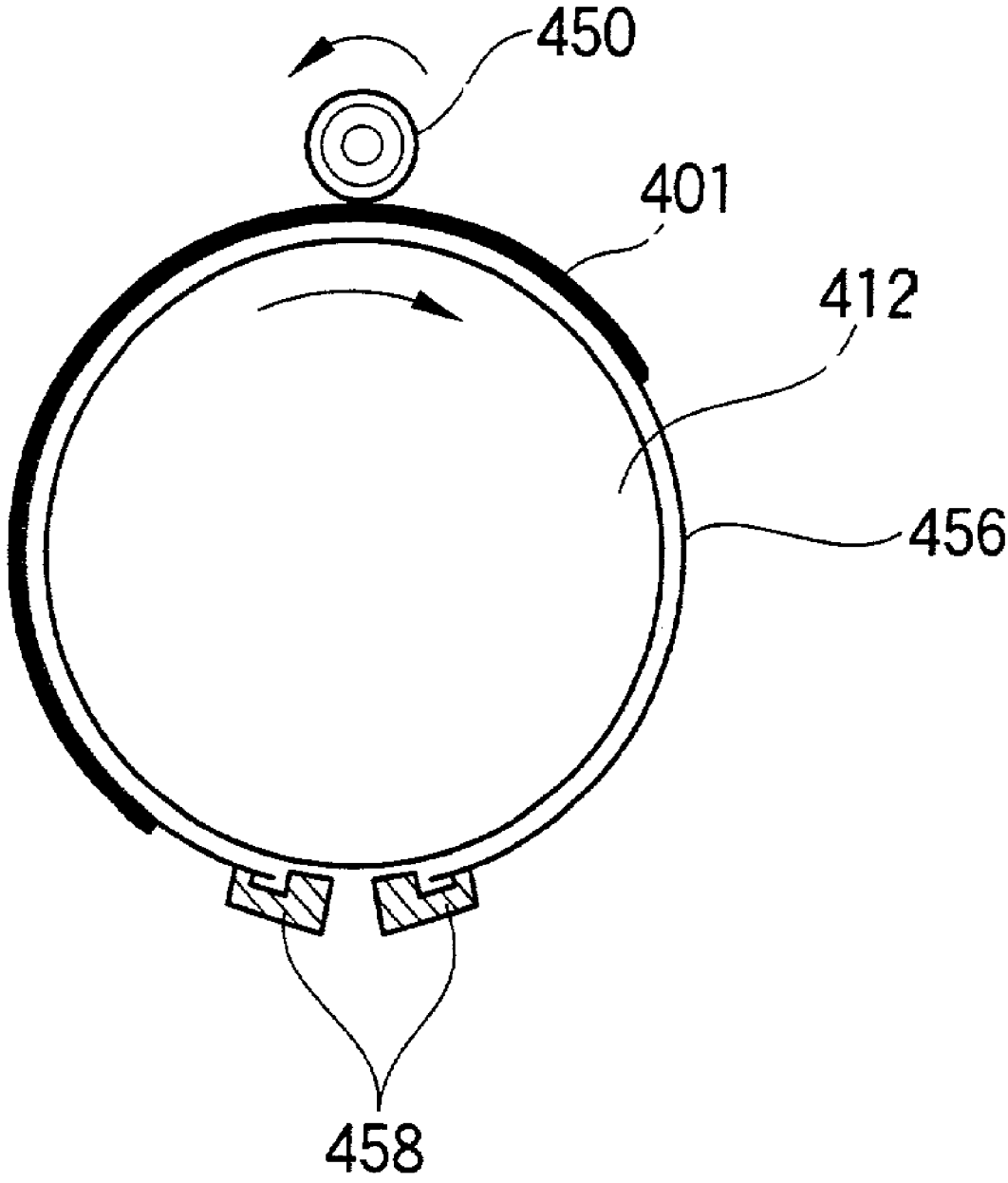
FIG. 42 is a view showing a condition that the recording medium is fixed onto the recording medium surface fixing member and cleaned.
Figure 43A:
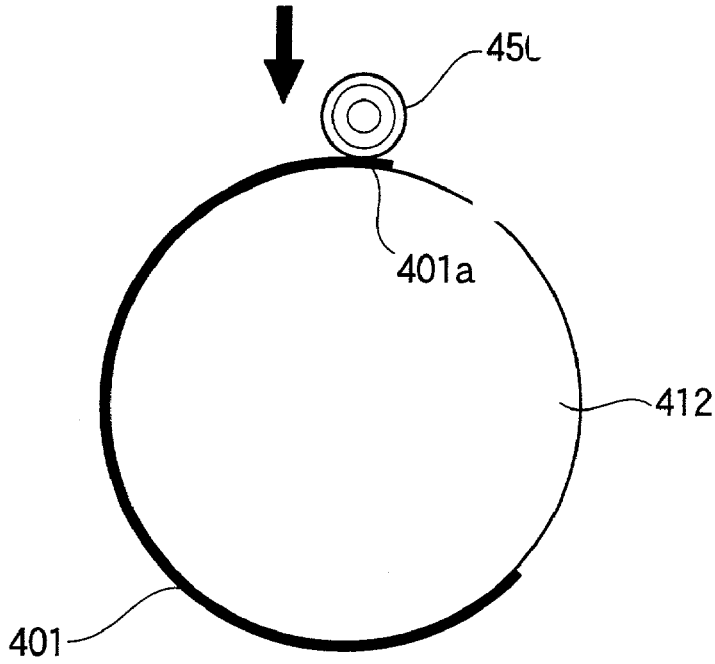
FIGS. 43(*a*) to 43(*b*) show views showing the conventional cleaning procedure.
Figure 43B:
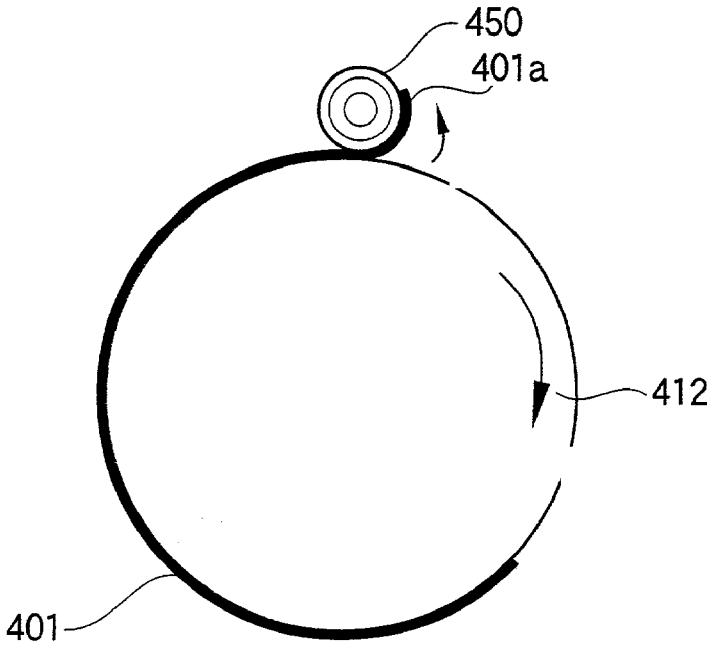

This recording medium surface fixing member is, as shown in FIG. 42, formed of the plate-like member which is made of resin or metal and whose surface is smooth, and wound around the peripheral surface of the rotating drum for the recording 412, and clamped and fixed by the fixing releasing mechanism 458 provided to the rotating drum for the recording 412. Thereby, the peripheral surface of the rotating drum for the recording 412 can be formed into the smooth surface, and generation of undulation in the set recording medium 401 can be prevented.

Also for the recording medium 401 fixed on the surface of this recording medium surface fixing member 456, in the same manner as described above, the foreign material removal can be conducted by the cleaning roller 450. Thereby, the foreign material X adhered onto the surface of the recording medium 401 can be removed without generating the position dislocation of the recording medium 401, and the generation of the image defect in the recording image due to the foreign material can be previously prevented.

Further, in the present embodiment, the rotating drum type recording apparatus by which the recording medium is fixed onto the rotating drum for the recording 412 and the recording is conducted, is described as an example, but the present invention is not limited to this structure, but, for example, also for the fixed type recording apparatus in which the rotating drum for the recording 412 whose peripheral surface is developed as shown in FIG. 39, is regarded as a plane fixed base, and recording medium is fixed thereon and the recording is conducted, and also for the conveying type recording apparatus in which, while recording medium is conveyed by nip rollers, the recording is conducted, in the same manner, the above cleaning method of the recording medium can be applied. That is, it may be allowable when it is a structure in which the cleaning roller can be relatively moved to the recording medium fixing member such as the rotating drum for the recording or plane fixed base.

According to a cleaning method of the recording medium of the present invention, the recording medium surface is cleaned when the cleaning roller is brought into contact with almost central portion in the relative movement direction of the recording medium, and the cleaning roller is relatively moved to one relative movement direction end portion, and after that, when the cleaning roller is brought into contact with almost central portion in the relative movement direction of the recording medium again, and the cleaning roller is relatively moved to the other relative movement direction end portion, the recording medium surface is cleaned. Further, while the cleaning roller is brought into contact with the recording medium, the cleaning roller is relatively moved to the relative movement direction end portion of the recording medium, and after the cleaning roller passes the relative movement direction end portion of the recording medium, the cleaning roller is separated from the recording medium fixing member surface to which it transferred from the recording medium. Thereby, even when the adhesion property of the cleaning roller is large, there is no case where the end portion of the fixed recording medium is turned over, film peeling is generated, or the position dislocation of the recording medium is generated, and the whole recording medium surface is cleaned. Accordingly, the image defect of the recording image is prevented, and the high quality image formation becomes possible.

According to the recording apparatus according to the present invention, when the recording apparatus is provided with a cleaning roller having the adhesion property provided oppositely to the recording medium fixing member in such a manner that it can be contacted with or separated from the fixed recording medium, and a control section which controls the contact and separation motion of the cleaning roller, and the relative movement motion of the recording medium fixing member and the cleaning roller, a motion by which the cleaning roller is relatively moved while the cleaning roller is brought into contact with almost central portion of the relative movement direction of the recording medium fixed onto the recording medium fixing member, and after the cleaning roller passes one relative movement direction end portion of the recording medium, the cleaning roller is separated from the recording medium fixing member surface, and after that, the cleaning roller is relatively moved in the reversal direction to the preceding movement direction while the cleaning roller is brought into contact with almost central portion of the relative movement direction of the recording medium again, and after the cleaning roller passes the other relative movement direction end portion of the recording medium, the cleaning roller is separated from the recording medium fixing member surface, becomes possible. Thereby, even when the adhesion property of the cleaning roller is large, there is no case where the end portion of the fixed recording medium is turned over, film peeling is generated, or the position dislocation of the recording medium is generated, and the whole recording medium surface is cleaned and the high quality image formation becomes possible.

Eighth Embodiment

Referring to the drawings from FIG. 44 to FIG. 50, the eighth and the ninth embodiments relating to the adhesive roller and the foreign material removal method using it according to the present invention will be described below.

Figure 44:
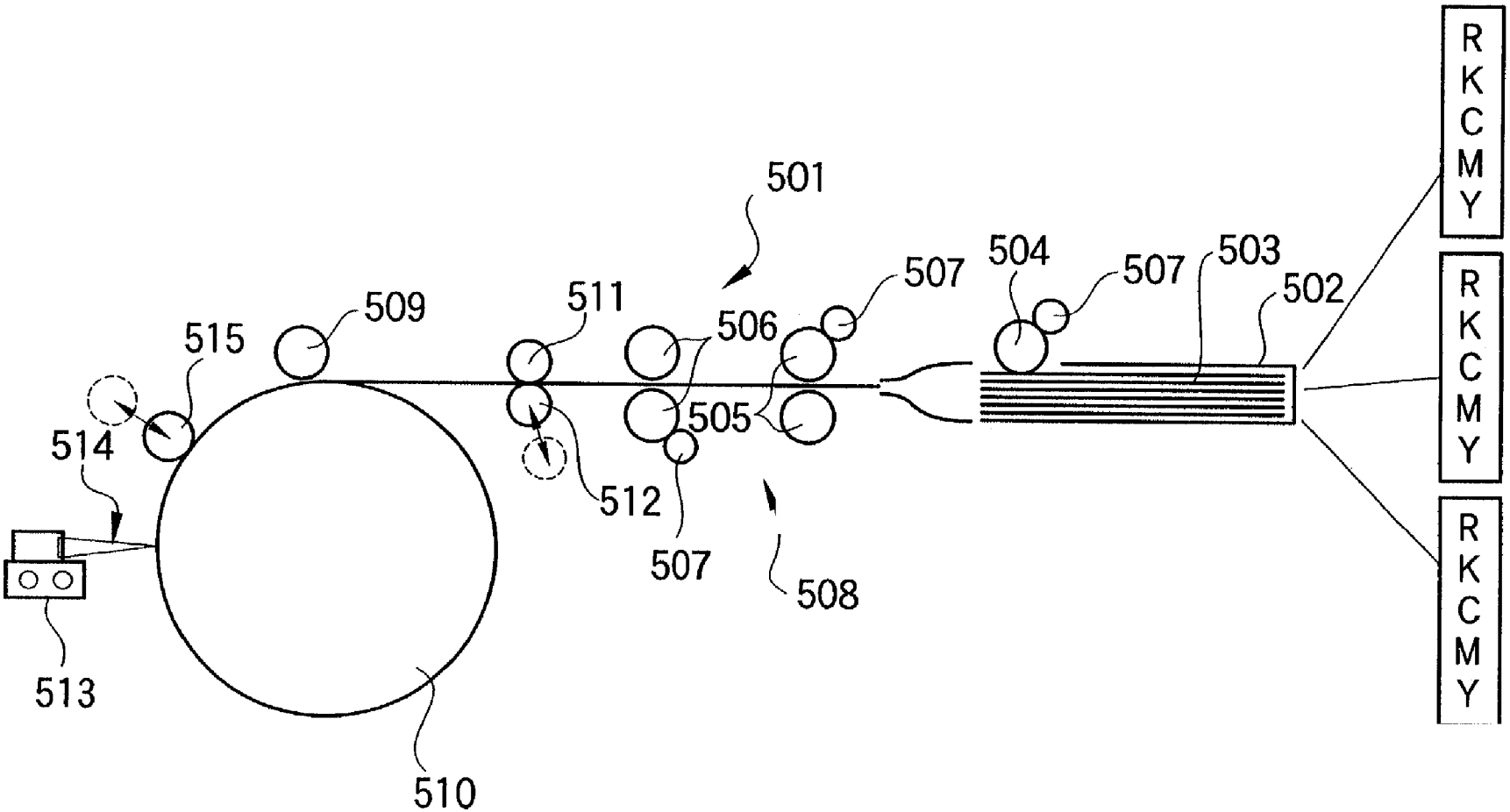
FIG. 44 is a structural view showing a main portion of the recording apparatus.

FIG. 44 is a structural view showing a main portion of the recording apparatus. In this connection, in the present embodiment, a case where the adhesive roller and the foreign material removal method using it according to the present invention are applied to the recording apparatus, will be described below.

In the recording apparatus of the present embodiment, as shown in FIG. 44, a sheet cassette 502 detachable to the recording apparatus 501 is provided, and sheets 503 are loaded in the sheet cassette 502. The sheet set is structured in such a manner that total five kinds of sheets of the image receiving sheet (R), transfer sheets of K (black), C (cyan), M (magenta) and Y (yellow) are accommodated in the order, and a plurality of sheet sets are loaded in the sheet cassette 502. Then, by a pick-up roller 504, the sheets 503 successively pass through between a pair of conveying rollers 505, 505 and 506, 506, provided in the conveyance section by one by one sheet, and it is conveyed to the rotating drum for the recording 510.

In the vicinity of the pick-up roller 504 and the conveying rollers 505 and 506, in order to remove by adherence the foreign material adhered onto the surface of rollers 504, 505, 506, the movement mechanism such as an air cylinder or urging mechanism such as a spring is arranged so that the adhesive rollers 507, 507, 507 are always or appropriately pressed onto and brought into contact with the surface of rollers 504, 505, 506. After the image receiving sheet (R) which is a recording medium sheet initially conveyed onto the rotating drum for the recording 510, passes through a pair of conveying rollers 505, 505, and conveying rollers 506, 506, it is conveyed between the pressing roller 509 and the rotating drum for the recording 510, and pressed by the pressing roller 509, and sucked onto the rotating drum for the recording 510 side by the suction mechanism (not shown) provided in the rotating drum for the recording 510. In this case, the surface not sucked onto the rotating drum for the recording 510 is the image receiving layer of the image receiving sheet (R).

Next, the first transfer sheet (K) is conveyed to the rotating drum for the recording 510 through the conveyance section 508. A fixed roller 511 and the adhesive roller 512 as if it is opposite to the fixed roller 511, are arranged between the conveyance section 508 and the rotating drum for the recording 510. The movement mechanism such as the air cylinder is provided so that the adhesive roller 512 can be pressed onto the fixed roller 511 only when the transfer sheet (K) is conveyed. Then, when the transfer sheet (K) passes between the fixed roller 511 and the adhesive roller 512, the foreign material adhered onto the toner layer of the transfer sheet (K) can be removed by the adhesive roller 512 by adherence. While the transfer sheet (K) passed through the adhesive roller 512 is superimposed on the image receiving surface of the image receiving sheet (R) sucked onto the rotating drum for the recording 510, it passes through the pressing roller 509 and the rotating drum for the recording 510. The transfer sheet (K) is set in such a manner that the sheet width or sheet length is not smaller than the image receiving sheet (R), and in the suction section provided on the rotating drum for the recording 510, the transfer sheet (K) is sucked at the suction section outside the suction section by which the image receiving sheet (R) is sucked, and under the condition that the image receiving layer of the image receiving sheet (R) and the toner layer of the transfer sheet (K) are superimposed on each other, it is sucked and fixed on the drum for the recording 510 (not shown).

Further, when the rotating drum for the recording 510 is rotated, the laser exposure 514 is conducted by the recording head 513 onto the image receiving sheet (R) and the transfer sheet (K) which are superimposed on each other, and the transfer from the transfer sheet (K) onto the image receiving sheet (R) is conducted. After the completion of the transfer, only the transfer sheet (K) is peeled from the rotating drum for the recording 510 and delivered, and the next transfer sheet (C) is conveyed and sucked and fixed in such manner that it is superimposed on the image receiving sheet (R) on the rotating drum for the recording 510 each other. Hereinafter, in the same manner, the laser exposure, peeling, delivering are conducted, the transfer onto the image receiving sheet (R) from the transfer sheet (M) and transfer sheet (Y) is repeatedly conducted. As the result, the color (K, C, M, Y) from the four color transfer sheets is transferred onto the image receiving surface of the of the image receiving sheet (R), thereby, the image or character of the color is formed on the image receiving sheet (R).

The adhesive roller 515 is arranged among the rotating drum for the recording 510 and the pressing roller 509 and the recording head 513, and pressed onto the surface of the rotating drum for the recording 510 or the surface of the sheet sucked and fixed onto the rotating drum for the recording 510, and removes the foreign material. It may also be structured such that, onto the adhesive roller 515, the movement mechanism by the air cylinder is attached, and when necessary, it moves to the direction of the rotating drum for the recording 510, and comes into contact with the drum 510, and adherence removal of the foreign material on its surface is conducted, and not only that, but even when the apparatus is not used when the recording apparatus 501 is started, or at the power supply input condition, the rotating drum for the recording 510 is rotated periodically, and also the foreign material adhered onto the surface of the rotating drum for the recording 510 is removed.

Finally, the image receiving sheet (R) is peeled from the rotating drum for the recording 510, and conveyed to the separately provided image transfer section (not shown), and the toner ink on the image receiving sheet is further transferred onto the arbitrary printing sheet. Thereby, the color printing for the correction is conducted.

Figure 45A:
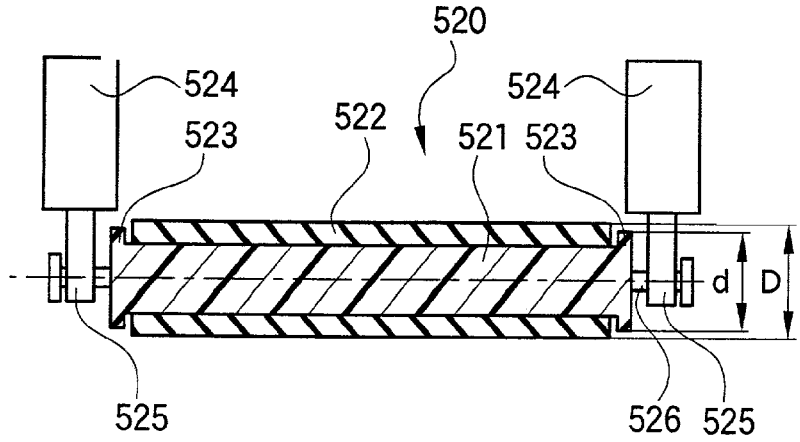
FIGS. 45(*a*) to 45(*b*) show embodiments before the adhesive roller of the present invention is pressed onto the foreign material removal objective surface, and (a) is a sectional view, and (b) is a side view.
Figure 45B:
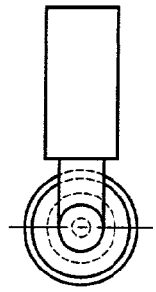

FIG. 45 shows an embodiment before the adhesive roller of the present invention is pressed onto the foreign material removal objective surface, and FIG. 45(*a*) is a sectional of the adhesive roller, and FIG. 45(*b*) is a side view of the adhesive roller.

The adhesive roller 520 shown in FIG. 45(*a*) can be adopted, for example, to the adhesive rollers 507, 507, 507, 512, and 515 arranged in the recording apparatus 501 in FIG. 44, and the cylindrical core portion 521 is formed around the rotating axis, and the adhesive member 522 is attached in such a manner that it covers around the core portion 521.

The adhesive member 522 is a rubber material, and an adhesive rubber which includes $TiO_x$ (titanium oxide), and (or) hydrocarbon compound having the functional group of C—O or Si—O, and does not include Ba (barium), can be appropriately used. When this material is used, the foreign material adhered on the recording medium can be removed extending over a long period of time. The preferable material is such as Sample 1 or Sample 2 as already discussed, and because of its small electric resistance value, it has the feature of removing the static electricity generated in the recording medium.

A pair of regulation disks 523, 523, and a pair of air cylinders 524, 524 and piston rod 525, 525 are provided at both end portions of the rotating axis direction of the adhesive roller 520 structured by the core portion 521 and the adhesive member 522. The adhesive roller shown in FIG. 45 is an embodiment of the present invention, and the core portion 521 and a pair of regulation disks 523, 523 are integrally molded and made of resin products such as Derurin (du-Pont Co.), phenol resin, urethane resin, high hardness rubber, Teflon, (du-Pont co.), Juracon (Poly plastic co.), acetal resin, and ethylene tetra fluoride resin, or metallic products such as aluminum, iron, and stainless steel, thereby, the number of parts can be reduced.

The adhesive member 522 of the adhesive roller 520 has the outer diameter D, and the regulation disk 523 has diameter d, and these are set so that the diameter d of the regulation disk 523 is not slightly larger than the outer diameter D of the adhesive member 522. Accordingly, a value of (rubber radius (D/2))−(disk radius (d/2)) is a compression deformation amount of the adhesive member 522 when the adhesive roller 520 is pressed onto the foreign material removal objective surface.

When the air is supplied to the air cylinders 524, 524 from the air supply source, not shown, the piston rods 525, 525 are extended, and the movement operation is started so that the adhesive roller 520 is pressed onto the foreign material removal objective surface. When the movement operation is started, the adhesive member 522 whose diameter is larger than the regulation disk 523 is initially brought into contact with the foreign material removal objective surface, and next, following the extension of the piston rod 525, the adhesive member 522 is gradually compression-deformed, and when the regulation disk 523, 523 are brought into contact with the foreign material removal objective surface, the compression deformation of the adhesive member 522 is regulated.

Figure 46A:
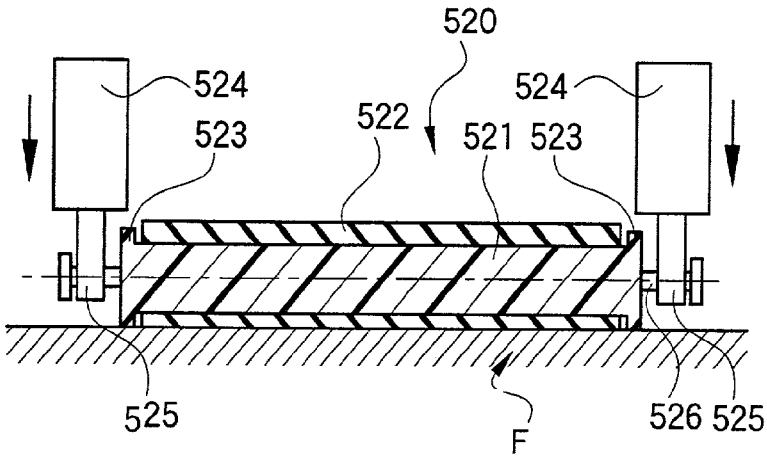
FIGS. 46(*a*) to 46(*b*) show embodiments after the adhesive roller of the present invention is pressed onto the foreign material removal objective surface, and (a) is a sectional view, and (b) is a side view.
Figure 46B:
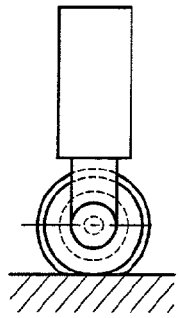

FIG. 46 shows another embodiment after the adhesive roller of the present invention is pressed onto the foreign material removal objective surface, and FIG. 46(*a*) is a sectional view of the adhesive roller, and FIG. 46(*b*) is a side view of the adhesive roller.

When regulation disks 523, 523 are brought into contact with the foreign material removal objective surface F, after the compression deformation of the adhesive member 522 is regulated, the rotating drum for the recording which is the foreign material removal objective surface F or the foreign material on the toner layer surface of the transfer sheet is removed by the adherence by the adhesive member 522 which is compression-deformed. At this time, the diameter (D/2−α) from the rotating axis center of the adhesive roller 520 to the outer surface of the adhesive member 522 which is compression deformed by the compression deformation amount α and the radius (d/2) of the regulation disk is the same diameter (value). When the foreign material removal operation of the foreign material removal objective surface F is completed, the piston rods 525, 525 are contracted, and the adhesive roller 520 is separated from the foreign material removal objective surface F and the adhesive member 522 which is compression-deformed, is expanded and returns to the initial outer diameter.

Ninth Embodiment

Figure 47:
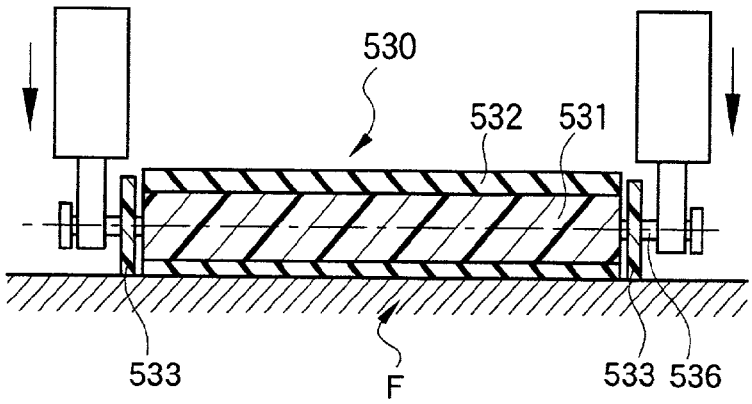
FIG. 47 is a sectional view showing another embodiment after the adhesive roller of the present invention is pressed onto the foreign material removal objective surface.

FIG. 47 is a sectional view showing the ninth embodiment of the adhesive roller of the present invention, and shows the condition after it is pressed onto the foreign material removal objective surface. Except a point in which, after the core portion 531 of the adhesive roller 530 and the regulation disks 533, 533 are respectively molded, they are assembled, the main structure of the adhesive roller shown in FIG. 45 is the same.

The assembly of the regulation disks 533, 533 onto the shaft 536 of the adhesive roller 530 can be conducted by a method by which it is fixed by a screw (setscrew) or a method (slot) by which a portion of the disk is slotted and when it is inserted into the shaft 536, the slotted portion is enlarged and it is assembled. When the core portion 531 and the regulation disks 533, 533 are separately provided, the adhesive member 532 can be easily set onto the core portion 531 before the assembly of the regulation disks 533, 533, thereby, the assembly property is increased. Further, also when the adhesive member 532 is replaced, the regulation disk is disassembled, and the replacing operation becomes easy.

Figure 48A:
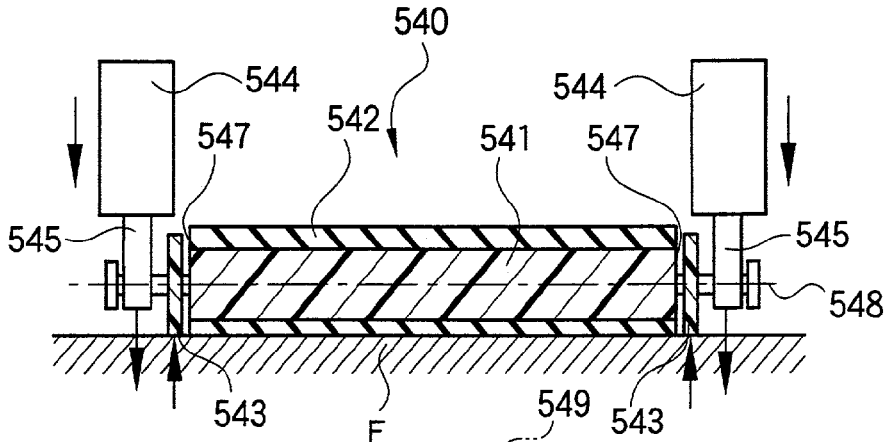
FIGS. 48(*a*) to 48(*b*) shows another embodiment after the adhesive roller of the present invention is pressed onto the foreign material removal objective surface, and (a) is a sectional view and (b) is a flexure curve of the rotating axis line of the adhesive roller.
Figure 48B:
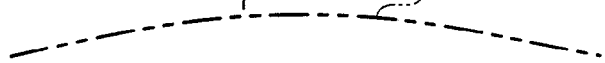
Figure 49A:
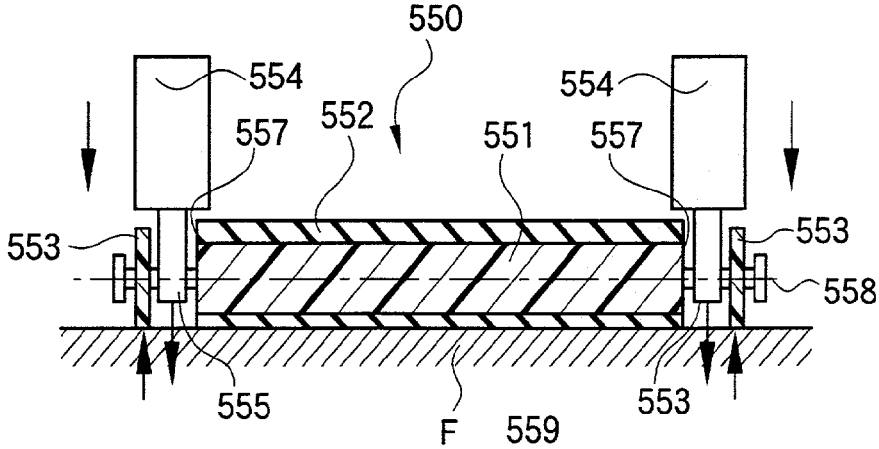
FIGS. 49(*a*) to 49(*b*) shows another embodiment after the adhesive roller of the present invention is pressed onto the foreign material removal objective surface, and (a) is a sectional view and (b) is a flexure curve of the rotating axis line of the adhesive roller.
Figure 49B:
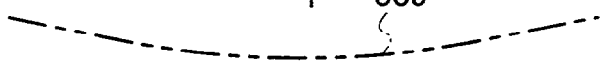
Figure 50:
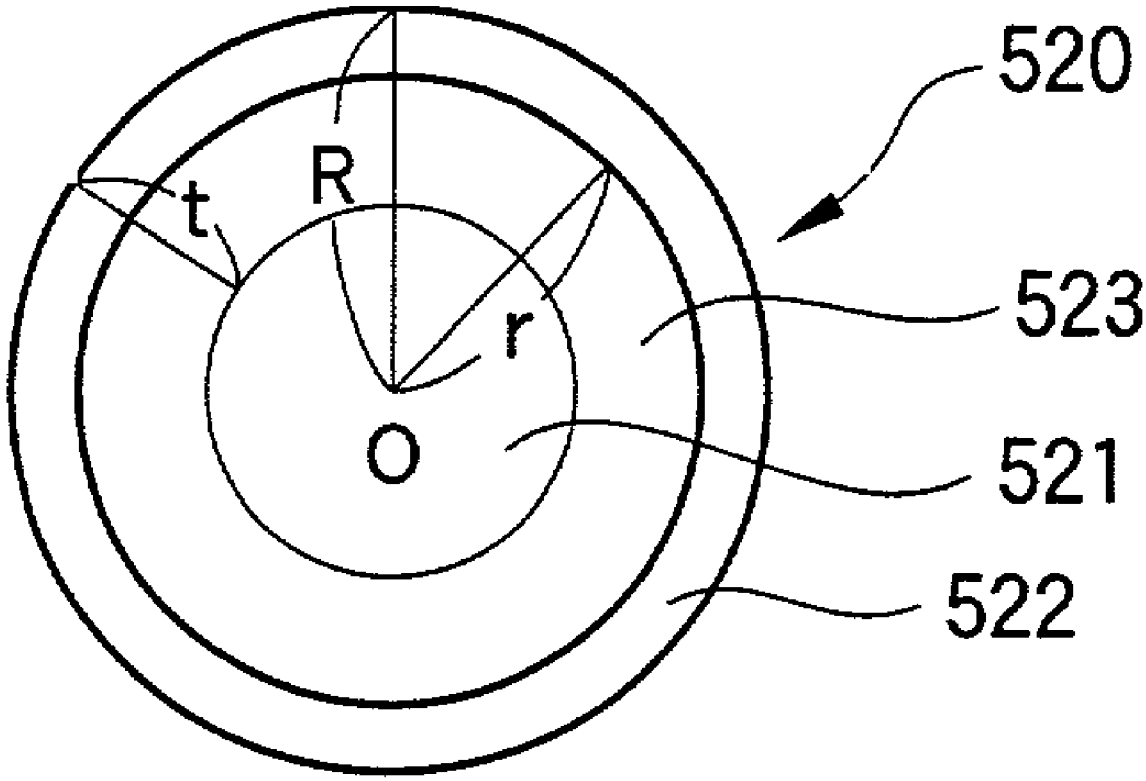
FIG. 50 is a side view showing the relationship among the core portion, adhesive member, and regulation disk of the adhesive roller of the present invention.

FIG. 48 and FIG. 49 are another embodiment of the adhesive roller of the present invention, and shows the relationship of the arrangement positions of the regulation disks and the air cylinders which are the drive section, respectively arranged at both ends of the rubber roller, and the main structure and mechanism are the same as shown in FIG. 46 and FIG. 47.

FIG. 48(*a*) is a sectional view of the structure in which the regulation disks are arranged outside of both end surfaces of the core portion of the adhesive roller, and further the air cylinders are arranged outside them, and FIG. 48(*b*) shows the flexure direction of the rotating axis when the adhesive roller is pressed onto the foreign material removal objective surface. The regulation disks 543, 543 are respectively arranged outside the both end surfaces 547, 547 of the rotating axis 548 direction of the core portion 541 of the adhesive roller 540, and further, air cylinders 544, 544 are respectively arranged outside the regulation disks 543, 543. The flexure direction of the rotating axis 548 of the adhesive roller 540 generated when the regulation disks 543, 543 are pressed on the foreign material removal objective surface by the air cylinders 544, 544 and piston rods 545, 545, is a curve 49 shown in FIG. 48(*b*). That is, by the relationship of the pressing force by which the adhesive roller 540 is pressed onto the foreign material removal objective surface F by the piston rods 545, 545, and the repulsive force applied onto the regulation disks 543, 543 from the foreign material removal objective surface, the flexure of the rotating axis 548 is a curve 4 shown in FIG. 48(*b*), and in the flexure in the vicinity of the central portion of the adhesive roller 540, the flexure to the reversal direction to the pressing direction onto the foreign material removal objective surface becomes large, and the pressing force onto the foreign material removal objective surface is decreased.

FIG. 49(*a*) is a sectional view in which air cylinders are arranged outside both end surfaces of the core portion of the adhesive roller, and further, the regulation disks are arranged outside them, and FIG. 49(*b*) shows the flexure direction of the rotating axis when the adhesive roller is pressed onto the foreign material removal objective surface. Air cylinders 554, 554 are arranged outside both end surfaces 557, 557 of the rotating direction of the core portion of the adhesive roller, and further, the regulation disks 553, 553 are respectively arranged outside the air cylinders 554, 554. The flexure direction of the rotating axis 558 generated when the regulation disks 543, 543 are pressed onto the foreign material removal objective surface F by the air cylinders 554, 554 and piston rods 555, 555, is a curve 59 shown in FIG. 49(*b*). In this case, the flexure to the pressing direction onto the foreign material removal objective surface in the vicinity of the central portion of the adhesive roller 540 becomes large, and the foreign material removal in the vicinity of the central portion of the adhesive roller becomes good.

Further, in order to conduct the good foreign material removal by the adhesive roller of the present invention, as shown in the following Table 501, the difference between the outer diameter D of the adhesive member and the diameter d of the regulation disk is related.

TABLE 4

| D-d (mm) | When foreign material removal objective surface is image receiving sheet, or transfer sheet | When foreign material removal objective surface is rotating drum for recording, or medium surface fixed member (plate) |
|---|---|---|
| 0 | foreign material removal is poor | foreign material removal is poor |
| 0.5 | foreign material removal is good | foreign material removal is good |
| 1 | foreign material removal is fine | foreign material removal is fine |
| 2 | foreign material removal is fine | foreign material removal is fine |
| 2.5 | a portion of sheet is peeled, or film is peeled | rotation resistance of drum is slightly increased, or plate is dislocated |
| 3 | sheet is peeled, or film is peeled | rotation resistance of drum is increased, or plate is separated |

As can be seen from the table 501, when D−d=0, that is, when the outer diameter of rubber and diameter of the regulation disk is the same, the adhesive member of the adhesive roller can not be compression-deformed, thereby, the adherence-peeling of the foreign material can be slightly conducted on the foreign material removal objective surface, and becomes the poor foreign material removal. When the transfer is conducted in this condition, by the existence of the foreign material, the image defect such as the image reversing or ring unevenness appears.

On the one hand, when the diameter of the regulation disk is smaller than the outer diameter of the rubber by 0.5-2 (mm), because the adhesive member is compression-deformed, and closely contacted with the foreign material removal object, a good foreign material removal effect can be obtained. When the diameter of the regulation disk is smaller than the outer diameter of the rubber by 2.5 mm or 3 mm, the compression deformation amount (adherence amount) of the adhesive member to the foreign material removal objective surface is too large, thereby, the peeling of the image receiving layer of the image receiving sheet, or the generation of a partial peeling of the toner layer, or the increase of the flexure of the rotating axis of the adhesive roller is generated. Further, when the foreign material removal objective surface is the recording medium surface fixing member (plate) to fix the sheet placed on the rotating drum for the recording, or the surface of the rotating drum for the recording or the opposite side roller, because the pressing force of the adhesive member is large, the rotation resistance force is increased, thereby, the normal rotation movement is prevented.

Further, in order to conduct the good foreign material removal by the adhesive roller, the distance (diameter) R from the rotating axis center O of the adhesive roller 520 as shown in FIG. 507 and Table 502, to the outer surface of the adhesive member 522, and the thickness t of the adhesive member 522, and the radius r of the regulation disk 523 are related with each other.

in the present embodiment, when the distance R from the rotating axis center O of the adhesive roller 520 to the outer surface of the adhesive member is 20 mm, and the thickness t of the adhesive member is 4 mm, the radius r is changed to various values and respective results are compared.

TABLE 5

| r (mm) | (R-r)/t | When foreign material removal objective surface is image receiving sheet, or transfer sheet | When foreign material removal objective surface is rotating drum for recording, or medium surface fixed member (plate) |
|---|---|---|---|
| 20 | 0 | foreign material removal is poor | foreign material removal is poor |
| 19.8 | 0.05 | foreign material removal is good | foreign material removal is good |
| 19 | 0.25 | foreign material removal is fine | foreign material removal is fine |
| 18 | 0.5 | foreign material removal is fine | foreign material removal is fine |
| 17.6 | 0.6 | a portion of sheet is peeled, or film is peeled | rotation resistance of drum is slightly increased, or plate is dislocated |
| 17.2 | 0.7 | sheet is peeled, or film is peeled | rotation resistance of drum is increased, or plate is separated |

As can be seen from Table 5, when the value of (R−r)/t is 0, the adhesive strength to the foreign material removal objective surface is very weak, thereby, the poor foreign material removal is caused, and it becomes a cause of generation of the image defect such as the image reversing or ring unevenness. When the value of (R−r)/t is in the range of 0.05-0.5, the adhesive roller is closely contacted with the transfer sheet or rotating drum for the recording, and the adhesion-removal of the foreign material is finely conducted. When the value of (R−r)/t is 0.6 or 0.7, the compression deformation amount of the adhesive member becomes too large, and by the peeling of the toner layer of the transfer sheet or unbalance of the pressing force by the increase of the flexure amount of the rotating axis of the adhesive roller, or the increase of the rotation resistance force to the rotating drum for the recording, there is lowering of the number of drum rotation. Further, the recording medium fixing member is not limited to the cylindrical shape such as the rotating drum, but, it may also be the plane shape and a member which moves in the horizontal direction to the plane.

As described above, the adhesive roller according to the present invention has the diameter smaller than the outer diameter of the adhesive member at both ends of the cylindrical shape core portion on which the movement section and the adhesive member are provided, and respectively provided with the regulation disks arranged outside both end surfaces of the core portion, thereby, when the adhesive roller is moved and pressed onto the foreign material removal objective surface, the compression deformation amount of the adhesive member is regulated by the regulation disk, and thereby, the excessive pressing of the adhesive roller is prevented, and the foreign material adhered onto the foreign material removal objective surface can be adherence-removed by the constant compression amount of the adhesive member, and the image defect such as the image reversing or ring unevenness is not generated, and the good image transfer is conducted always.

What is claimed is:

1. A recording apparatus comprising:

a recording medium fixing member having a plurality of suction ports on a fixed surface to fix a recording medium;

an adhering roller which is operable to contact with or operable to separate from the recording medium fixing member and which cleans the fixed surface;

a flexible plate which is attached onto the fixed surface of the recording medium fixing member and whose contact surface with the recording medium is cleaned by the adhering roller, the flexible plate comprising a plurality of distributed holes; and a suction apparatus for recording medium fixing which sucks air from the suction ports of the recording medium fixing member and sucks and fixes the flexible plate and the recording medium onto the fixed surface, wherein the plurality of distributed holes in the flexible plate coincide to a degree with the plurality of suction ports on the fixed surface of the recording medium fixing member such that suction from the suction apparatus is transmitted through the flexible plate to the recording medium.

2. A recording apparatus according to claim 1, wherein the adhesive strength of the adhering roller is 10-65 Hpa.

3. A recording apparatus according to claim 1, the hardness of the adhering roller 10-70°.

4. A recording apparatus according to claim 1, wherein at least either one of the recording medium fixing member or the adhering roller which are under a contacting condition with each other, is driven, and both of them are synchronously rotated.

5. A recording apparatus according to claim 1, wherein the recording medium fixing member is disposed to one side of the flexible plate and the recording medium is disposed on another side of the flexible plate.

6. A recording apparatus according to claim 1, wherein the plurality of distributed holes in the flexible plate that coincide to the degree with the plurality of suction ports on the fixed surface of the recording medium fixing member are arranged such that at least one of the plurality of distributed holes is disposed directly over a corresponding at least one of the plurality of suction ports.

7. A foreign material removal method of a recording medium of a recording device comprising a recording medium fixing member having a plurality of suction ports on a fixed surface of the recording medium, an adhering roller which cleans the fixed surface of a recording medium fixing member, a flexible plate which is attached onto the fixed surface of the recording medium fixing member, and a suction apparatus for recording medium fixing which sucks air from the suction port of the recording medium fixing member and sucks and fixes the flexible plate and the recording medium onto the recording medium fixing member, said foreign material removal method comprising:

attaching the flexible plate onto the fixed surface of the recording medium fixing member, the flexible plate comprising a plurality of distributed holes; and cleaning the flexible plate using the adhering roller, wherein the plurality of distributed holes in the flexible plate coincide to a degree with the plurality of suction ports on the fixed surface of the recording medium fixing member such that suction from the suction apparatus is transmitted through the flexible plate to the recording medium.

8. A foreign material removal method of a recording medium of a recording device comprising a recording medium fixing member having a plurality of suction ports on a fixed surface of the recording medium, an adhering roller which cleans the fixed surface of a recording medium fixing member, a flexible plate which is attached onto the fixed surface of the recording medium fixing member and a suction apparatus for recording medium fixing which sucks air from the suction port of the recording medium fixing member and fixes by suction the flexible plate and the recording medium onto the recording medium fixing member, said foreign material removal method comprising:

attaching the flexible plate onto the fixed surface of the recording medium fixing member, the flexible plate being sucked and fixed onto the fixed surface by the suction apparatus for recording medium fixing and comprising a plurality of distributed holes, wherein the plurality of distributed holes in the flexible plate coincide to a degree with the plurality of suction ports on the fixed surface of the recording medium fixing member such that suction from the suction apparatus is transmitted through the flexible plate to the recording medium, and cleaning the flexible plate using the adhering roller.

9. A foreign material removal method of a recording medium of a recording device comprising a recording medium fixing member having a plurality of suction ports on a fixed surface of the recording medium, an adhering roller which cleans the fixed surface of a recording medium fixing member, a flexible plate which is attached onto the fixed surface of the recording medium fixing member, and a suction apparatus for recording medium fixing which sucks air from the suction port of the recording medium fixing member and sucks and fixes the flexible plate and the recording medium onto the recording medium fixing member, said foreign material removal method comprising:

cleaning the fixed surface using the adhering roller; and attaching the flexible plate onto the cleaned fixed surface of the recording medium fixing member, the flexible plate comprising a plurality of distributed holes, wherein the plurality of distributed holes in the flexible plate coincide to a degree with the plurality of suction ports on the fixed surface of the recording medium fixing member such that suction from the suction apparatus is transmitted through the flexible plate to the recording medium.

10. A cleaning method of a recording medium having a length parallel to a main scanning direction, the cleaning method comprising:

first removing foreign material on the recording medium surface, the first removing comprising:

bringing a cleaning roller having an adhesion property into contact with the recording medium sucked and fixed on a surface of a recording medium fixing member, the cleaning roller being in contact at about a middle portion of the length of the recording medium, and relatively moving the cleaning roller in contact with the recording medium, in a first main scanning direction toward an end of the recording medium, and second removing foreign material on the recording medium surface, the second removing comprising:

bringing the cleaning roller into contact with the recording medium sucked and fixed on the surface of recording medium fixing member, the cleaning roller being in contact at about the middle portion of the length of the recording medium, and relatively moving the cleaning roller in contact with the recording medium, in a second main scanning direction opposite to the first main scanning direction, toward another end of the recording medium.

11. A cleaning method of the recording medium according to claim 10, wherein the at about the middle portion of the length of the recording medium is positioned within a range of 50% of the length of the recording medium from the middle of the length.

12. A cleaning method of the recording medium according to claim 10, wherein the at about the middle portion of the length of the recording medium is positioned within a range of ±25% of the length of the recording medium from the middle of the length.

13. A cleaning method of the recording medium according to claim 10, wherein a first cleaning area from the at about the middle portion of the length of the recording medium to the end of the recording medium overlaps with a second cleaning area from the at about the middle portion of the length of the recording medium to the other of the recording medium.

14. A cleaning method of the recording medium according to claim 13, wherein an overlap amount of the first cleaning area with the second cleaning area is not larger than 45% of the length of the recording medium.

15. A recording method comprising:

conducting a recording corresponding to the character image data on a recording medium sucked and fixed onto a surface of a recording medium fixing member, wherein a cleaning roller having an adhesion property provided oppositely to the recording medium fixing member in such a manner that the cleaning roller is operable to contact or operable to from the fixed recording medium, and a control section which controls a contact motion and a separation motion of the cleaning roller and a relative movement motion of the recording medium fixing member and the cleaning roller according to the cleaning method of the recording medium of claim 10, are provided.

16. A recording method according to claim 15, wherein the recording medium fixing member is a rotating drum for the recording which is rotated with the recording medium fixed on a peripheral surface thereof.

17. A cleaning method of a recording medium having a length parallel to a main scanning direction, the cleaning method comprising:

first removing foreign material on the recording medium surface, the first removing comprising:

bringing a cleaning roller having an adhesion property into contact with the recording medium sucked and fixed on a surface of a recording medium fixing member, the cleaning roller being in contact at about a middle portion of the length of the recording medium, relatively moving the cleaning roller in contact with the recording medium, in a first main scanning direction toward an end of the recording medium to remove foreign material on the recording medium surface, and separating the cleaning roller from the recording medium fixing member surface, and second removing foreign material on the recording medium surface, the second removing comprising:

bringing the cleaning roller into contact with the recording medium sucked and fixed on the surface of recording medium fixing member, the cleaning roller being in contact at about the middle portion of the length of the recording medium, relatively moving the cleaning roller in contact with the recording medium, in a second main scanning direction opposite to the first main scanning direction, toward another end of the recording medium, and separating the cleaning roller from the recording medium fixing member surface.

18. A cleaning method of a recording medium having a length parallel to a main scanning direction, the cleaning method comprising:

first removing foreign material on the recording medium surface, the first removing comprising:

bringing a cleaning roller having an adhesion property into contact with the recording medium sucked and fixed on a surface of a recording medium fixing member, the cleaning roller being in contact at about a middle portion of the length of the recording medium, and first relatively moving the cleaning roller in contact with the recording medium, in a first main scanning direction toward an end of the recording medium, and separating the cleaning roller from the recording medium fixing member surface, and second removing foreign material on the recording medium surface, the second removing comprising:

bringing the cleaning roller into contact with the recording medium sucked and fixed on the surface of recording medium fixing member, the cleaning roller being in contact at about the middle portion of the length of the recording medium, and second relatively moving the cleaning roller in contact with the recording medium, in a reverse direction of the first relatively moving, and separating the cleaning roller from the recording medium fixing member surface.

* * * * *